US010096411B2

(12) United States Patent
Hu et al.

(10) Patent No.: US 10,096,411 B2
(45) Date of Patent: Oct. 9, 2018

(54) BONDED LA(FE,SI)13-BASED MAGNETOCALORIC MATERIAL AND PREPARATION AND USE THEREOF

(75) Inventors: Fengxia Hu, Beijing (CN); Ling Chen, Beijing (CN); Lifu Bao, Beijing (CN); Jing Wang, Beijing (CN); Baogen Shen, Beijing (CN); Jirong Sun, Beijing (CN); Huayang Gong, Yichang (CN)

(73) Assignees: INSTITUTE OF PHYSICS, CHINESE ACADEMY OF SCIENCES, Beijing (CN); HUBEI QUANYANG MAGNETIC MATERIALS MANUFACTURING CO., LTD., Yichang, Hubei (CN)

( * ) Notice: Subject to any disclaimer, the term of this patent is extended or adjusted under 35 U.S.C. 154(b) by 463 days.

(21) Appl. No.: 14/359,685

(22) PCT Filed: May 17, 2012

(86) PCT No.: PCT/CN2012/075662
§ 371 (c)(1),
(2), (4) Date: Oct. 27, 2014

(87) PCT Pub. No.: WO2013/075468
PCT Pub. Date: May 30, 2013

(65) Prior Publication Data

US 2015/0047371 A1 Feb. 19, 2015

(30) Foreign Application Priority Data

Nov. 22, 2011 (CN) ..... 2011 1 0374158

(51) Int. Cl.
*B22F 1/00* (2006.01)
*B22F 3/02* (2006.01)
(Continued)

(52) U.S. Cl.
CPC ..... *H01F 1/015* (2013.01); *F25B 21/00* (2013.01); *F25B 2321/002* (2013.01)

(58) Field of Classification Search
None
See application file for complete search history.

(56) References Cited

U.S. PATENT DOCUMENTS 5,186,765 A 2/1993 Arai et al.
5,449,416 A 9/1995 Arai et al.
(Continued)

FOREIGN PATENT DOCUMENTS

CN 1450190 A 10/2003
CN 101477864 A 7/2009
(Continued)

OTHER PUBLICATIONS

International Search Report for International Application No. PCT/CN2012/083420.
(Continued)

*Primary Examiner* — Xiaowei Su
(74) *Attorney, Agent, or Firm* — Cantor Colburn LLP

(57) ABSTRACT

Provided is a high-strength, bonded La(Fe, Si)$_{13}$-based magnetocaloric material, as well as a preparation method and use thereof. The magnetocaloric material comprises magnetocaloric alloy particles and an adhesive agent, wherein the particle size of the magnetocaloric alloy particles is less than or equal to 800 μm and are bonded into a massive material by the adhesive agent; the magnetocaloric alloy particle has a $NaZn_{13}$-type structure and is represented by a chemical formula of $La_{1-x}R_x(Fe_{1-p-q}Co_pMn_q)_{13-y}Si_yA_\alpha$, wherein R is one or more selected from elements cerium (Ce), praseodymium (Pr) and neodymium (Nd), A is one or more selected from elements C, H and B, x is in the range of $0 \le x \le 0.5$, y is in the range of $0.8 \le y \le 2$, p is in the range of
(Continued)

$0 \leq p \leq 0.2$, q is in the range of $0 \leq q \leq 0.2$, $\alpha$ is in the range of $0 \leq \alpha \leq 3.0$. Using a bonding and thermosetting method, and by means of adjusting the forming pressure, thermosetting temperature, and thermosetting atmosphere, etc., a high-strength, bonded $La(Fe, Si)_{13}$-based magnetocaloric material can be obtained, which overcomes the frangibility, the intrinsic property, of the magnetocaloric material. At the same time, the magnetic entropy change remains substantially the same, as compared with that before the bonding. The magnetic hysteresis loss declines as the forming pressure increases. And the effective refrigerating capacity, after the maximum loss being deducted, remains unchanged or increases.

16 Claims, 26 Drawing Sheets

(51) Int. Cl.
*H01F 1/01* (2006.01)
*F25B 21/00* (2006.01)

(56) References Cited

U.S. PATENT DOCUMENTS

| | | | | |
|---|---|---|---|---|
| 5,743,095 | A | 4/1998 | Gschneider, Jr. et al. | |
| 7,063,754 | B2 | 6/2006 | Fukamichi et al. | |
| 2005/0274454 | A1 | 12/2005 | Extrand | |
| 2006/0076084 | A1* | 4/2006 | Nakajima | B22D 11/001 148/101 |
| 2006/0231163 | A1* | 10/2006 | Hirosawa et al. | H01F 1/015 148/105 |
| 2009/0071572 | A1 | 3/2009 | Fujita et al. | |
| 2010/0004960 | A1 | 2/2010 | Katter | |
| 2010/0047527 | A1 | 2/2010 | Katter | |
| 2010/0116471 | A1* | 5/2010 | Reppel | B22F 3/02 165/133 |
| 2011/0020661 | A1* | 1/2011 | Waeckerle | C22C 33/0207 428/546 |
| 2011/0030939 | A1* | 2/2011 | Carroll | F25B 21/00 165/185 |
| 2011/0042608 | A1* | 2/2011 | Reesink | B22F 3/1028 252/67 |
| 2011/0173993 | A1 | 7/2011 | Muller et al. | |
| 2014/0290274 | A1 | 10/2014 | Hu et al. | |

FOREIGN PATENT DOCUMENTS

| | | | |
|---|---|---|---|
| CN | 101755312 | A | 6/2010 |
| EP | 0411591 | A2 | 2/1991 |
| EP | 2508279 | A1 | 10/2012 |
| JP | 200396547 | A | 4/2003 |
| JP | 2007-84897 | A | 4/2007 |
| JP | 200968077 | A | 4/2009 |
| JP | 2011518943 | A | 6/2011 |
| JP | 2011137218 | A | 7/2011 |
| WO | 2009090442 | A1 | 7/2009 |

OTHER PUBLICATIONS

English Abstract for CN1450190A.
Study on the granularity effect of Gd5Si2Ge2 giant magnetic entropy change alloy, functional materials, Niu Peili et al., 2004, supplement, vol. 35, pp. 626 to 629, Dec. 31, 2004 sections 3.2, 4.
English Machine Translation of Study on the granularity effect of Gd5Si2Ge2 giant magnetic entropy change alloy, functional materials, Niu Peili et al., 2004, supplement, vol. 35, pp. 626 to 629, Dec. 31, 2004 sections 3.2, 4.
International Search Report for International Application No. PCT/CN2012/075662.
English Translation of Abstract for CN101477864.
English Translation of Abstract for CN101755312.
English Translation of Abstract for JP2007-84897.
Final Office Action for U.S. Appl. No. 14/353,618, filed Jun. 6, 2014; dated Oct. 21, 2016; 8 pages.
Non-Final Office Action for U.S. Appl. No. 14/353,618, filed Jun. 6, 2014; dated Apr. 15, 2016; 20 pages.
Notice of Allowance for U.S. Appl. No. 14/353,618, filed Jun. 6, 2014; dated Jan. 17, 2017; 10 pages.
EPO Communication dated Apr. 5, 2017, in European Patent Application No. 12850893.4, 4 pages.
EPO Communication dated Jul. 8, 2016, in European Patent Application No. 12850893.4, 5 pages.
Extended European Search Report dated Jul. 10, 2015, in European Patent Application No. 12850893.4, 6 pages.
Japanese First Office Action dated Aug. 4, 2015, in Japanese Patent Application No. 2014-542683, with English translation, 6 pages.
Japanese Second Office Action dated Jun. 7, 2016, in Japanese Patent Application No. 2014-542683, with English translation, 6 pages.

* cited by examiner

BONDED LA(FE,SI)13-BASED MAGNETOCALORIC MATERIAL AND PREPARATION AND USE THEREOF

CROSS REFERENCE TO RELATED APPLICATIONS

This application is a National Phase Application of Patent Application PCT/CN2012/075662 filed on May 17, 2012, which claims priority to CN 201110374158.1 filed on Nov. 22, 2011, the contents each of which are incorporated herein by reference thereto.

TECHNICAL FIELD

The present invention belongs to magnetocaloric material field. Particularly, the present invention relates to a high-strength, bonded $La(Fe,Si)_{13}$-based magnetocaloric material, as well as to the preparation and use thereof. More particularly, the present invention relates to a high-strength $La(Fe,Si)_{13}$-based magnetocaloric material obtained by an bonding and thermoset method using an adhesive agent such as epoxide-resin glue, polyimide adhesive and so on, as well as to the preparation and use thereof.

BACKGROUND ART

Over 15% of the total energy consumption is used for refrigeration. Now, the commonly used gas compression refrigeration technology has Carnot cycle efficiency up to only about 25%, and the gas refrigerant used in gas compression refrigeration damages atmospheric ozone layer and induces greenhouse effect. Therefore, exploration of pollution-free and environment friendly refrigeration materials and development of novel refrigeration technologies with low energy consumption and high efficiency become very urgent in the whole world.

Magnetic refrigeration technology, as characterized by environment friendly, energy efficient, stable and reliable, has drawn great attention worldwide in recent years. Several types of giant magnetocaloric materials at room temperature and even high temperature zone were found successionally in US, China, Holland and Japan, which significantly increased the expectation for environment friendly magnetic refrigeration technology, e.g. Gd—Si—Ge, $LaCaMnO_3$, Ni—Mn—Ga, $La(Fe,Si)_{13}$-based compound, Mn—Fe—P—As, MnAs-based compound, etc. Common features of these novel giant magnetocaloric materials lie in that their magnetic entropy changes are all higher than that of the traditional magnetic refrigeration material Gd working around room temperature (R. T.), their phase-transition properties are of the first-order, most of them show strong magnetocrystalline coupling characteristics, and magnetic phase transition is accompanied with distinct crystalline structural transition. These novel materials also show different features. For example, Gd—Si—Ge is not only expensive but also requires further purification of the raw material while being prepared. And the raw materials used to prepare Mn—Fe—P—As and MnAs-based compound, etc. are toxic; NiMn-based Heusler alloy shows large hysteresis loss, and so on.

Among the several novel materials found in the past over ten years, $La(Fe,Si)_{13}$-based compound is commonly accepted worldwide and has the highest potential for magnetic refrigeration application in a high temperature zone or even at R.T. This alloy has many characters shown as follows: the cost of its raw material is low; phase-transition temperature, phase-transition property and hysteresis loss may vary upon component adjustment; its magnetic entropy change around R.T. is higher than that of Gd by one fold. In the laboratories of many countries, $La(Fe,Si)_{13}$-based magnetic refrigeration material has been used for prototype test, which proved its refrigerating capacity is better than that of Gd.

The investigation also showed that the phase-transition property of $La(Fe,Si)_{13}$-based compounds varies with the adjustment of its components. For example, for the compounds with low Si amount, its phase-transition property is normally of the first-order in nature. Upon the increasing of Co content and rising of Curie temperature, the first-order nature of phase-transition property is weakened and gradually transmitted to the second order; hysteresis loss decreased gradually (no hysteresis loss for the second-order phase transition). However, due to the change of components and exchange interaction, the range of magnetocaloric effect was reduced in turn. Addition of Mn lowered the Curie temperature by impacting the exchange interaction; the first-order phase-transition property weakened; hysteresis loss decreased gradually; and the range of magnetocaloric effect was reduced in turn. In contrast, it was found that replacement of La with small rare earth magnetic atoms (e.g. Ce, Pr, Nd) can enhance the first-order phase-transition property; and increase hysteresis loss and the range of magnetocaloric effect. It was also found that introduction of interstitial atom (e.g. C, H, B, etc.) with small atomic radii can increase Curie temperature; and enable magnetocaloric effect to occur in a higher temperature zone. For instance, where the content of the interstitial atom H in molecular formula $LaFe_{11.5}Si_{1.5}H_{\alpha}$ increased from $\alpha=0$ to $\alpha=1.8$, the phase-transition temperature (peak temperature of magnetocaloric) was raised from 200K to 350K. It was expected that the first-order phase-transition $La(Fe,Si)_{13}$-based compound showing a giant magnetocaloric effect can be used in actual magnetic refrigeration application, so as to achieve ideal refrigerating effect.

However, $La(Fe,Si)_{13}$-based compounds (particularly, first-order phase-transition material) shows low compressive strength, fragile and poor corrosion resisting ability due to its strong magnetocrystalline coupling property (the intrinsic property of the material). Samples made from certain components have been cracked into pieces right after being made, and even pulverized naturally if being kept in air. Due to its fragility, the material, while used as a magnetic refrigeration material in a refrigeration cycle, is cracked into powder, which blocks the circulating path and thus reduces magnetic refrigeration efficiency and shorten refrigerator's lifetime.

Chinese patent application CN101755312A discloses a reactive sintered magnetic heat-exchanging material and a method for preparing the same. Said material comprises a $(La_{1-a}M_a)(Fe_{1-b-c}T_bY_c)_{13-d}$-based alloy prepared by the steps of mixing precursors or powders such as a La precursor, a Fe precursor and a Y precursor, etc.; compressing the mixture into a green body; sintering the green body at a temperature of 1000~1200° C. for a period of 2~24 hours to form a phase having a composition of $(La_{1-a}M_a)(Fe_{1-b-e}T_bY_c)_{13-d}$. Using such a ceramimetallurgical method, a $La(Fe,Si)_{13}$-based magnetocaloric material can be manufactured into a working material shape satisfying the requirement of a magnetic refrigerator. For example, a $La(Fe,Si)_{13}$-based room-temperature magnetocaloric material doped with Co, as normally having second-order phase-transition property (weak magnetocrystalline coupling, and magnetic phase transition accompanied with slower and weaker lattice expansion), can be manufactured by the ceramimetallurgical method into a working material shape satisfying the requirement of a sample machine. The resultant material processes certain compressive strength and shows no (or less) microcracks during the cyclic process. However, regarding a first-order phase-transition La(Fe,Si)$_{13}$-based material (strong magnetocrystalline coupling, and magnetic phase transition accompanied with significant lattice expansion), the working material with a regular shape manufactured by the ceramimetallurgical method unavoidably shows microcracks or breaks during the cyclic process, which means an undesired mechanical property thereby restricts the application of the material.

CONTENTS OF INVENTION

Therefore, an objective of the invention is to provide a high-strength, bonded La(Fe,Si)$_{13}$-based magnetocaloric material.

Another objective of the invention is to provide a method for preparing the high-strength, bonded La(Fe,Si)$_{13}$-based magnetocaloric material.

A further objective of the invention is to provide a magnetic refrigerator comprising the high-strength, bonded La(Fe,Si)$_{13}$-based magnetocaloric material.

Yet another objective of the invention is to provide use of the high-strength, bonded La(Fe,Si)$_{13}$-based magnetocaloric material in the manufacture of refrigerating materials.

These objectives are achieved by carrying out the technical solutions shown below.

The present invention provides a high-strength, bonded La(Fe,Si)$_{13}$-based magnetocaloric material, which comprises magnetocaloric alloy particles and an adhesive agent, wherein the magnetocaloric alloy particles have a particle size in the range of ≤800 μm, and are bonded into a massive material by the adhesive agent; wherein, the magnetocaloric alloy particles have a NaZn$_{13}$-type structure and is represented by a chemical formula:

$$La_{1-x}R_x(Fe_{1-p-q}Co_pMn_q)_{13-y}Si_yA_\alpha,$$

wherein,

R is one or more selected from elements cerium (Ce), praseodymium (Pr) and neodymium (Nd), A is one or more selected from elements carbon (C), hydrogen (H) and boron (B), x is in the range of $0 \le x \le 0.5$, y is in the range of $0.8 \le y \le 2$, p is in the range of $0 \le p \le 0.2$, q is in the range of $0 \le \le 0.2$, α is in the range of $0 \le \alpha \le 3.0$.

The present invention further provides a method for preparing said magnetocaloric material, which comprises the steps of 1) formulating raw materials according to the chemical formula, or formulating raw materials other than hydrogen according to the chemical formula where A includes hydrogen element;

2) placing the raw material formulated in step 1) in an arc furnace, vacuuming and purging it with an argon gas, and smelting it under the protection of an argon gas so as to obtain alloy ingots;

3) vacuum annealing the alloy ingots obtained in step 2) and then quenching the alloy ingots in liquid nitrogen or water, so as to obtain the magnetocaloric alloy $La_{1-x}R_x(Fe_{1-p-c}Co_pMn_q)_{13-y}Si_yA_\alpha$ having a NaZn$_{13}$-type structure;

4) crushing the magnetocaloric alloy obtained in step 3) so as to obtain magnetocaloric alloy particles with a particle size of ≤800 μm;

5) mixing an adhesive agent with the magnetocaloric alloy particles obtained in step 4) evenly, press forming and solidifying the mixture into a massive material;

wherein, when A in the chemical formula includes hydrogen element, the solidification in step 5) is performed in hydrogen gas.

The invention further provides a magnetic refrigerator, which comprises the magnetocaloric material according to the invention or the magnetocaloric material prepared by the method provided in the invention.

The invention also provides use of the magnetocaloric material according to the invention or the magnetocaloric material prepared by the method provided in the invention in the manufacture of refrigerating materials.

Compared with prior art, the present invention has advantages shown as follows:

(1) By introducing a small amount of adhesive agent into the La(Fe,Si)$_{13}$-based magnetocaloric material; using a thermosetting forming method; and adjusting the forming pressure, thermosetting temperature, thermosetting atmosphere and so on, a high-strength, bonded La(Fe,Si)$_{13}$-based magnetocaloric material can be obtained, thereby overcoming the intrinsic property, i.e. fragility of the material.

(2) Magnetic entropy change (a parameter characterizing magnetocaloric effect) range remains substantially the same, as compared with that before the bonding; the magnetic hysteresis loss declines as the forming pressure increases; and the effective refrigerating capacity, after the maximum loss being deducted, remains unchanged or enhanced.

(3) Refrigerating working materials may be manufactured into any shapes and sizes based on the actual need required by a magnetic refrigerator.

(4) The method of preparing the high-strength, bonded La(Fe,Si)$_{13}$-based magnetocaloric material according to the invention is simple, and can be operated and industrialized easily. Additionally, due to the low price (about 40~50 RMB/kg) of the adhesive agent used in the invention, the high-strength La(Fe,Si)$_{13}$-based magnetocaloric material prepared by the thermosetting forming method still has a cost efficient advantage, which is very important to the magnetic refrigerating application of this type of materials in practice.

DESCRIPTION OF DRAWINGS

The invention is further illustrated with reference to the following figures, wherein.

DETAILED DESCRIPTION OF THE INVENTION

Figure 1:
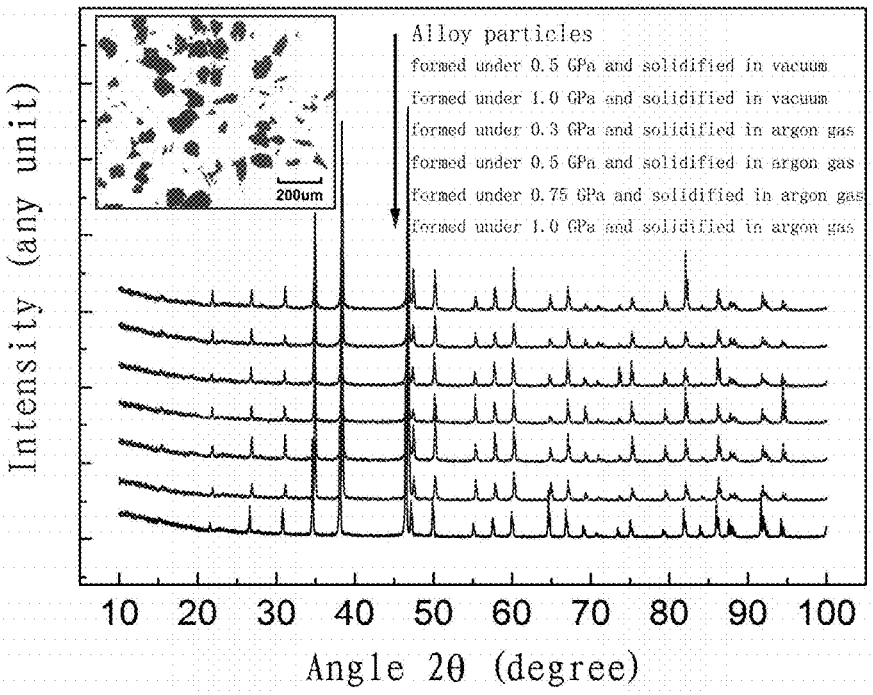
FIG. 1 shows the X-ray Diffraction (XRD) spectra, at room temperature, of the $LaFe_{11.6}Si_{1.4}C_{0.2}$ alloy particles and the massive material obtained by mixing the alloy particles with an adhesive agent, forming the mixture under different forming pressure and solidifying the formed material in argon atmosphere and in vacuum according to Example 1. The insert shows the pattern of the $LaFe_{11.6}Si_{1.4}C_{0.2}$ alloy particles obtained in step (4) of Example 1 in the invention.

The present invention is further described in details by referring to the objectives of the invention.

Particularly, the invention provides a high-strength $La(Fe,Si)_{13}$-based magnetocaloric material prepared by a bonding-thermosetting method using an adhesive agent (e.g. epoxide-resin glue, polyimide adhesive, etc.), a method for preparing the same and use thereof. It has been found by the inventors that by introducing an adhesive agent, using a thermosetting forming method, selecting a proper adhesive agent, adjusting forming pressure, thermosetting temperature and thermosetting atmosphere, etc., a high-strength, bonded $La(Fe,Si)_{13}$-based magnetocaloric material can be obtained. Magnetic entropy change (a parameter characterizing magnetocaloric effect) range remains substantially the same, as compared with that before the bonding; the magnetic hysteresis loss declines as the forming pressure increases; and the effective refrigerating capacity, after the maximum loss being deducted, remains unchanged or enhanced. In addition, the refrigerating working materials may be manufactured into any shapes and sizes based on the actual need required by a magnetic refrigerator. Epoxide-resin glue is an adhesive agent comprising epoxy resin as its main part and containing a corresponding curing agent and accelerating agent. Solidification period, solidification temperature, and mechanical parameters such as strength and tenacity, etc. of solidified material rely on the type and proportion of epoxy resin as well as the corresponding curing agent and accelerating agent. Moreover, due to the low price (about 40~50 RMB/kg) of the organic adhesive agents such as epoxide-resin glue, polyimide adhesive and the like, preparation of a high-strength $La(Fe,Si)_{13}$-based magnetocaloric material by a thermosetting forming method is very important to the magnetic refrigerating application of this type of materials in practice.

For better understanding of the invention, some terms are defined as follows. The terms defined herein have the meaning generally understood by those skilled in the art.

Unless otherwise indicated, the "$NaZn_{13}$-type structure" or "1:13 structure" corresponding to the terms "$LaFe_{13-x}M_x$" as used herein means a structure in which the space group is $Fm\bar{3}c$. Fe atom occupies two crystal sites 8b ($Fe^I$) and 96i ($Fe^{II}$) in a ratio of 1:12, respectively. La and $Fe^I$ atoms constitute CsCl structure, in which La atom is surrounded by 24 $Fe^{II}$ atoms; $Fe^I$ atom is surrounded by 12 $Fe^{II}$ atoms constituting an icosahedron; and around each $Fe^{II}$ atom, there are 9 nearest-neighbor $Fe^{II}$ atoms, 1 $Fe^I$ atom and 1 La atom. For $LaFe_{13-x}M_x$ (M=Al, Si) compound, its neutron diffraction experiment showed that the 8b site is fully occupied by Fe atom; and 96i site is occupied by M atom and the rest Fe atom randomly.

The invention provides a high-strength, bonded $La(Fe,Si)_{13}$-based magnetocaloric material, which comprises magnetocaloric alloy particles and an adhesive agent, wherein the magnetocaloric alloy particles have a particle size in the range of ≤800 μm, and are bonded into a massive material by the adhesive agent; wherein, the magnetocaloric alloy particles have a $NaZn_{13}$-type structure and is represented by a chemical formula:

$$La_{1-x}R_x(Fe_{1-p-q}Co_pMn_q)_{13-y}Si_yA_{\alpha},$$

wherein,

R is one or more selected from elements cerium (Ce), praseodymium (Pr) and neodymium (Nd), A is one or more selected from elements carbon (C), hydrogen (H) and boron (B), x is in the range of $0 \le x \le 0.5$, y is in the range of $0.8 \le y \le 2$, p is in the range of $0 \le p \le 0.2$, q is in the range of $0 \le q \le 0.2$, α is in the range of $0 \le \alpha \le 3.0$.

In the present invention, the composition of the magnetocaloric alloy is not specifically restricted, provided that it is a $La(Fe,Si)_{13}$-based magnetocaloric alloy having a main phase in a $NaZn_{13}$-type structure. Because the $La(Fe,Si)_{13}$-based magnetocaloric alloys having especially the properties of a first-order phase-transition shows low compressive strength, fragile and poor corrosion resisting ability, etc., the technical solutions involving a bonding step utilizing an adhesive agent according to the invention are very useful for the alloy described above.

Preferably, in the magnetocaloric material according to the invention, relative to 100 parts by weight of the magnetocaloric alloy particles; the adhesive agent is in an amount of 1~10 parts by weight, preferably 2~5 parts by weight. The adhesive agent can be selected from various adhesive agents commonly used in prior art, provided that it enables the magnetocaloric alloy particles of the invention to be bonded into a massive material. For instance, the adhesive agent can be selected from one or more of epoxide-resin glue, polyimide adhesive, or epoxy resin (EP), urea resin, phenol-formaldehyde resin, diallyl phthalate (DAP) and the like. Preferably, the adhesive agent used in the invention is selected from one or both of epoxide-resin glue and polyimide adhesive.

Preferably, the magnetocaloric material according to the invention can, while the magnetic field changes from 0 to 5 T, show an effective magnetic entropy change value of 1.0~50.0 J/kgK, more preferably 5.0~50.0 J/kgK and a range of phase-transition temperature of 10~450 K.

In the magnetocaloric material provided in the invention, the magnetocaloric alloy particles have a particle size in the range of preferably 15~800 μm, more preferably 15~200 μM.

It has been found by the inventors that when the particle size of the magnetocaloric alloy particles according to the invention is not greater than 200 μm, the bonded La (Fe, Si)$_{13}$-based magnetocaloric material of the invention also shows significantly reduced hysteresis loss, besides its high strength. As demonstrated in Example 6 of the invention, hysteresis loss was reduced gradually upon the decrease of the particle size. When the particle size was decreased into the range of 15~50 μm, the hysteresis loss was remarkably reduced by 64%.

In the chemical formula representing the magnetocaloric alloy particles of the invention, A represents interstitial atoms (e.g. carbon, hydrogen and boron) with small atomic radii. All these interstitial atoms, while added, occupy the 24d-interstitial position in the $NaZn_{13}$ structure and have the same impact on structure. As the number of the interstitial atoms is increased, the phase-transition temperature (the peak temperature of magnetocaloric effect) moves towards the higher temperature zone. For example, where the amount of interstitial atom H in molecular formula $LaFe_{11.5}Si_{1.5}H_\alpha$ was increased from $\alpha=0$ to $\alpha=1.8$, the phase-transition temperature is raised from 200K to 350K.

In a preferred embodiment of the invention, the magnetocaloric alloy particles are represented by a chemical formula:

$La_{1-x}R_x(Fe_{1-p}Co_p)_{13-y}Si_yA_\alpha$, wherein,

R is selected from one or more of elements Ce, Pr and Nd,

A is selected from one, two or three of elements H, C and B, x is in the range of $0 \le x \le 0.5$, y is in the range of $1 \le y \le 2$, p is in the range of $0 \le p \le 0.1$, $\alpha$ is in the range of $0 \le \alpha \le 2.6$.

The invention further provides a method of preparing the magnetocaloric material described above, which comprises the steps of:

1) formulating raw materials according to the chemical formula, or formulating raw materials other than hydrogen according to the chemical formula where A in the chemical formula includes hydrogen element;

2) placing the raw material formulated in step 1) in an arc furnace, vacuuming and purging it with an inert gas, and smelting it under the protection of an inert gas so as to obtain alloy ingots, wherein the inert gas is preferably argon gas;

3) vacuum annealing the alloy ingots obtained in step 2) and then quenching the alloy ingots in liquid nitrogen or water, or furnace cooling the alloy ingots to room temperature, so as to obtain the magnetocaloric alloy $La_{1-x}R_x(Fe_{1-p-q}Co_pMn_q)_{13-y}Si_yA_\alpha$ having a $NaZn_{13}$-type structure;

4) crushing the magnetocaloric alloy obtained in step 3) so as to obtain magnetocaloric alloy particles with a particle size of ≤800 μm;

5) mixing the adhesive agent with the magnetocaloric alloy particles obtained in step 4) evenly, press forming and solidifying the mixture into a massive material;

wherein, when A in the chemical formula includes hydrogen element, the solidification in step 5) is performed in hydrogen gas.

According to one embodiment of the preparation method of the invention, in step 5), the adhesive agent was mixed with the magnetocaloric alloy particles by a dry or wet mixing method. The dry mixing method includes the step of mixing the pulverous adhesive agent as well as its curing agent and accelerating agent with the magnetocaloric alloy particles evenly; and the wet mixing method includes the steps of dissolving the adhesive agent as well as its curing agent and accelerating agent in an organic solvent to obtain a glue solution, adding the magnetocaloric alloy particles to the glue solution, mixing evenly and drying the mixture.

Preferably, in some embodiments of the invention, the dry and wet mixing methods are carried out as below:

Dry mixing method: the adhesive agent (e.g. epoxide-resin glue, polyimide adhesive, etc.) as well as its corresponding curing agent and accelerating agent (both are pulverous) are mixed with the magnetocaloric alloy particles, as dry powder, in proportion (relative to 100 parts by weight of the magnetocaloric alloy particles, the total amount of the adhesive agent, curing agent and accelerating agent is 10 parts by weight), and agitated evenly; wherein the curing agent is normally in an amount of 2~15 wt % of the adhesive agent and plays a role in solidification of the adhesive agent; and the accelerating agent is normally in an amount of 1~8 wt % of the adhesive agent and functions to reduce solidification temperature and shorten solidification period.

Wet mixing method: the adhesive agent as well as its curing agent and accelerating agent are dissolved proportionally in a mixture solution of acetone and absolute ethanol (generally, the curing agent is dissolvable in acetone and the accelerating agent is dissolvable in ethanol), to formulate a glue solution. The proportion (weight ratio) is as follow: "adhesive agent:curing agent:accelerating agent=100:(2~15):(1~8)". Dissolving method: the adhesive agent, curing agent and accelerating agent powder are weighted in proportion and poured into the acetone and absolute ethanol mixture solution (the amount of the acetone and absolute ethanol solution should be minimized, optimally just allowing the complete dissolution of the solute), and agitated to achieve complete dissolution of the powder. Then the resultant glue solution is mixed with the magnetocaloric alloy particles in proportion, agitated evenly and dried at 25~100° C.

According to one preferred embodiment of the preparation method of the invention, in step 5), the press forming is carried out under a compressing pressure of 100 MPa~20 GPa, preferably 0.1~2.5 GPa for a compressing period of 1~120 mins, preferably 1~10 mins Particularly, the mixture of the adhesive agent and alloy particles is press formed into shapes and sizes satisfying the requirement of magnetic refrigerators. The mixture of the adhesive agent and alloy particles is placed in a mould (in a shape and size determined in accordance with the actual needs of magnetic refrigerators for materials), press formed at room temperature, and then released from the mould.

According to another preferred embodiment of the preparation method of the invention, in step 5), solidification can be performed in inert gas or in vacuum. The solidification condition includes a solidification temperature of 70~250° C., a solidification period of 1~300 mins, and an inert gas pressure of $10^{-2}$ Pa~10 MPa or vacuum degree of <1 Pa.

Where A in the chemical formula includes hydrogen element, in step 5), the amount of hydrogen can be controlled by adjusting hydrogen pressure, solidification temperature and solidification period. Preferably, the hydrogen pressure can be $10^{-2}$ Pa~10 MPa; the solidification temperature can be 70~250° C., and the solidification period can be 1~300 mins. It should be pointed out that the amount of hydrogen absorbed by the alloy of the invention relies on the temperature and pressure during hydrogen absorption process. By regulating the temperature and pressure during hydrogen absorption, the amount of the absorbed hydrogen can be adjusted. In addition, the hydrogen absorption process can be performed under progressively increased pressures, and different amount of hydrogen can be absorbed if the hydrogen absorption process is terminated at different pressure.

In the present invention, the raw materials La and R can be commercially available elementary rare earth elements, or industrial-pure LaCe alloy and/or industrial-pure LaCePrNd mischmetal. Commercialized industrial-pure LaCe alloy normally has a purity of 95-98 at. % (atomic ratio) and an atomic ratio of La:Ce in the range of 1:1.6-1:2.3; and the industrial-pure LaCePrNd mischmetal normally has a purity of about 99 wt. %. The insufficience of La element in the material to be prepared, as compared with LaCe alloy, can be supplemented by elementary La. Similarly, industrial-pure LaCePrNd mischmetal can also be processed in accordance with above.

Where A in the chemical formula includes carbon and/or boron element(s), preferably the carbon and/or boron can be provided by FeC and/or FeB alloy(s), respectively. Since FeC and FeB alloys also contain Fe element, the amount of the added elementary Fe needs to be properly reduced, so that the ratio of the added elements still meets the requirement for the atomic ratio in the chemical formula of the magnetic material.

All the other raw materials in the chemical formula are commercially available elementary substance.

According to another preferred embodiment of the preparation method of the invention, specifically, the step 2) comprises steps of placing the raw material prepared in step 1) into an arc furnace; vacuuming the arc furnace to reach a vacuum degree less than $1\times10^{-2}$ Pa; purging the furnace chamber with argon gas having a purity higher than 99 wt. % once or twice; then filling the furnace chamber with the argon gas to reach 0.5-1.5 atm; and arcing; so as to obtain the alloy ingots; wherein each alloy ingot is smelted at 1500-2500° C. for 1-6 times repeatedly.

According to yet another preferred embodiment of the preparation method of the invention, specifically, the step 3) comprises steps of annealing the alloy ingots obtained in step 2) at 1000-1400° C., with a vacuum degree less than $1\times10^{-3}$ Pa, for 1 hour-60 days; then quenching the alloy ingots in liquid nitrogen or water, or furnace cooling the alloy ingots to room temperature.

The invention further provides a magnetic refrigerator, which comprises a magnetocaloric material according to the invention or the magnetocaloric material prepared by a method provided in the invention.

The invention also provides use of a magnetocaloric material according to the invention or a magnetocaloric material prepared by a method provided in the invention in the manufacture of refrigerating materials.

Specific Modes for Carrying Out the Invention

The invention is further described by referring to the Examples. It needs to be clarified that the following Examples are provided for the purpose of illustrating the invention only and are not intended to restrict the scope of the invention by any means. Any modification made by a person skilled in the art in light of the invention shall belong to the extent sought to be protected by the claims of the application.

The raw materials and equipments used in the Examples are described as follows:

(1) Raw materials La, Ce, Pr, Fe, Co, Mn, Si, FeC and the purities thereof are shown as follows. Elementary La with a purity of 99.52 wt. % and elementary Pr with a purity of 98.97 wt. % were purchased from Hunan Shenghua Rare Earth Metal Material Ltd. Industrial-pure raw material LaCePrNd mischmetal was purchased from Inner Mongolia Baotou Steel Rare Earth International Trade Ltd., with two different purities: (a) the industrial-pure LaCePrNd mischmetal having a purity of 99.6 wt. % used in Example 3 (La, Ce, Pr, Nd elements are in a ratio of 28.27 wt. % La:50.46 wt. % Ce:5.22 wt. % Pr:15.66 wt. % Nd), and (b) the industrial-pure LaCePrNd mischmetal having a purity of 98.2 wt. % used in Examples 7 and 9 (La, Ce, Pr, Nd elements are in a ratio of 25.32 wt. % La:52.85 wt. % Ce:4.52 wt. % Pr: 15.51 wt. % Nd). Industrial-pure LaCe alloy was purchased from Inner Mongolia Baotou Steel Rare Earth International Trade Ltd., with a purity of 99.17 wt. % and a La:Ce atomic ratio of 1:1.88. Elementary Fe with a purity of 99.9 wt % was purchased from Beijing Research Institute for Nonferrous Metals; FeC (99.9 wt %, Fe, C weight ratio of 95.76:4.24) was smelted from elementary C and Fe having a purity of 99.9 wt %; FeB alloy (99.9 wt. %, Fe, B weight ratio of 77.6:22.4) was purchased from Beijing Zhongke Sanhuan High Technology Ltd.; Si (99.91 wt %) was purchased from Beijing Research Institute for Nonferrous Metals; Co (99.97 wt %) was purchased from Beijing Research Institute for Nonferrous Metals; and Mn (99.8 wt. %) was purchased from Beijing Shuanghuan Chemical Reagent Factory. All the above raw materials were in blocks.

(2) Raw material "epoxide-resin BT-801 powder (corresponding curing agent and accelerating agent have been mixed in this product)" was purchased from BONT Surface Treatment Material Co., Ltd, Dongguan City, China; "superfine epoxy resin powder", "superfine latent Q curing agent (micronized dicyandiamide)" and "superfine latent SH-A100 accelerating agent" were purchased from Xinxi Metallurgical Chemical Co., Ltd, Guangzhou City, China; and raw materials polyimide adhesive agent powder and silane coupling agent were purchased from AlfaAesar (Tianjing) Chemical Co., Ltd.

(3) The arc furnace (Model: WK-II non-consumable vacuum arc furnace) was manufactured by Beijing Wuke Electrooptical Technology Ltd.; the Cu-targeted X-ray diffractometer (Model: RINT2400) was manufactured by Rigaku; and the Superconducting Quantum Interference Vibrating Sample Magnetometer (Model: MPMS (SQUID)

VSM) was manufactured by Quantum Design (USA). P-C-T (pressure-composition-temperature) tester was purchased from Beijing Zhongke Yuda Teaching Equipment Department. The oil hydraulic press (Model: 769YP-24B) was purchased from Keqi Hi-tech Company of Tianjin. The six-anvil hydraulic press (Model: DS-029B) was purchased from Jinan Foundry & Metalforming Machinery Research Institute, First Industry Department. The electronic universal testing machine (Model: CMT4305) was purchased from Shenzhen Sans Material Testing Co. Ltd.

Example 1: Preparation of High-Strength Magnetocaloric Material $LaFe_{11.6}Si_{1.4}C_{0.2}$ 1) The materials were prepared in accordance with the chemical formula $LaFe_{11.6}Si_{1.4}C_{0.2}$. The raw materials included La, Ce, Fe, Si and FeC. FeC alloy was used to provide C (carbon). The amount of the elementary Fe added thereto was reduced properly since the FeC alloy also contains Fe element, so that the proportion of each element added still met the requirement for the atomic ratio in the chemical formula of the magnetic material.

2) The raw materials formulated in step 1), after mixed, was loaded into an arc furnace. The arc furnace was vacuumized to a pressure of $2\times10^{-3}$ Pa, purged with high-purity argon with a purity of 99.996 wt % twice, and then filled with high-purity argon with a purity of 99.996 wt % to a pressure of 1 atm. The arc was struck (the raw materials were smelted together to form alloy after striking) to generate alloy ingots. Each alloy ingot was smelted at a temperature of 2000° C. repeatedly for 4 times. After the smelting, the ingot alloys were obtained by cooling down in a copper crucible.

3) After wrapped separately with molybdenum foil and sealed in a vacuumized quartz tube ($1\times10^{-4}$ Pa), the ingot alloy obtained from step 2) was annealed at 1080° C. for 30 days followed by being quenched in liquid nitrogen by breaking the quartz tube. As a result, $LaFe_{11.6}Si_{1.4}C_{0.2}$ alloy having a $NaZn_{13}$-type structure were obtained.

4) The $LaFe_{11.6}Si_{1.4}C_{0.2}$ alloy obtained in step 3) was divided into irregular particles with an average particle size in the range of 20~200 micron and a pattern of particles shown as the insert of FIG. 1.

5) A glue solution was prepared with the "epoxide-resin BT-801 powder (corresponding curing agent and accelerating agent have been mixed in this product)" purchased from BONT Surface Treatment Material Co., Ltd, Dongguan City, China. The weight ratio of acetone:absolute ethanol:BT-801 epoxide-resin glue was 1:1:1. Dissolving method: a solution of acetone and absolute ethanol, after mixed, was poured to BT-801 epoxide-resin powder; the mixture was agitated until the powder was dissolved completely in the solution, indicating the accomplishment of preparation of the glue solution. Then the resultant glue solution was poured to the $LaFe_{11.6}Si_{1.4}C_{0.2}$ particles obtained in step 4) according to a weight ratio as below: "alloy particles:BT-801 epoxide-resin powder"="100:2.5", mixed evenly, and laid flat in an oven at 50° C. until died out. The drying period was 180 mins.

6) The $LaFe_{11.6}Si_{1.4}C_{0.2}$ alloy particles (having been mixed with the adhesive agent) obtained in step 5) were press formed into a cylinder (diameter: 5 mm; height: 7 mm) The procedure is shown as below: the alloy particles were, after mixed with the adhesive agent, loaded into a mould (in a shape of cylinder with a diameter of 5 mm) made of high chromium carbide alloy tool steel; and press formed in an oil hydraulic press at room temperature. In the parallel experiments, pressures of 0.3 GPa, 0.5 GPa, 0.75 GPa and 1.0 GPa were chosen respectively for the forming process; and the forming period was 2 mins. After press formed, the material was released from the mould.

7) The cylinder formed in step 6) was solidified in argon atmosphere (argon pressure: 0.5 MPa) and in vacuum (vacuum degree: $1\times10^{-2}$ Pa), respectively. The solidification temperature was 170° C., and the solidification period was 30 mins. After solidification, a high-strength first-order phase-transition $LaFe_{11.6}Si_{1.4}C_{0.2}$ magnetocaloric material was obtained.

Performance Test

Figure 2:
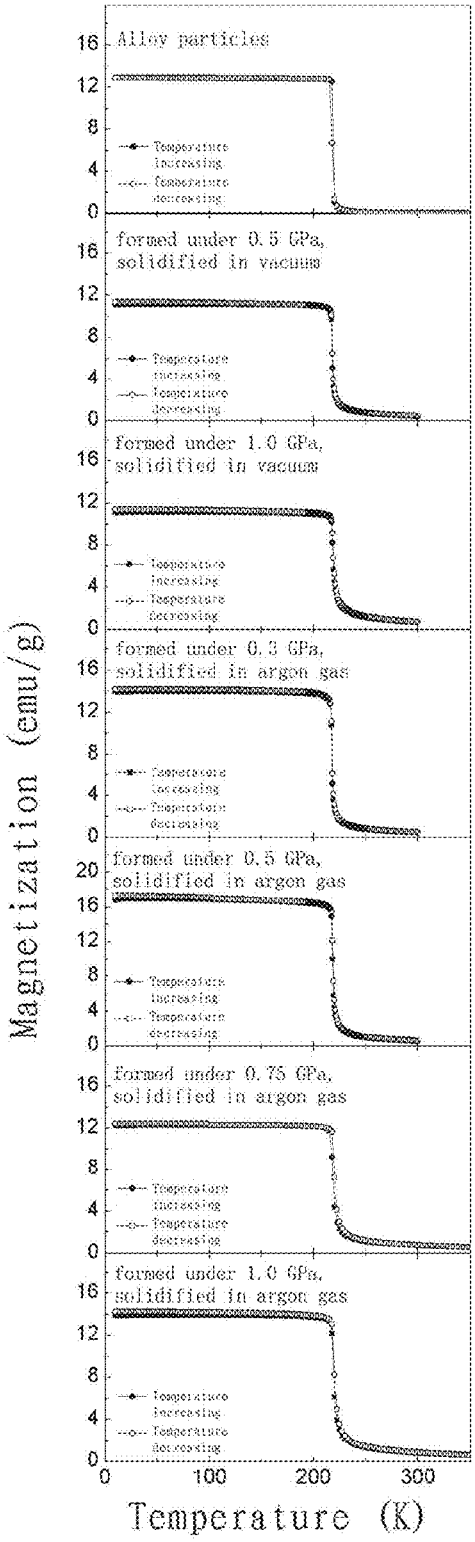
FIG. 2 shows the thermomagnetic (M-T) curves, in a magnetic field of 0.02 T, of the $LaFe_{11.6}Si_{1.4}C_{0.2}$ alloy particles and the massive material obtained by mixing the alloy particles with an adhesive agent, forming the mixture under different forming pressure and solidifying the formed material in argon atmosphere and in vacuum according to Example 1.
Figure 3:
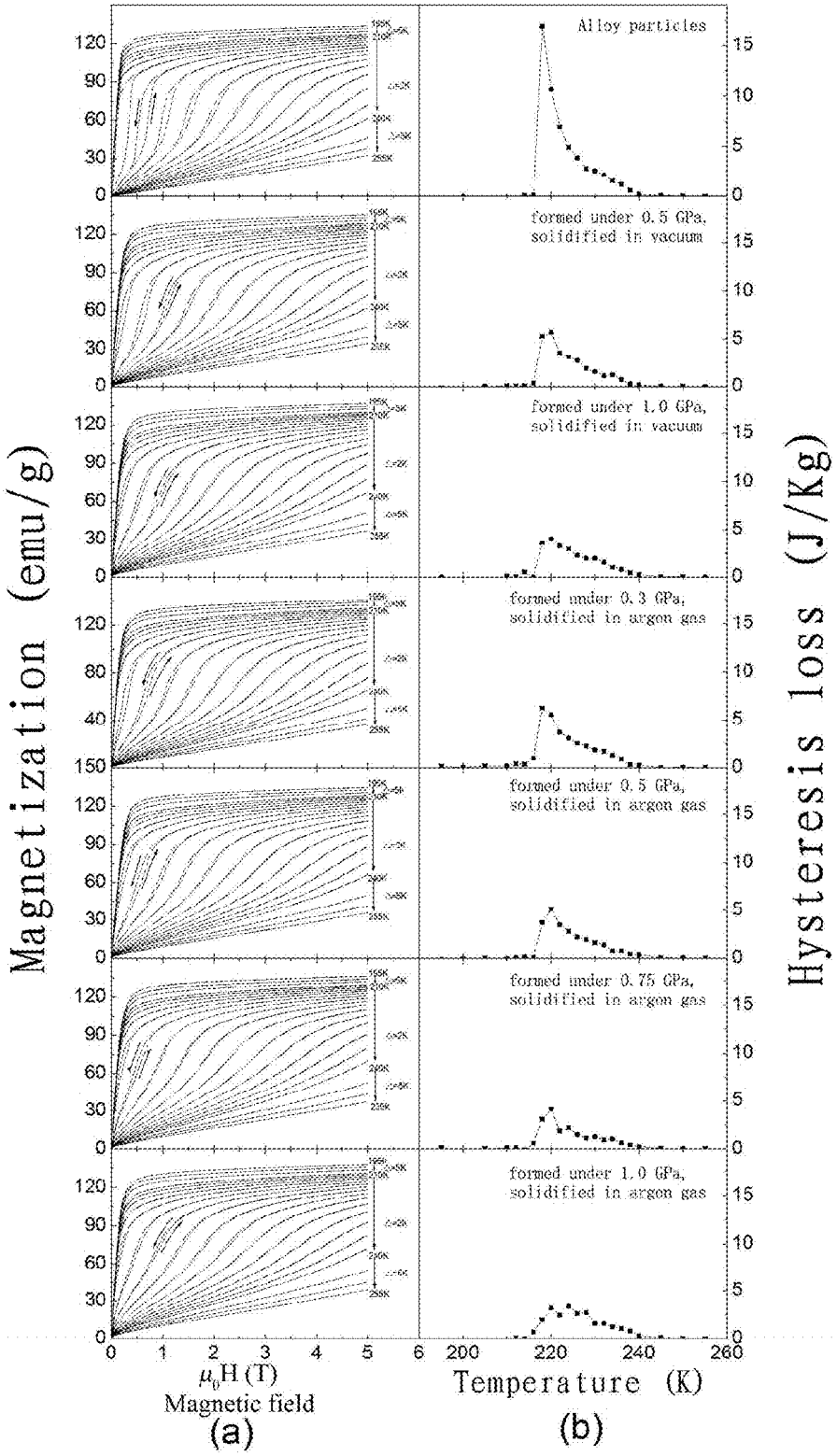
FIG. 3 shows the magnetization curves (M-H curve), at different temperatures, in the process of increasing and decreasing the field, of the $LaFe_{11.6}Si_{1.4}C_{0.2}$ alloy particles and the massive material obtained by mixing the alloy particles with an adhesive agent, forming the mixture under different forming pressure and solidifying the formed material in argon atmosphere and in vacuum according to Example 1; as well as the dependency of hysteresis loss on temperature.

I. The X-ray diffraction (XRD) spectra, at room temperature, were measured using the Cu-target X-ray diffractometer. FIG. 1 shows the comparison of XRD spectra for the $LaFe_{11.6}Si_{1.4}C_{0.2}$ alloy particles obtained in step 4) and the massive material obtained in step 7). These XRD results indicated that the $LaFe_{11.6}Si_{1.4}C_{0.2}$ alloy particles were crystallized into a $NaZn_{13}$-type structure and no obvious impurity phase was detected. For the samples obtained by mixing the alloy particles with an adhesive agent, forming the mixture under various pressures and then solidifying the formed material in different atmosphere (in argon atmosphere or in vacuum), no obvious α-Fe impurity phase or other impurity phase was detected. The added 2.5% epoxide-resin glue was organic, and its diffraction peak was not detected by the Cu-target X-ray diffraction technology II. The thermomagnetic curves (M-T curves), in a magnetic field of 0.02 T, were measured for the $LaFe_{11.6}Si_{1.4}C_{0.2}$ alloy particles obtained in step 4) and the massive material obtained in step 7). As shown in FIG. 2, the phase-transition temperatures of the alloy particles and the massive material after solidification in different conditions were maintained unchanged essentially, i.e. ~219K and the temperature hysteresis was <1K. The presence of inflection points in the magnetization curves (M-H curves, as shown in FIG. 3*a*) at different temperatures in the process of increasing and decreasing the field indicated that metamagnetic transition from paramagnetic to ferromagnetic state was induced by the magnetic field. It was also found that inflection points were present in M-H curves for the both cases before and after the solidification. FIG. 3*b* shows the dependency of hysteresis loss on temperature for the alloy particles obtained in step 4) and the massive material obtained in step 7). Both the temperature hysteresis and magnetic hysteresis indicate the first-order nature of the phase-transition material. The maximal magnetic hysteresis loss of the alloy particles and the massive materials solidified under different forming pressures of 0.3 GPa, 0.5 GPa, 0.75 GPa and 1.0 GPa and in argon atmosphere were 16.9 J/kg, 6.0 J/kg, 5.1 J/kg, 4.1 J/kg and 3.4 J/kg, respectively. For the massive materials upon the solidification under forming pressures of 0.5 GPa and 1.0 GPa and in vacuum, the maximal magnetic hysteresis loss were 5.7 J/kg and 4.0 J/kg, respectively. While the forming pressure was increased, the magnetic hysteresis loss was declined gradually. However, under the same forming pressure, solidification either in argon or in vacuum has little impact on the magnetic hysteresis loss.

Figure 4:
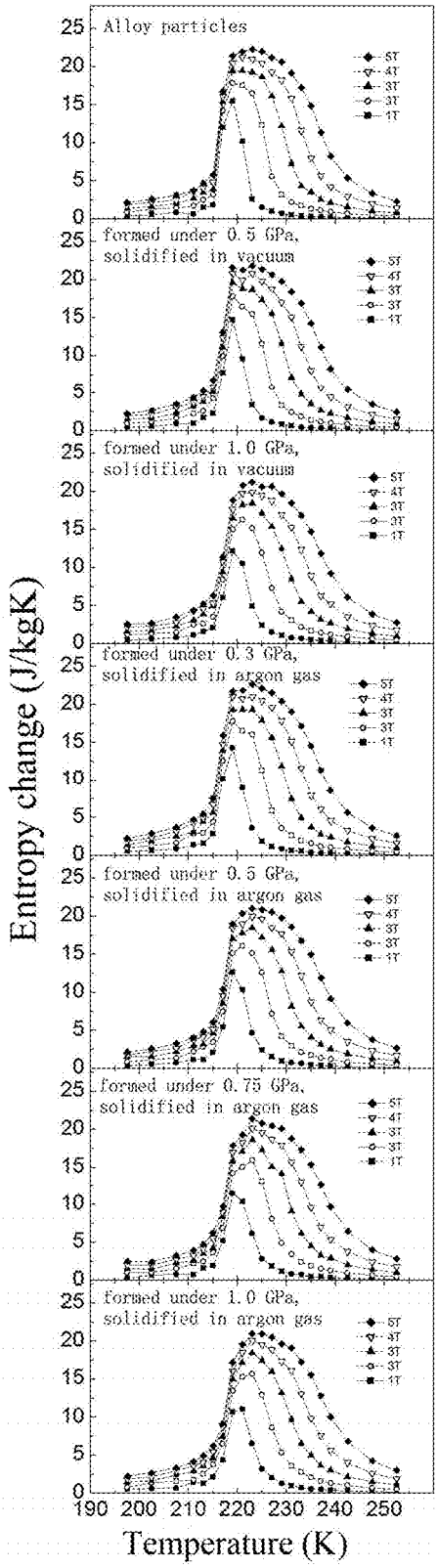
FIG. 4 indicates the dependency of magnetic entropy change (ΔS) on temperature, in various magnetic fields, for the $LaFe_{11.6}Si_{1.4}C_{0.2}$ alloy particles and the massive material obtained by mixing the alloy particles with an adhesive agent, forming the mixture under different forming pressure and solidifying the formed material in argon atmosphere and in vacuum according to Example 1 (calculation of ΔS in the process of increasing the field)

III. On the basis of the Maxwell's equation $$\Delta S(T, H) = S(T, H) - S(T, 0) = \int_0^H \left(\frac{\partial M}{\partial T}\right)_H dH,$$

the magnetic entropy change, ΔS, can be calculated according to the isothermal magnetization curve. FIG. 4 shows the dependency of ΔS on temperature, in various magnetic fields, for the $LaFe_{11.6}Si_{1.4}C_{0.2}$ alloy particles obtained in step 4) and the massive material formed under different pressures and solidified in argon atmosphere or in vacuum (calculation of ΔS in the process of increasing field). It was observed that the ΔS peak shape extended asymmetrically towards high-temperature zone while the field was increased. For the alloy particles as well as the massive material solidified under forming pressures of 0.3 GPa, 0.5 GPa, 0.75 GPa, 1.0 GPa and in argon atmosphere, the heights of the ΔS peak upon a magnetic field change from 0 T to 5 T were 22.3 J/kgK, 21.8 J/kgK, 21.0 J/kgK, 21.4 J/kgK and 21.0 J/kgK, respectively; the widths at half height were 21.17K, 21.54K, 20.27K, 21.04K and 21.35K, respectively; and the effective refrigerating capacities, after the maximum loss being deducted, were 388 J/kg, 403 J/kg, 364 J/kg, 374 J/kg and 377 J/kg, respectively. For the massive material solidified under forming pressures of 0.5 GPa, 1.0 GPa and in vacuum, the heights of the ΔS peak upon a magnetic field change from 0 T to 5 T were 21.6 J/kgK and 21.2 J/kgK, respectively; the widths at half height were 20.9K and 21.2K, respectively; and the effective refrigerating capacities, after the maximum loss being deducted, were 380 J/kg and 376 J/kg, respectively. It can be found that the effective refrigerating capacity after solidification was not decreased; instead it was maintained unchanged or enhanced.

Figure 5:
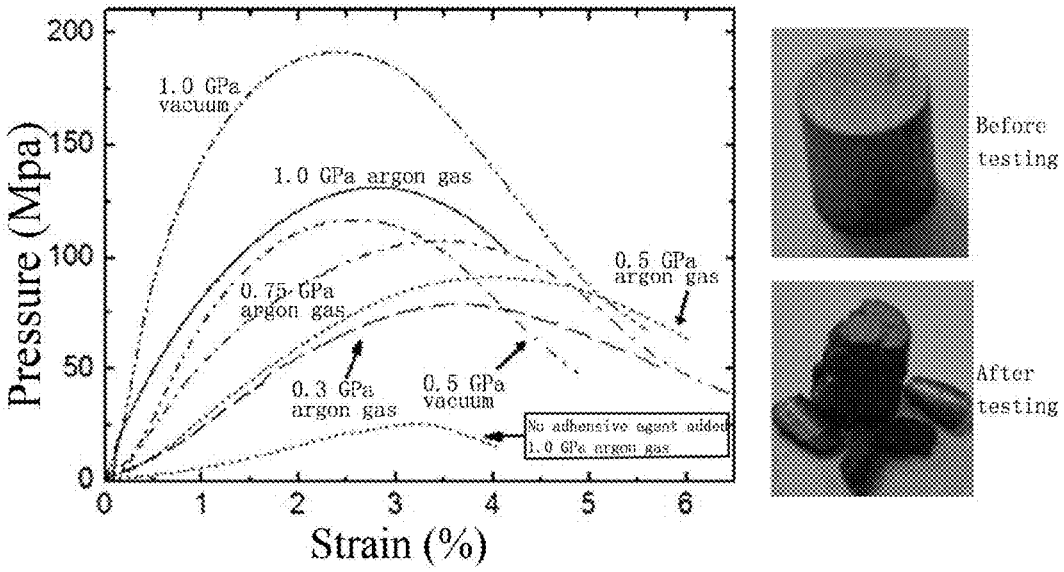
FIG. 5 shows the relation between the bearing pressure and strain of the massive material obtained in step (7) of Example 1, and the insert shows the pattern of the massive material and that after the crush under a pressure.
Figure 6:
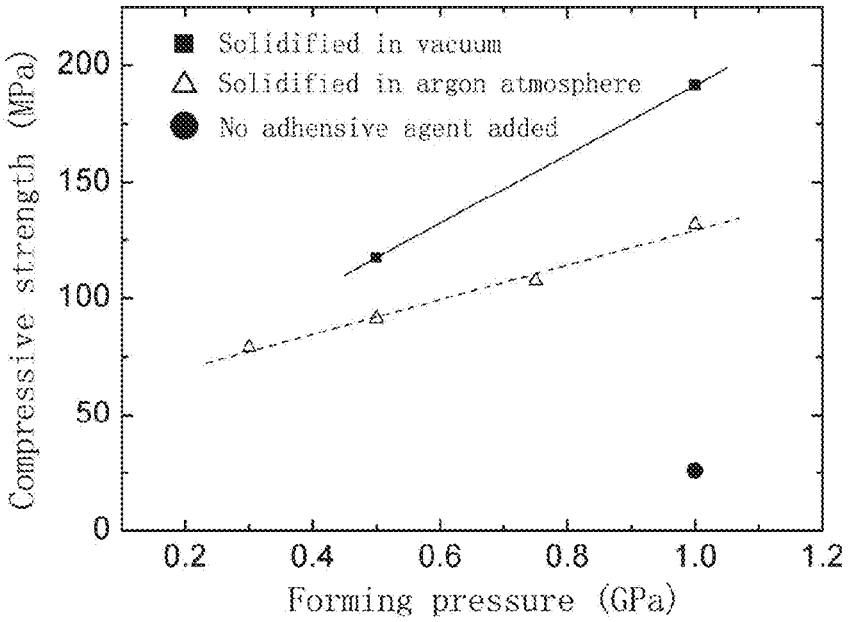
FIG. 6 shows the dependency of the compressive strength of the massive material obtained in step (7) of Example 1 on the forming pressure.

IV. The relation between the bearing pressure and strain was measured using an electronic universal testing machine (CMT4305) for the massive material formed under different forming pressures and solidified in argon atmosphere or in vacuum (as illustrated in FIG. 5, the insert shows the pattern of the material solidified and crushed under certain pressure), so as to achieve the dependency of compressive strength on forming pressure (as shown in FIG. 6). It can be found that the two samples obtained under the same forming pressure, 1.0 GPa and in argon atmosphere showed a compressive strength of 25.7 MPa before added to the adhesive agent and a compressive strength of 131.4 MPa, i.e. 5 fold higher, after added to epoxy resin adhesive. Additionally, the compressive strength was also increased significantly upon the increase of the forming pressure. Under the same forming pressure, solidification in vacuum can dramatically increase the compressive strength. For instance, the compressive strength of the material formed under 1.0 GPa and solidified in vacuum was up to 191.6 MPa, i.e. increased by 45.8% as compared with the circumstance in which the solidification was carried out in argon atmosphere; whereas both the magnetic entropy change and effective refrigerating capacity remained unchanged essentially.

Conclusion: after the introduction of epoxide-resin adhesive, the compressive strength of the materials was raised dramatically (5 fold higher as compared with the circumstance in which the same condition was applied except for no introduction of any adhesive agent); solidification either in argon atmosphere or in vacuum had no clear impact on the magnetic entropy change and hysteresis loss; both the magnetic entropy change and effective refrigerating capacity remained unchanged essentially before and after solidification, but the compressive strength was greatly enhanced if the solidification was carried out in vacuum.

Example 2: Preparation of High-Strength Magnetocaloric Material $La_{0.7}Ce_{0.3}Fe_{11.6}Si_{1.4}C_{0.2}$ 1) The materials were prepared in accordance with the chemical formula $La_{0.7}Ce_{0.3}Fe_{11.6}Si_{1.4}C_{0.2}$. The raw materials included industrial-pure LaCe alloy, Fe, Si, La and FeC, wherein elementary La was added to make up the La insufficience in the LaCe alloy and FeC alloy was used to provide C (carbon). The amount of the elementary Fe added thereto was reduced properly since the FeC alloy also contains Fe element, so that the proportion of each element added still met the requirement for the atomic ratio in the chemical formula of the magnetic material.

2) The raw materials prepared in step 1), after mixed, was loaded into an arc furnace. The arc furnace was vacuumized to a pressure of $2\times10^{-3}$ Pa, purged with high-purity argon with a purity of 99.996 wt % twice, and then filled with high-purity argon with a purity of 99.996 wt % to a pressure of 1 atm. The arc was struck (the raw materials were smelted together to form alloy after striking) to generate alloy ingots. Each alloy ingot was smelted at a temperature of 2000° C. repeatedly for 4 times. After the smelting, the ingot alloys were obtained by cooling down in a copper crucible.

3) After wrapped separately with molybdenum foil and sealed in a vacuumized quartz tube ($1\times10^{-4}$ Pa), the ingot alloy obtained from step 2) was annealed at 1080° C. for 30 days followed by being quenched in liquid nitrogen by breaking the quartz tube. As a result, $La_{0.7}Ce_{0.3}Fe_{11.6}Si_{1.4}C_{0.2}$ alloy having a $NaZn_{13}$-type structure were obtained.

4) The $La_{0.7}Ce_{0.3}Fe_{11.6}Si_{1.4}C_{0.2}$ alloy obtained in step 3) was crushed into irregular particles with an average particle size in the range of 20~200 micron.

5) A glue solution was prepared with the "epoxide-resin BT-801 powder (corresponding curing agent and accelerating agent have been mixed in this product)" purchased from BONT Surface Treatment Material Co., Ltd, Dongguan City, China. The weight ratio of acetone:absolute ethanol:BT-801 epoxide-resin glue was 1:1:1. Dissolving method: a solution of acetone and absolute ethanol, after mixed, was poured to BT-801 epoxide-resin powder; the mixture was agitated until the powder was dissolved completely in the solution, indicating the accomplishment of preparation of the glue solution. Then the resultant glue solution was poured to the $La_{0.7}Ce_{0.3}Fe_{11.6}Si_{1.4}C_{0.2}$ particles obtained in step 4) according to a weight ratio as below: "alloy particles:BT-801 epoxide-resin powder"="100:4.5", mixed evenly, and laid flat in an oven at 50° C. until died out. The drying period was 180 mins.

6) The $La_{0.7}Ce_{0.3}Fe_{11.6}Si_{1.4}C_{0.2}$ alloy particles (having been mixed with the adhesive agent) obtained in step 5) were press formed into a cylinder (diameter: 5 mm; height: 7 mm) The procedure is shown as below: the alloy particles were, after mixed with the adhesive agent, loaded into a mould (in a shape of cylinder with a diameter of 5 mm) made of high chromium carbide alloy tool steel; and press formed in an oil hydraulic press at room temperature. In the parallel experiments, pressures of 0.5 GPa, 0.75 GPa, 1.0 GPa and 1.3 GPa were chosen respectively in the forming process; and the forming period was 2 mins. After press formed, the material was released from the mould.

7) The cylinder formed in step 6) was solidified in vacuum (vacuum degree: $1\times10^{-2}$ Pa). The solidification temperature was 160° C., and the solidification period was 20 mins. After solidification, a high-strength, first-order phase-transition $La_{0.7}Ce_{0.3}Fe_{11.6}Si_{1.4}C_{0.2}$ magnetocaloric material was obtained.

Performance Test

Figure 7:
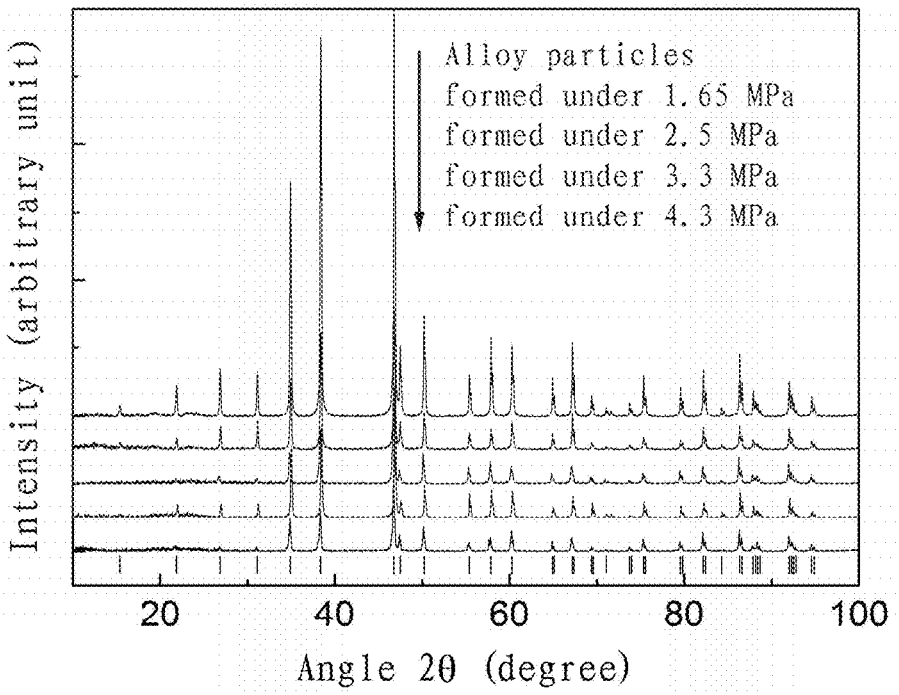
FIG. 7 shows the X-ray Diffraction (XRD) spectra, at room temperature, of the $La_{0.7}Ce_{0.3}Fe_{11.6}Si_{1.4}C_{0.2}$ alloy particles and the massive material obtained by mixing the alloy particles with an adhesive agent, forming the mixture under different forming pressure and solidifying the formed material in vacuum according to Example 2.

I. The X-ray diffraction (XRD) spectra, at room temperature were measured using the Cu-target X-ray diffractometer for the $La_{0.7}Ce_{0.3}Fe_{11.6}Si_{1.4}C_{0.2}$ alloy particles obtained in step 4) and the massive material formed under different forming pressure followed by solidification. The XRD results, as shown in FIG. 7, indicated that the $La_{0.7}Ce_{0.3}Fe_{11.6}Si_{1.4}C_{0.2}$ alloy particles were crystallized into a $NaZn_{13}$-type structure and no obvious impurity phase was detected. For the samples obtained by mixing the alloy particles with an adhesive agent, forming the mixture under various pressures and solidifying the formed material in vacuum, no obvious α-Fe impurity phase or other impurity phase was detected. The added 4.5% epoxide-resin glue was organic, and its diffraction peak was not detected by the Cu-target X-ray diffraction technology.

Figure 8:
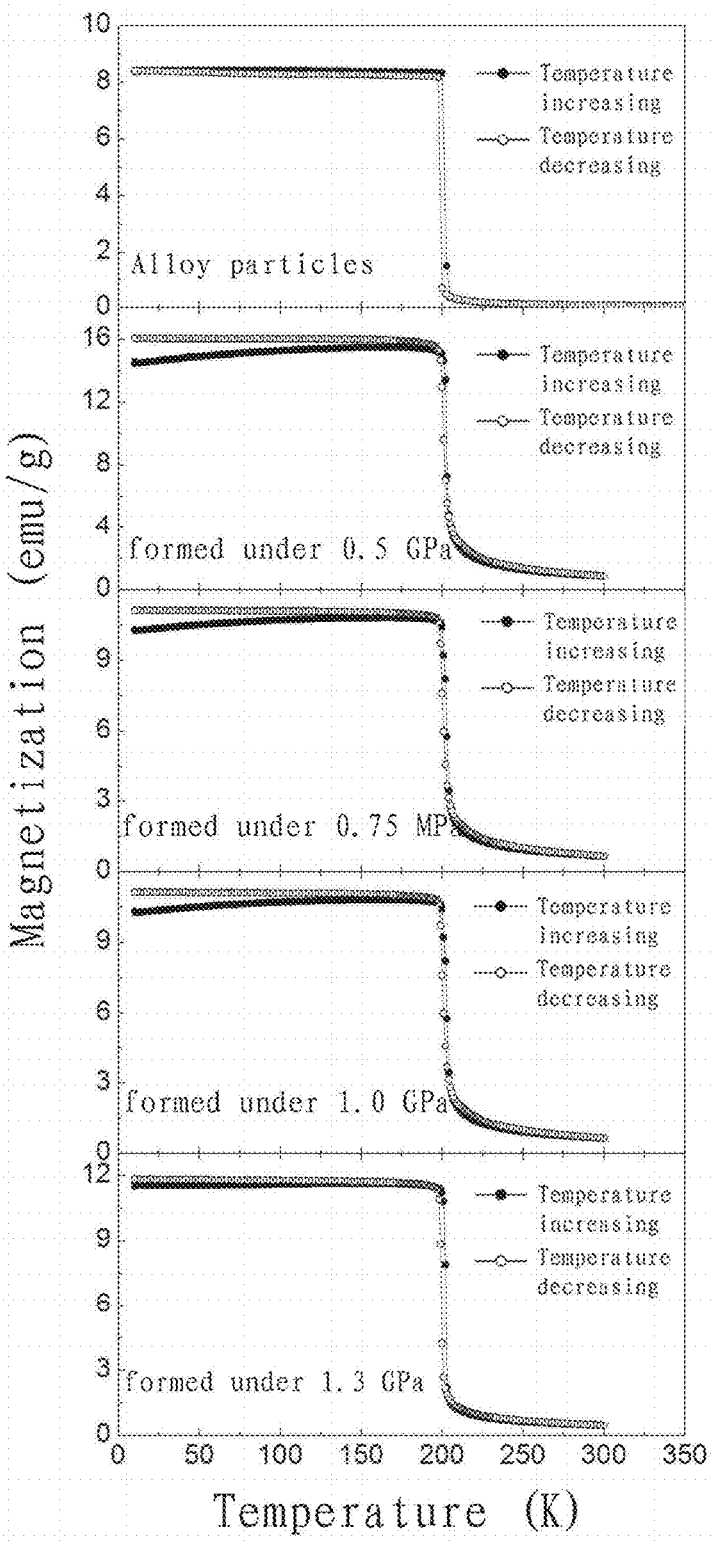
FIG. 8 shows the thermomagnetic (M-T) curves, in a magnetic field of 0.02 T, of the $La_{0.7}Ce_{0.3}Fe_{11.6}Si_{1.4}C_{0.2}$ alloy particles and the massive material obtained by mixing the alloy particles with an adhesive agent, forming the mixture under different forming pressure and solidifying the formed material in vacuum according to Example 2.
Figure 9:
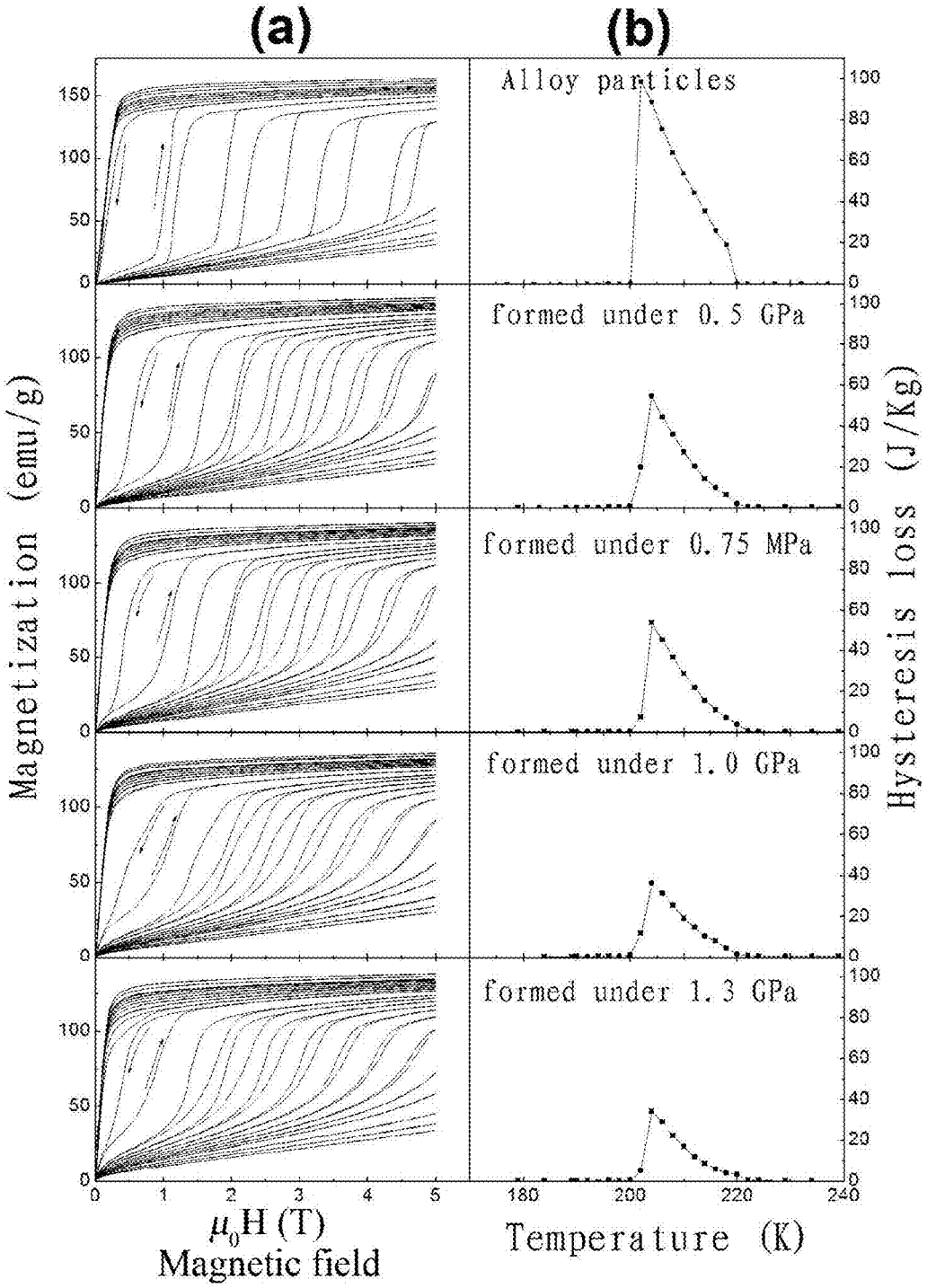
FIG. 9 shows the magnetization curves (M-H curve), at different temperatures, in the process of increasing and decreasing the field, of the $La_{0.7}Ce_{0.3}Fe_{11.6}Si_{1.4}C_{0.2}$ alloy particles and the massive material obtained by mixing the alloy particles with an adhesive agent, forming the mixture under different forming pressure and solidifying the formed material in vacuum according to Example 2; as well as the dependency of hysteresis loss on temperature.

II. The thermomagnetic curves (M-T curves), in a magnetic field of 0.02 T, were measured for the $La_{0.7}Ce_{0.3}Fe_{11.6}Si_{1.4}C_{0.2}$ alloy particles obtained in step 4) and the massive material formed under different pressure followed by solidification (as shown in FIG. 8). It can be found that the alloy particles showed a phase-transition temperature of ~219K and temperature hysteresis of 2K. After the solidification under forming pressures of 0.5 GPa, 0.75 GPa, 1.0 GPa and 1.3 GPa, the phase-transition temperature was shifted toward the high-temperature zone by 1-2K, i.e. located at 202K, 203K, 203K and 203K, respectively; and the temperature hysteresis was maintained unchanged essentially, i.e. 2K. The presence of inflection points in the magnetization curves (M-H curves, as shown in FIG. 9*a*) at different temperatures in the process of increasing and decreasing field indicated that metamagnetic transition from paramagnetic to ferromagnetic state was induced by the magnetic field. It was also found that clear inflection points were present in M-H curves for the both cases before and after the solidification. FIG. 9*b* shows the dependency of hysteresis loss on temperature for the alloy particles obtained in step 4) and the massive material obtained in step 7). The maximal magnetic hysteresis loss of the alloy particles and the massive materials solidified under the forming pressures 0.5 GPa, 0.75 GPa, 1.0 GPa and 1.3 GPa and in vacuum were 83 J/kg, 55 J/kg, 54 J/kg, 36 J/kg and 34 J/kg, respectively, indicating that the magnetic hysteresis loss declined gradually as the forming pressure was increased.

Figure 10:
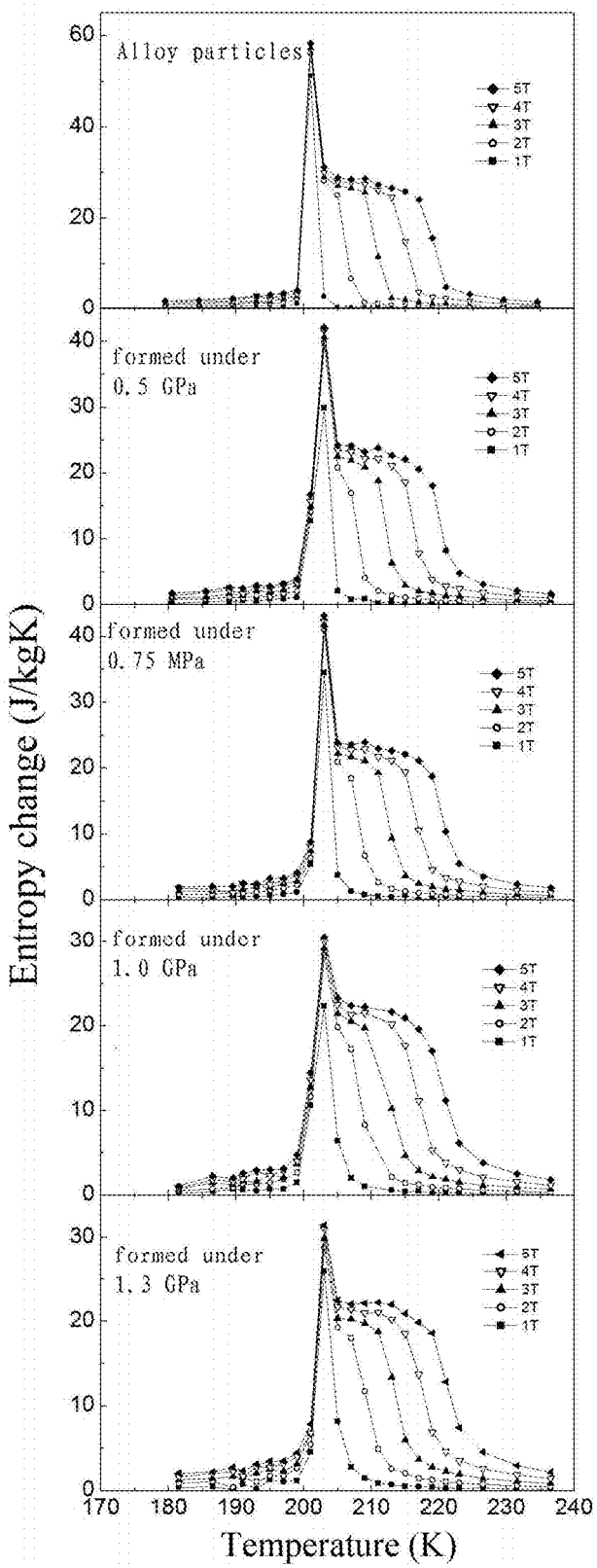
FIG. 10 indicates the dependency of magnetic entropy change (ΔS) on temperature, in various magnetic fields, for the $La_{0.7}Ce_{0.3}Fe_{11.6}Si_{1.4}C_{0.2}$ alloy particles and the massive material obtained by mixing the alloy particles with an adhesive agent, forming the mixture under different forming pressure and solidifying the formed material in vacuum according to Example 2 (calculation of ΔS in the process of increasing the field)

III. FIG. 10 shows the dependency of ΔS on temperature, in various magnetic fields, for the $La_{0.7}Ce_{0.3}Fe_{11.6}Si_{1.4}C_{0.2}$ alloy particles obtained in step 4) and the massive material formed under different pressure followed by solidification (calculation of ΔS in the process of increasing field). It was observed that the ΔS peak shape extended asymmetrically towards the high-temperature zone while the field was increased; the peak was followed by a plateau. According to previous studies, such an appearance of the ΔS peak is caused by the coexistence of two phases during the first-order phase transition, and the high ΔS spike is a false signal which does not involving thermal effect but the ΔS plateau reflects the essential property of magnetocaloric effect. For the alloy particles as well as the massive material formed under different pressures 0.5 GPa, 0.75 GPa, 1.0 GPa and 1.3 GPa followed by solidification, the heights of the ΔS plateaus under a magnetic field change from 0 T to 5 T were 26.4 J/kgK, 24.2 J/kgK, 23.8 J/kgK, 23.3 J/kgK and 22.5 J/kgK, respectively; the widths at half height were 19.6K, 20.0K, 19.2K, 20.3K and 20.1K, respectively; and the effective refrigerating capacities, after the maximum loss being deducted, were 375 J/kg, 389.1 J/kg, 362.4 J/kg, 379.6 J/kg and 374.3 J/kg, respectively. It can be found that the effective refrigerating capacity was not decreased after the solidification; instead it was maintained unchanged or enhanced.

Figure 11:
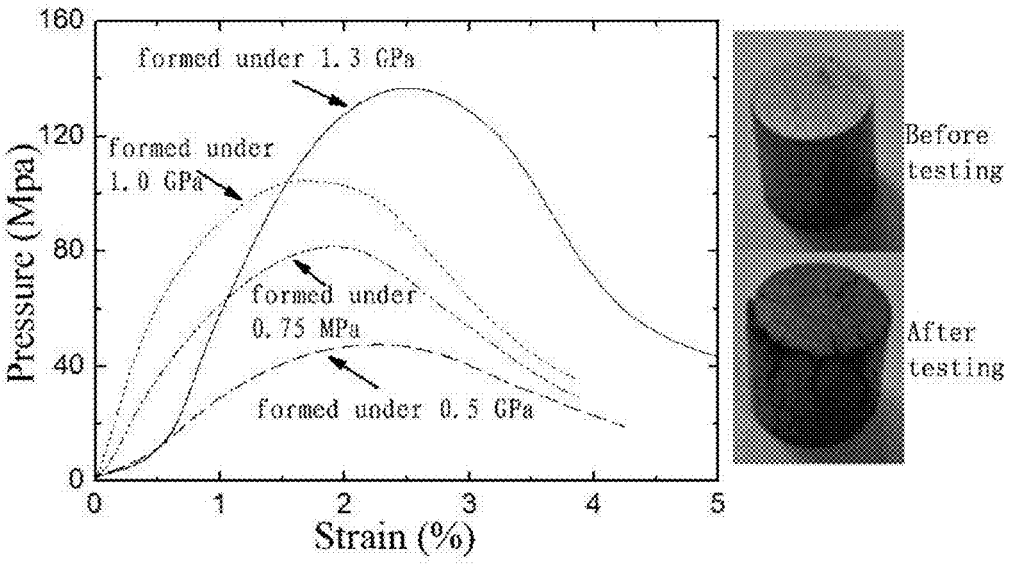
FIG. 11 shows the relation between the bearing pressure and strain of the massive material obtained by forming the $La_{0.7}Ce_{0.3}Fe_{11.6}Si_{1.4}C_{0.2}$ alloy particles under different forming pressure and solidifying the formed material in vacuum according to Example 2, and the insert shows the patterns of the massive material and that after the crushed under a pressure.
Figure 12:
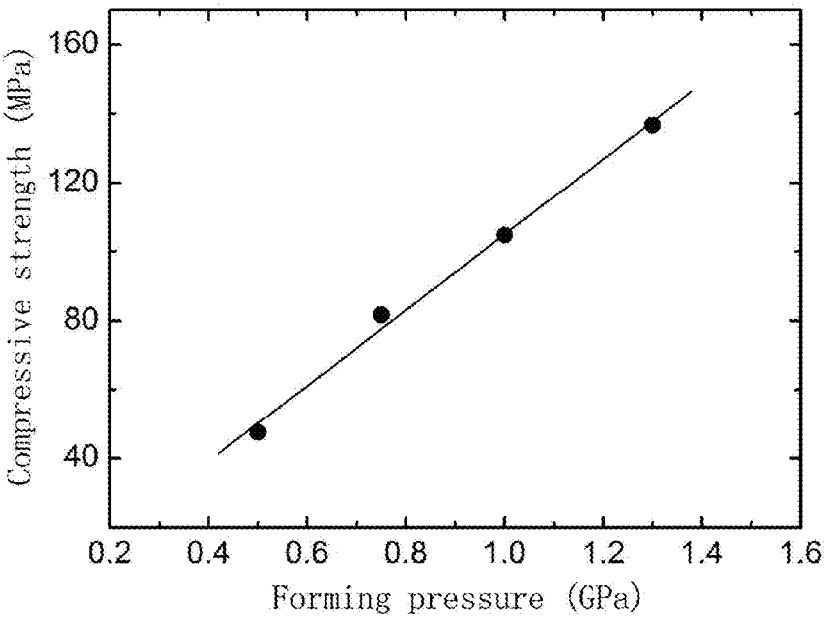
FIG. 12 shows the dependency of the compressive strength of the massive material obtained in step (7) of Example 2 on the forming pressure.

IV. The relation between the bearing pressure and strain was measured using an electronic universal testing machine (CMT4305) for the massive material formed under different forming pressure followed by solidification (as illustrated in FIG. 11), so as to achieve the dependency of compressive strength on forming pressure (as shown in FIG. 12). It can be found that the compressive strength was raised upon the increase of the forming pressure. When the forming pressure was raised from 0.50 GPa to 1.3 GPa, the compressive strength of the solidified material was greatly increased from 47.6 MPa to 136.7 MPa. As compared with those of the original alloy particles, the magnetic entropy change was reduced slightly and at the same time, the hysteresis loss was also dropped; whereas the effective refrigerating capacity was maintained unchanged or enhanced.

Conclusion: the epoxide-resin glue used in this Example was same as that in Example 1; the solidification temperature was lower than that in Example 1, which decreased the magnetocaloric effect reduction caused by the potential oxidation of the material during solidification. However, it was found that under the same forming pressure and in the same solidification atmosphere, solidification at a low solidification temperature made the compressive strength to decline somewhat, but the compressive strength was still considerable, i.e. 136.7 MPa Similar to the case in Example 1, the magnetic entropy change range and refrigerating capacity of the material were maintained unchanged essentially before and after the solidification.

Example 3: Preparation of High-Strength Magnetocaloric Material $La_{0.7}(Ce,Pr,Nd)_{0.3}(Fe_{0.9}Co_{0.1})_{11.9}Si_{1.1}$ 1) The materials were prepared in accordance with the chemical formula $La_{0.7}(Ce,Pr,Nd)_{0.3}(Fe_{0.9}Co_{0.1})_{11.9}Si_{1.1}$. The raw materials included industrial-pure mischmetal La—Ce—Pr—Nd (with a purity of 99.6 wt %), elementary Fe, elementary Co, elementary Si elementary La and FeC alloy, wherein elementary La was added to make up the La insufficience in the mischmetal and FeC alloy was used to provide C (carbon). The amount of the elementary Fe added thereto was reduced properly since the FeC alloy also contains Fe element, so that the proportion of each element added still met the requirement for the atomic ratio in the chemical formula of the magnetic material.

2) The raw materials prepared in step 1), after mixed, was loaded into an arc furnace. The arc furnace was vacuumized to a pressure of $2\times10^{-3}$ Pa, purged with high-purity argon with a purity of 99.996 wt % twice, and then filled with high-purity argon with a purity of 99.996 wt % to a pressure of 1 atm. The arc was struck (the raw materials were smelted together to form alloy after striking) to generate alloy ingots. Each alloy ingot was smelted at a temperature of 2000° C. repeatedly for 4 times. After the smelting, the ingot alloys were obtained by cooling down in a copper crucible.

3) After wrapped separately with molybdenum foil and sealed in a vacuumized quartz tube ($1\times10^{-4}$ Pa), the ingot alloy obtained from step 2) was annealed at 1080° C. for 30 days followed by being quenched in liquid nitrogen by breaking the quartz tube. As a result, second-order phase-transition $La_{0.7}(Ce,Pr,Nd)_{0.3}(Fe_{0.9}Co_{0.1})_{11.9}Si_{1.1}$ alloy having a $NaZn_{13}$-type structure were obtained.

4) The $La_{0.7}(Ce,Pr,Nd)_{0.3}(Fe_{0.9}Co_{0.1})_{11.9}Si_{1.1}$ alloy obtained in step 3) was crushed into irregular particles with an average particle size in the range of 20~200 micron.

5) A glue solution was prepared proportionally with "superfine epoxy resin powder (abbreviated as resin)", "superfine latent Q curing agent (micronized dicyandiamide, abbreviated as curing agent)", "superfine latent SH-A100 accelerating agent (abbreviated as accelerating agent)", purchased from Xinxi Metallurgical Chemical Co., Ltd, Guangzhou City, China. The weight ratio of "resin:curing agent: accelerating agent" was "100:12:5". Dissolving method: acetone and absolute ethanol (in a ratio of 1:1) was mixed and poured to epoxide-resin glue powder blended with the curing agent and accelerating agent (the solution of acetone and absolute ethanol was in an amount just allowing the complete dissolution of the solute); the mixture was agitated until the powder was dissolved completely in the solution, indicating the accomplishment of preparation of the glue solution. Then the resultant glue solution was poured to the $La_{0.7}(Ce,Pr,Nd)_{0.3}(Fe_{0.9}Co_{0.1})_{11.9}Si_{1.1}$ alloy particles obtained in step 4) according to a weight ratio of "alloy particles:(curing agent+accelerating agent+resin)"="100: 3.5", mixed evenly, and laid flat in an oven at 30° C. until died out. The drying period was 240 mins.

6) The $La_{0.7}(Ce,Pr,Nd)_{0.3}(Fe_{0.9}Co_{0.1})_{11.9}Si_{1.1}$ alloy particles (having been mixed with the adhesive agent) obtained in step 5) were press formed into a cylinder (diameter: 5 mm; height: 6 mm) The procedure is shown as below: the alloy particles were, after mixed with the adhesive agent, loaded into a mould (in a shape of cylinder with a diameter of 5 mm) made of high chromium carbide alloy tool steel; and press formed in an oil hydraulic press at room temperature. During the forming process, a pressure of 1.0 GPa was born by the sample; and the forming period was 2 mins. After press formed, the material was released from the mould.

7) The cylinder formed in step 6) was solidified in vacuum (vacuum degree: $1\times10^{-2}$ Pa). The solidification temperature was 120° C., and the solidification period was 60 mins. After solidification, a high-strength, room-temperature $La_{0.7}(Ce,Pr,Nd)_{0.3}(Fe_{0.9}Co_{0.1})_{11.9}Si_{1.1}$ magnetocaloric material was obtained.

Performance Test

Figure 13:
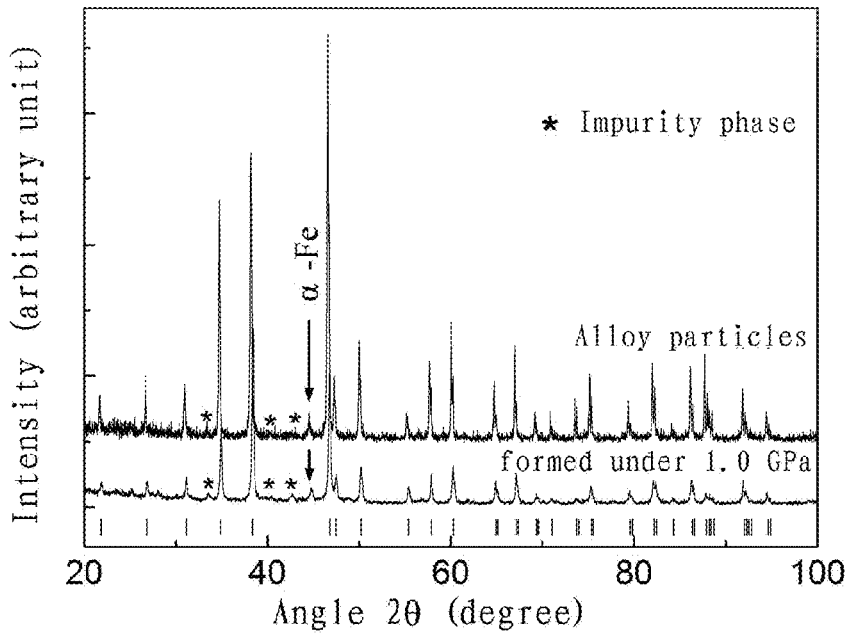
FIG. 13 shows the X-ray Diffraction (XRD) spectra, at room temperature, of the $La_{0.7}$ (Ce, Pr, Nd)$_{0.3}$($Fe_{0.9}Co_{0.1}$)$_{11.9}Si_{1.1}$ alloy particles and the massive material formed under 1.0 GPa and solidified in vacuum according to Example 3.

I. The X-ray diffraction (XRD) spectra, at room temperature were measured using the Cu-target X-ray diffractometer for the $La_{0.7}(Ce,Pr,Nd)_{0.3}(Fe_{0.9}Co_{0.1})_{11.9}Si_{1.1}$ alloy particles obtained in step 4) and the massive material formed under a pressure of 1.0 GPa and solidified in vacuum. The XRD results, as shown in FIG. 13, indicated that the alloy particles were crystallized into a $NaZn_{13}$-type structure, but a small amount of α-Fe and other unknown impurity phase was detected (the impurity phase is labeled by * in the Figure). After solidification, the sample still had a $NaZn_{13}$-type structure and the amount of the impurity phase was not changed much. The added epoxide-resin glue was organic, and its diffraction peak was not detected by the Cu-target X-ray diffraction technology.

II. The thermomagnetic curves (M-T curves) in a magnetic field of 0.02 T, and the magnetization curves at different temperatures in the process of increasing and decreasing field, were measured for the alloy particles obtained in step 4) and the massive material obtained in step 7), using the same method as those in Examples 1 and 2, on MPMS (SQUID)VSM. It was found that the materials showed second-order phase-transition properties both before and after the solidification. No temperature hysteresis or magnetic hysteresis was found and the phase-transition temperature was maintained unchanged, i.e. ~312K, around room temperature. As calculated on the basis of the Maxwell's equation, the magnetic entropy change was essentially the same before and after the solidification, and the refrigerating capacity was not changed either.

Figure 14:
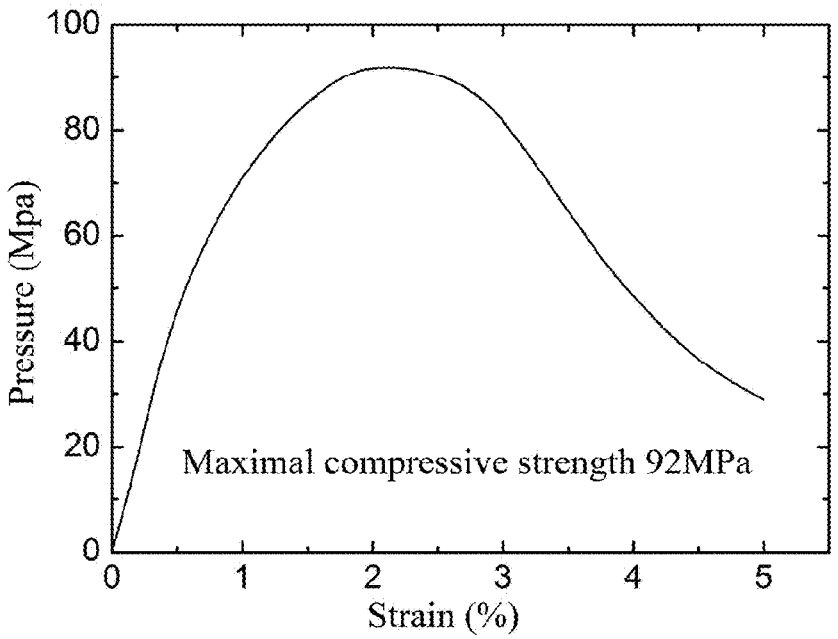
FIG. 14 shows the relation between the bearing pressure and strain of the sample obtained by forming $La_{0.7}$(Ce,Pr, Nd)$_{0.3}$($Fe_{0.9}Co_{0.1}$)$_{11.9}Si_{1.1}$ alloy particles under 1.0 GPa and solidifying the formed material according to Example 3.

III. The relation between the bearing pressure and strain was measured using an electronic universal testing machine (CMT4305) for the massive material obtained in step 7) (as shown in FIG. 14). It was found that the compressive strength was up to 92 MPa.

Conclusion: a La (Fe, SOD-based magnetocaloric material with considerable compressive strength can also be obtained using low-temperature epoxide-resin glue which is different from that used in Examples 1 and 2; both magnetic entropy change and effective refrigerating capacity were essentially the same before and after the solidification. In this Example, the solidification temperature (120° C. in this Example whereas 170° C. and 160° C. in Examples 1 and 2, respectively) was reduced dramatically, which effectively decreased the performance reduction caused by the potential oxidation of the material during solidification. Additionally, for the material of this Example, the phase-transition temperature was around room temperature and the phase-transition was of second-order in nature, indicating that a high-strength, second-order, room-temperature magnetocaloric material can be obtained directly using a bonding method, which is very important to the magnetic refrigerating application in practice.

Example 4: Preparation of High-Strength Magnetocaloric Material $La_{0.5}Pr_{0.5}Fe_{11.0}Si_{2.0}H_{2.6}$ 1) The materials were prepared in accordance with the chemical formula $La_{0.5}Pr_{0.5}Fe_{11.6}Si_{2.0}$. The raw materials included elementary La, Pr, Fe, Si.

2) The raw materials prepared in step 1), after mixed, was loaded into an arc furnace. The arc furnace was vacuumized to a pressure of $2\times10^{-3}$ Pa, purged with high-purity argon with a purity of 99.996 wt % twice, and then filled with high-purity argon with a purity of 99.996 wt % to a pressure of 1 atm. The arc was struck (the raw materials were smelted together to form alloy after striking) to generate alloy ingots. Each alloy ingot was smelted at a temperature of 2000° C. repeatedly for 4 times. After the smelting, the ingot alloys were obtained by cooling down in a copper crucible.

3) After wrapped separately with molybdenum foil and sealed in a vacuumized quartz tube ($1\times10^{-4}$ Pa), the ingot alloy obtained from step 2) was annealed at 1080° C. for 30 days followed by being quenched in liquid nitrogen by breaking the quartz tube. As a result, second-order phase-transition $La_{0.5}Pr_{0.5}Fe_{11.6}Si_{2.0}$ alloy having a $NaZn_{13}$-type structure were obtained.

4) The $La_{0.5}Pr_{0.5}Fe_{11.0}Si_{2.0}$ alloy obtained in step 3) was crushed into irregular particles with an average particle size in the range of 20~200 micron.

5) A glue solution was prepared with the "epoxide-resin BT-801 powder (corresponding curing agent and accelerating agent have been mixed in this product)" purchased from BONT Surface Treatment Material Co., Ltd, Dongguan City, China. The weight ratio of "acetone:absolute ethanol:BT-801 epoxide-resin powder was "1:1:1". Dissolving method: a solution of acetone and absolute ethanol, after mixed, was poured to BT-801 epoxide-resin powder; the mixture was agitated until the powder was dissolved completely in the solution, indicating the accomplishment of preparation of the glue solution. Then the resultant glue solution was poured to the $La_{0.5}Pr_{0.5}Fe_{11.0}Si_{2.0}$ particles obtained in step 4) according to a weight ratio of "alloy particles:BT-801 epoxide-resin powder="100:4.5", mixed evenly, and laid flat in an oven at 50° C. until dried out. The drying period was 180 mins.

6) The $La_{0.5}Pr_{0.5}Fe_{11.0}Si_{2.0}$ alloy particles (having been mixed with the adhesive agent) obtained in step 5) were press formed into a cylinder (diameter: 5 mm; height: 6 mm)

The procedure is shown as below: the alloy particles were, after mixed with the adhesive agent, loaded into a mould (in a shape of cylinder with a diameter of 5 mm) made of high chromium carbide alloy tool steel; and press formed in an oil hydraulic press at room temperature. During the forming process, a pressure of 1.0 GPa was born by the sample; and the forming period was 2 mins. After press formed, the material was released from the mould.

7) The cylinder compressed in step 6) was solidified in hydrogen gas using a P-C-T tester. More specifically, the $La_{0.5}Pr_{0.5}Fe_{11.0}Si_{2.0}$ cylinder compressed in step 6) was placed into the high-pressure sample chamber of the P-C-T tester; the sample chamber was vacuumized to a pressure of $1\times10^{-1}$ Pa, set up to a temperature of 180° C., then filled with high-purity $H_2$ (purity: 99.99%). The $H_2$ pressure was adjusted to 0.1032, 1.065, 2.031, 3.207, 4.235, 6.112, 8.088 MPa, respectively, and under each pressure, hydrogen absorption was carried out for 5 mins. Then the high-pressure sample chamber was placed in water at room temperature (20° C.), and immediately after this, hydrogen remained in the high-pressure sample chamber was extracted by a mechanical pump and the chamber was cooled down to room temperature. Based on the P-C-T analysis and weighting calculation, it was determined that H content was about 2.6, so that a high-strength, bonded $La_{0.5}Pr_{0.5}Fe_{11.0}Si_{2.0}H_{2.6}$ hydride magnetic refrigeration material was obtained. It should be understood that the amount of hydrogen absorbed by the alloy depends on the temperature and pressure in the hydrogen absorption process, therefore the amount of the absorbed hydrogen can be adjusted by regulating the temperature and pressure in the hydrogen absorption process and different amount of hydrogen will be absorbed if the hydrogen absorption is terminated under different hydrogen absorption pressure.

Performance Test

Figure 15:
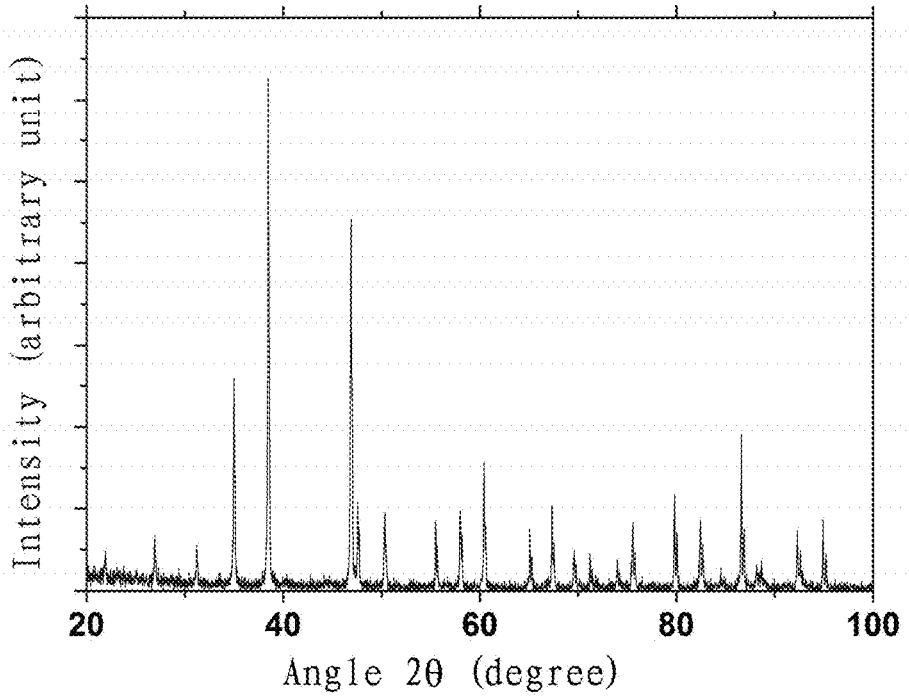
FIG. 15 shows the X-ray Diffraction (XRD) spectrum, at room temperature, of the bonded $La_{0.5}Pr_{0.5}Fe_{11.0}Si_{2.0}H_{2.6}$ massive material prepared in Example 4.

I. The X-ray diffraction (XRD) spectrum, at room temperature, was measured using the Cu-target X-ray diffractometer for the bonded $La_{0.5}Pr_{0.5}Fe_{11.6}Si_{2.0}H_{2.6}$ hydride massive material obtained in step 7). The XRD results, as shown in FIG. 15, indicated that it had a pure $NaZn_{13}$-type structure. The added epoxide-resin glue was organic, and its diffraction peak was not detected by the Cu-target X-ray diffraction technology.

Figure 16:
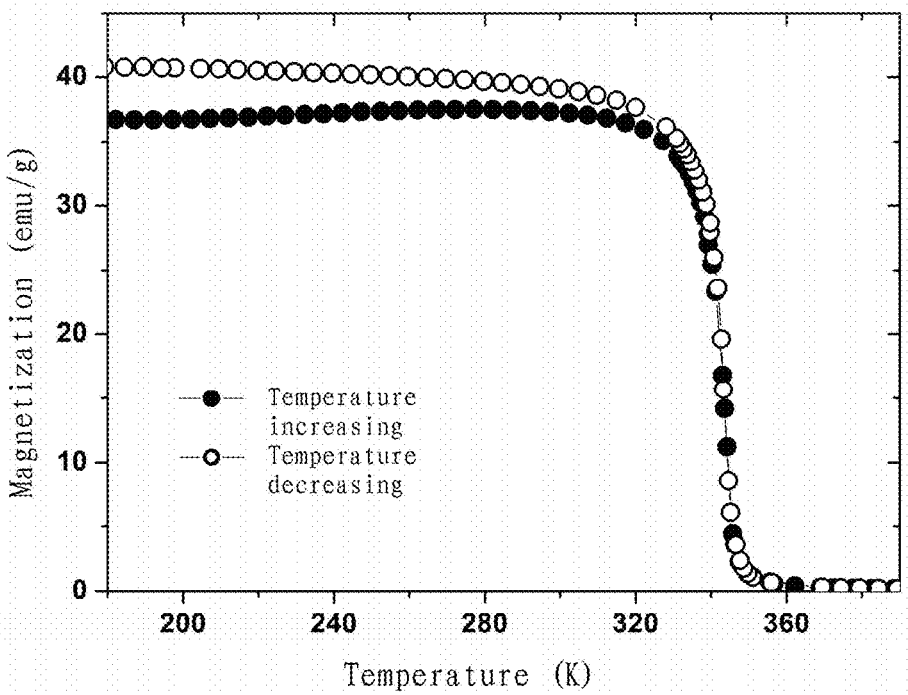
FIG. 16 shows the thermomagnetic (M-T) curves, in a magnetic field of 0.02 T, of the bonded $La_{0.5}Pr_{0.5}Fe_{11.0}Si_{2.0}H_{2.6}$ massive material prepared in Example 4.
Figure 17:
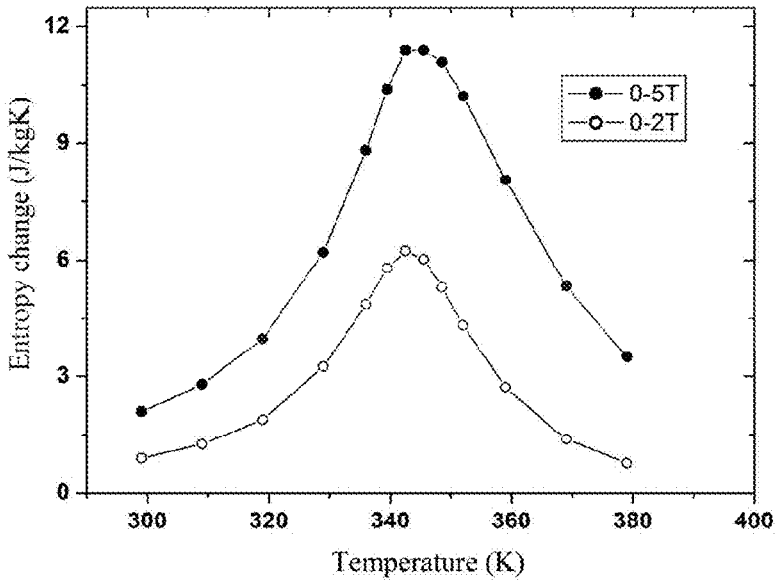
FIG. 17 indicates the dependency of ΔS of the bonded $La_{0.5}Pr_{0.5}Fe_{11.0}Si_{2.0}H_{2.6}$ massive material prepared in Example 4 on temperature in the process of increasing the field, in various magnetic fields.

II. The thermomagnetic curves (M-T curves) (as shown in FIG. 16) in a magnetic field of 0.02 T, and the magnetization curves at different temperatures in the process of increasing and decreasing field, were measured for the bonded $La_{0.5}Pr_{0.5}Fe_{11.6}Si_{2.0}H_{2.6}$ hydride massive material obtained in step 7), using the same method as those in Examples 1 and 2, on MPMS (SQUID)VSM. It was found that the material showed second-order phase-transition properties; no temperature hysteresis or magnetic hysteresis existed and the phase-transition temperature was ~342K. As calculated on the basis of the Maxwell's equation, the magnetic entropy change temperature curve was shown as FIG. 17; the maximal magnetic entropy change is about 11.0 J/kgK while magnetic field changes from 0 T to 5 T; and the magnetocaloric effect is considerable.

Figure 18:
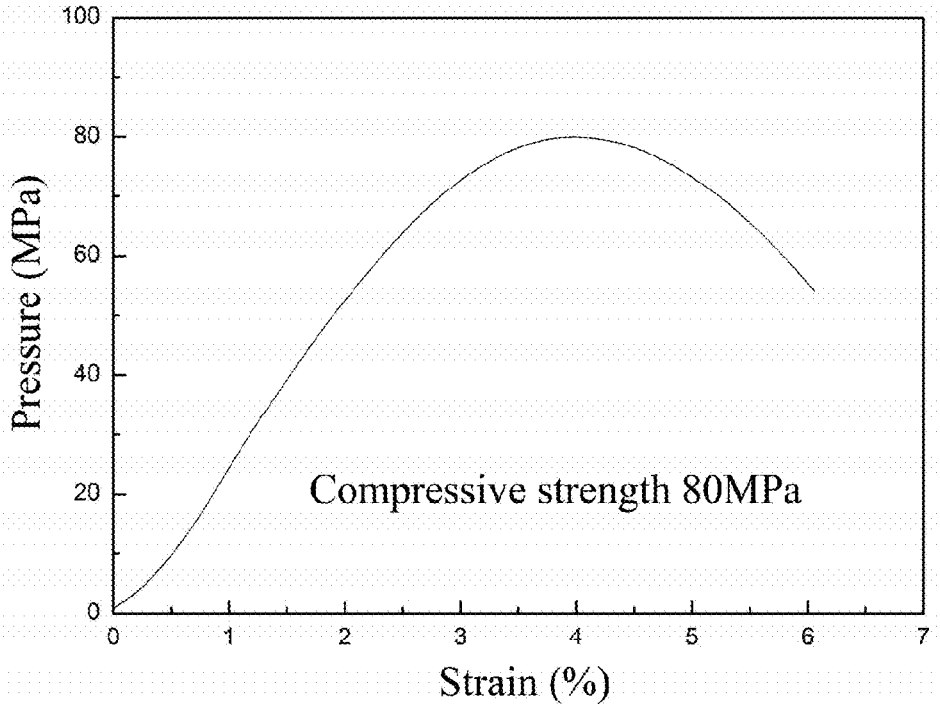
FIG. 18 shows the relation between the bearing pressure and strain of the bonded $La_{0.5}Pr_{0.5}Fe_{11.0}Si_{2.0}H_{2.6}$ massive material prepared in Example 4.

III. The relation between the bearing pressure and strain was measured using an electronic universal testing machine (CMT4305) for the massive material obtained in step 7) (as shown in FIG. 18). It was found that the compressive strength was up to 80 MPa.

Conclusion: $La(Fe, Si)_{13}$-based hydride with considerable compressive strength can be obtained by solidifying the bonded La $(Fe, Si)_{13}$-based magnetocaloric material in hydrogen atmosphere; the temperature at which the maximal magnetic entropy change occurs can be adjusted to around 350K, which is very important to the magnetic refrigerating application in practice.

Example 5: Preparation of High-Strength Magnetocaloric Material $LaFe_{11.6}Si_{1.4}C_{0.2}$ 1) The materials were prepared in accordance with the chemical formula $LaFe_{11.6}Si_{1.4}C_{0.2}$. The raw materials included La, Ce, Fe, Si and FeC. FeC alloy was used to provide C (carbon). The amount of the elementary Fe added thereto was reduced properly since the FeC alloy also contains Fe element, so that the proportion of each element added still met the requirement for the atomic ratio in the chemical formula of the magnetic material.

2) The raw materials prepared in step 1), after mixed, was loaded into an arc furnace. The arc furnace was vacuumized to a pressure of $2\times10^{-3}$ Pa, purged with high-purity argon with a purity of 99.996 wt % twice, and then filled with high-purity argon with a purity of 99.996 wt % to a pressure of 1 atm. The arc was struck (the raw materials were smelted together to form alloy after striking) to generate alloy ingots. Each alloy ingot was smelted at a temperature of 2000° C. repeatedly for 4 times. After the smelting, the ingot alloys were obtained by cooling down in a copper crucible.

3) After wrapped separately with molybdenum foil and sealed in a vacuumized quartz tube ($1\times10^{-4}$ Pa), the ingot alloy obtained from step 2) was annealed at 1080° C. for 30 days followed by being quenched in liquid nitrogen by breaking the quartz tube. As a result, first-order phase-transition $LaFe_{11.6}Si_{1.4}C_{0.2}$ alloy having a $NaZn_{13}$-type structure were obtained.

4) The $LaFe_{11.6}Si_{1.4}C_{0.2}$ alloy obtained in step 3) was crushed into irregular particles with an average particle size in the range of 10~50 micron.

5) A proper amount of silane coupling agent (its role is similar to the curing agent and accelerating agent used in the three preceding Examples, used for evenly bonding and promoting solidification) was dissolved and diluted in absolute ethanol. Then the $LaFe_{11.6}Si_{1.4}C_{0.2}$ alloy particles obtained in step 4) was added to the silane diluent, agitated and mixed evenly, laid flat in an oven at 45° C. until dried out. The drying period was 180 mins. The $LaFe_{11.6}Si_{1.4}C_{0.2}$ particles, after treated with the silane coupling agent, were mixed evenly with polyimide adhesive powder in a certain proportion, i.e. the weight ratio is as follow: "$LaFe_{11.6}Si_{1.4}C_{0.2}$ particles:polyimide adhesive:silane coupling agent"="100:3.2:0.9".

6) A powder mixture of $LaFe_{11.6}Si_{1.4}C_{0.2}$ and polyimide adhesive obtained in step 5 was press formed and solidified into a cylinder (diameter: 8 mm; height: 5 mm) The procedure is shown as below: the alloy particles were, after mixed with the adhesive agent, placed into a casing pipe (in a shape of cylinder with a diameter of 8 mm) made of boron nitride; and press formed in a six-anvil hydraulic press. During the forming process, a pressure of 2.0~2.5 GPa was born by the sample; and the forming period was 20 mins. The temperatures were set to 250° C., 300° C. and 400° C., respectively during solidification.

Performance Test

Figure 19:
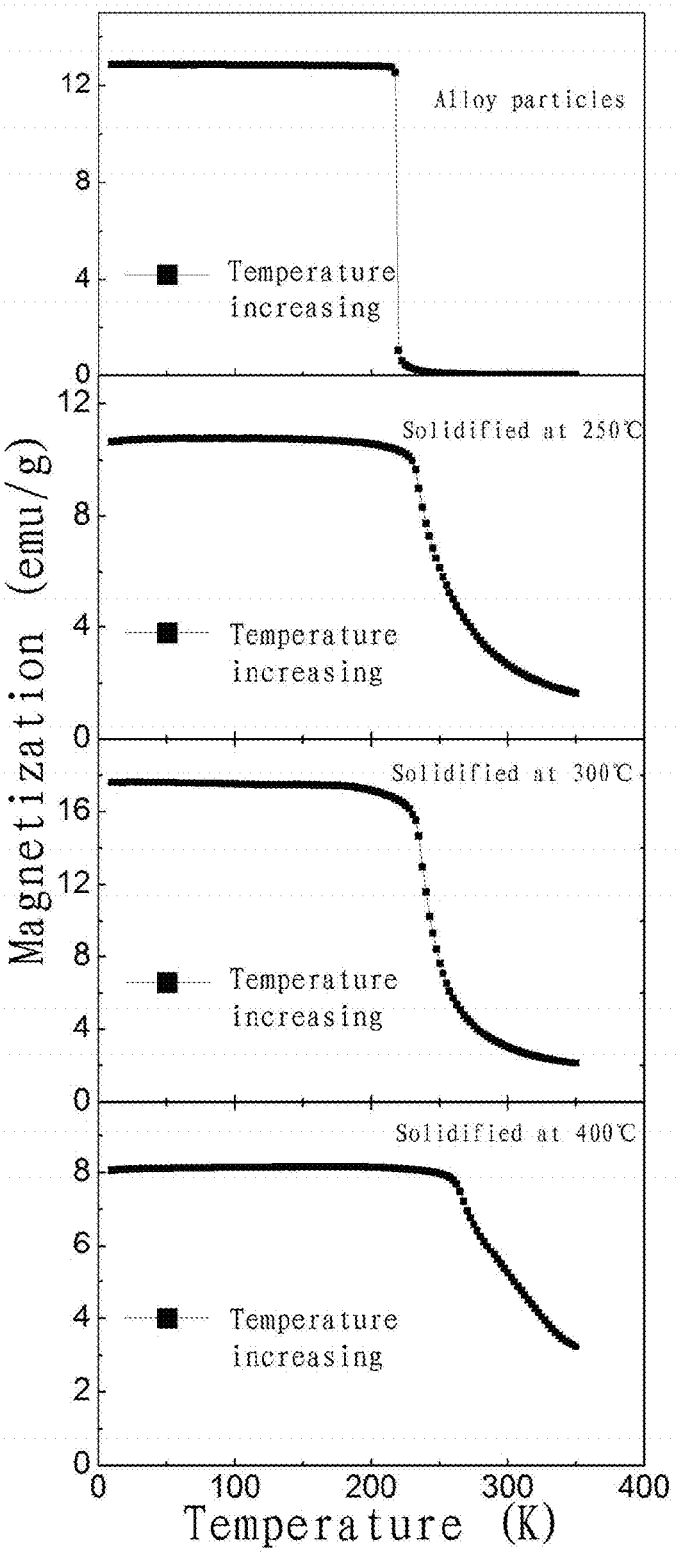
FIG. 19 shows the thermomagnetic (M-T) curves, in a magnetic field of 0.02 T, of the $LaFe_{11.6}Si_{1.4}C_{0.2}$ alloy particles and the massive material obtained by mixing the alloy particles with an adhesive agent, forming and solidifying the mixture under various solidification temperature according to Example 5.

I. The thermomagnetic curves (M-T curves), in a magnetic field of 0.02 T, were measured on MPMS (SQUID) VSM for the $LaFe_{11.6}Si_{1.4}C_{0.2}$ alloy particles obtained in step 4) and the massive material obtained by mixing the alloy particles with an adhesive agent and solidifying the mixture at different temperatures (as shown in FIG. 19). It was found that the material, after solidified at 250° C., 300°

Figure 20:
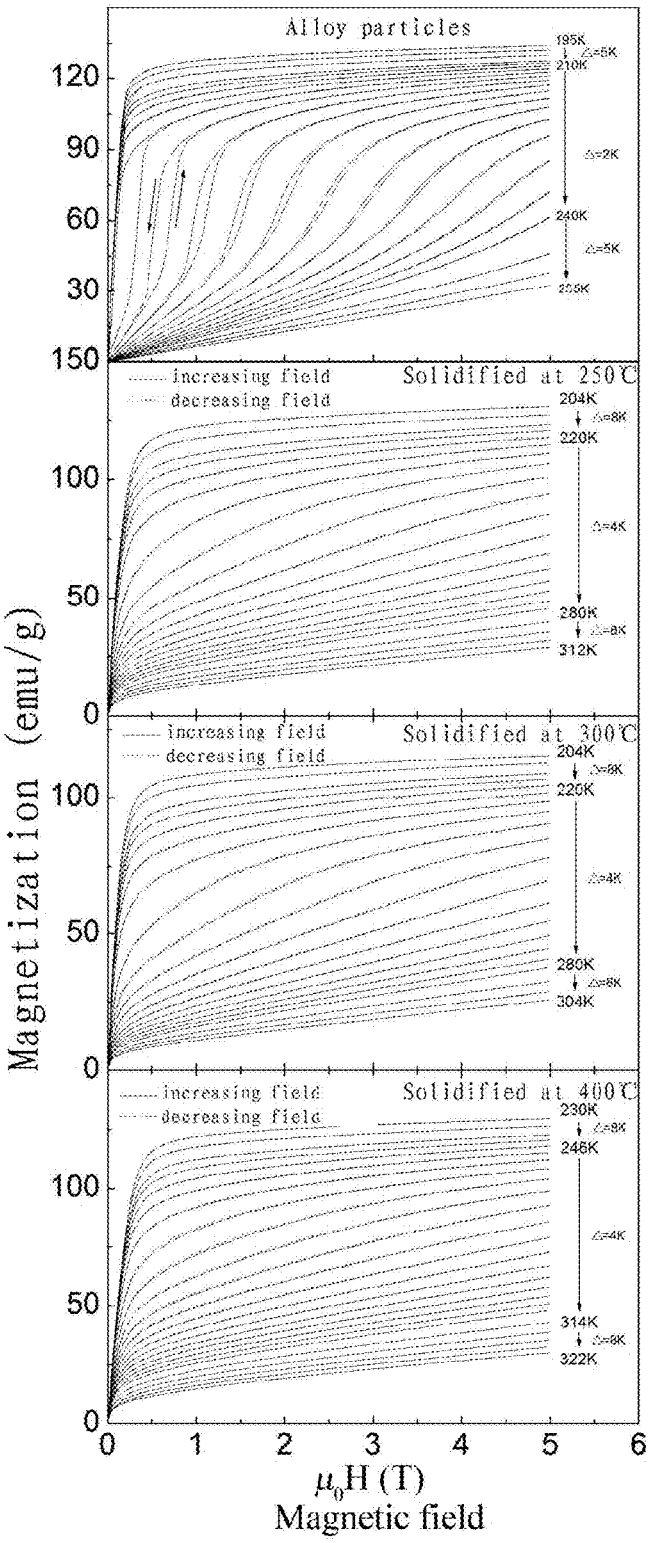
FIG. 20 shows the thermomagnetic (M-T) curves of the $LaFe_{11.6}Si_{1.4}C_{0.2}$ alloy particles and the massive material obtained by mixing the alloy particles with an adhesive agent, forming and solidifying the mixture under various solidification temperature according to Example 5, in the process of increasing and decreasing the field, at different temperatures.

C. and 400° C., showed phase-transition temperatures of 250K, 250K and 300K, respectively. Compared with that of the alloy particles (219K, Example 1), the phase-transition temperature of this material was greatly raised. The still high magnetization at high-temperature paramagnetic area for 1:13 phase, was caused by the appearance of α-Fe and other impurity phases during solidification, which is consistent with the result of M-H curves. FIG. 20 shows the magnetization curves (M-H curves), at different temperatures in the process of increasing and decreasing field. It was seen that in the process of increasing and decreasing field, the magnetic hysteresis loss was very little or approached to zero substantively. A curl shape of the M-H curves was present in the 1:13-phase paramagnetic high temperature zone, which is caused by the appearance of α-Fe impurity phase during solidification.

Figure 21:
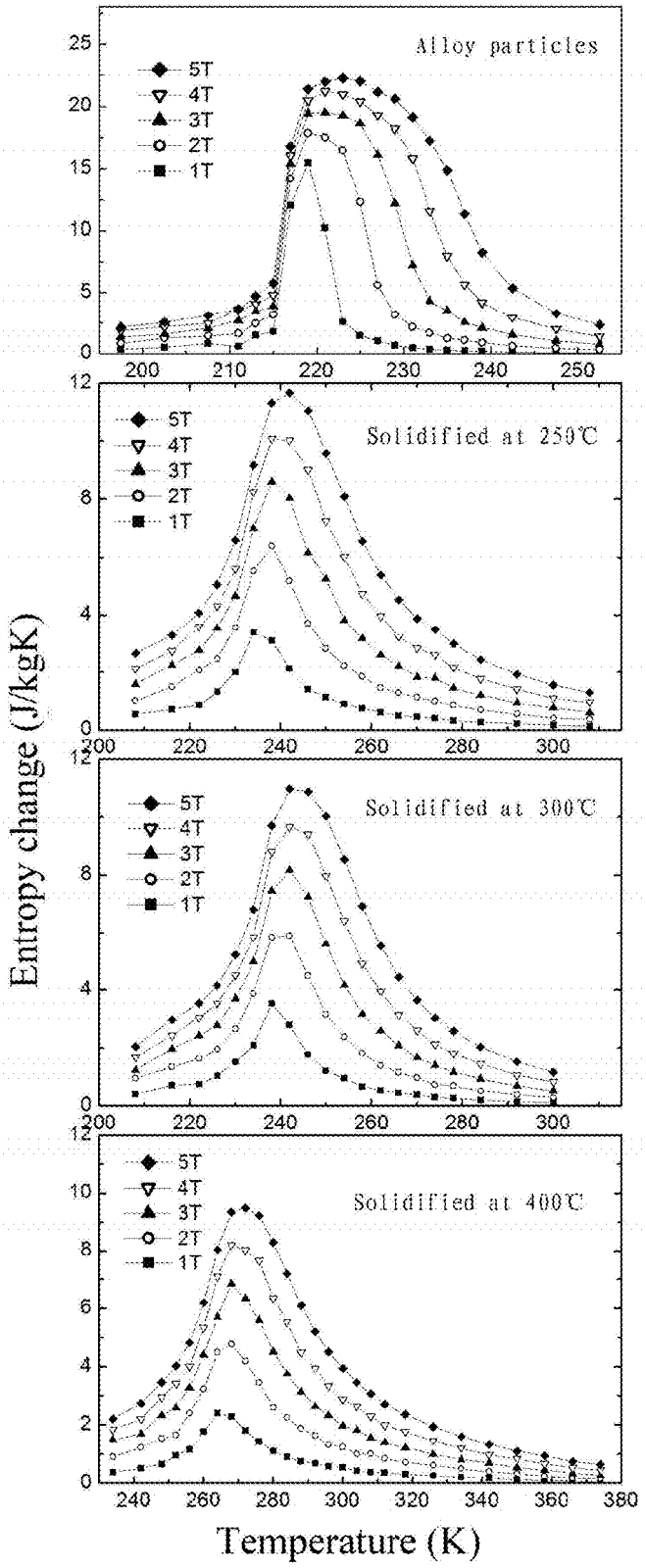
FIG. 21 indicates the dependency of magnetic entropy change (ΔS) on temperature, in various magnetic fields for the $LaFe_{11.6}Si_{1.4}C_{0.2}$ alloy particles and the massive material obtained by mixing the alloy particles with an adhesive agent, forming and solidifying the mixture under various solidification temperatures according to Example 5 (calculation of ΔS in the process of increasing the field)

II. FIG. 21 presents the dependency of ΔS on temperature, in various magnetic fields for the $LaFe_{11.6}Si_{1.4}C_{0.2}$ alloy particles, and the massive materials after formed and solidified at different temperatures (calculation of ΔS in the process of increasing the field). For the materials solidified at 250° C., 300° C. and 400° C., the ΔS peak values under a magnetic field change from 0 T to 5 T were 11.7 J/kgK, 11.0 J/kgK and 9.5 J/kgK, respectively; the widths at half height were 32.5K, 31.8K and 39.1K, respectively; and the effective refrigerating capacity, after the maximum loss being deducted, were 297.8 J/kg, 274.7 J/kg and 291.2 J/kg, respectively. Compared with that of the alloy particles (ΔS~21.2 J/kgK, Example 1), ΔS peak value was reduced dramatically. At the same time, the width at half height of ΔS was increased; and the refrigerating capacity was reduced.

Figure 22:
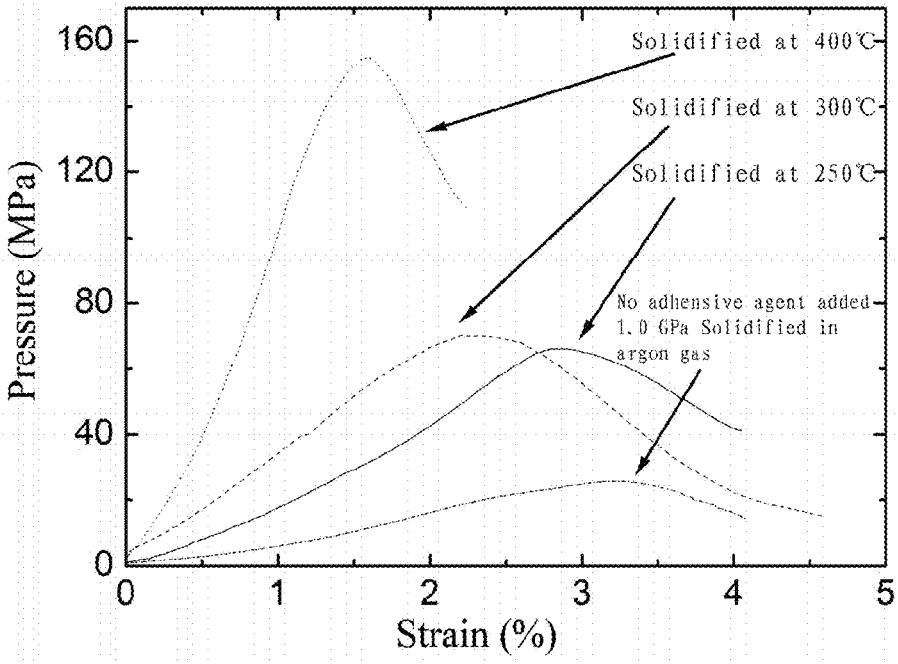
FIG. 22 shows the relation between the bearing pressure and strain of the massive material obtained by forming and solidifying $LaFe_{11.6}Si_{1.4}C_{0.2}$ alloy particles under various solidification temperatures according to Example 5.

III. The relation between the bearing pressure and strain was measured using an electronic universal testing machine (CMT4305) for the sample obtained by solidifying the $LaFe_{11.6}Si_{1.4}C_{o2}$ alloy particles obtained in step 4) at different temperatures (as shown in FIG. 22). It was found that the compressive strength of the materials solidified at 250° C., 300° C. and 400° C. was 66.3 MPa, 70.0 MPa and 154.7 MPa, respectively.

Conclusion: in this Example, considerable compressive strength can be achieved by bonding (with polyimide adhesive) and solidifying a $La(Fe, Si)_{13}$-based magnetocaloric material. However, introduction of high temperature (≥250° C.) and high pressure (≥2.0 GPa) during solidification may change the intrinsic property of the material. A large amount of α-Fe and other impurity phases appeared during solidification; the phase-transition temperature was raised greatly; at the same time, magnetocaloric effect and refrigerating capacity were reduced dramatically, and so was the performance of the materials. The high temperatures (250° C., 300° C. and 400° C.) used in this Example were higher than the solidification temperatures (160° C., 170° C. and 130° C.) in Examples 1~3; and the forming pressure (2.0~2.5 GPa) of this Example was also higher than those in the three proceeding Examples, i.e. ≤1 GPa, ≤1.3 GPa and 1 GPa.

Example 6: $La_{0.7}Ce_{0.3}Fe_{11.6}Si_{1.4}C_{0.2}$ Magnetocaloric Material Showing Small Hysteresis Loss 1) The materials were prepared in accordance with the chemical formula $La_{0.7}Ce_{0.3}Fe_{11.6}Si_{1.4}C_{0.2}$. The raw materials included industrial-pure LaCe alloy, Fe, Si, La and FeC, wherein elementary La was added to make up the La insufficience in the LaCe alloy and FeC alloy was used to provide C (carbon). The amount of the elementary Fe added thereto was reduced properly since the FeC alloy also contains Fe element, so that the proportion of each element added still met the requirement for the atomic ratio in the chemical formula of the magnetic material.

2) The raw materials prepared in step 1), after mixed, was loaded into an arc furnace. The arc furnace was vacuumized to a pressure of $2\times10^{-3}$ Pa, purged with high-purity argon with a purity of 99.996 wt % twice, and then filled with high-purity argon with a purity of 99.996 wt % to a pressure of 1 atm. The arc was struck (the raw materials were smelted together to form alloy after striking) to generate alloy ingots. Each alloy ingot was smelted at a temperature of 2000° C. repeatedly for 4 times. After the smelting, the ingot alloys were obtained by cooling down in a copper crucible.

3) After wrapped separately with molybdenum foil and sealed in a vacuumized quartz tube ($1\times10^{-4}$ Pa), the ingot alloy obtained from step 2) was annealed at 1080° C. for 30 days followed by being quenched in liquid nitrogen by breaking the quartz tube. As a result, $La_{0.7}Ce_{0.3}Fe_{11.6}Si_{1.4}C_{0.2}$ alloy block having a $NaZn_{13}$-type structure was obtained.

4) The alloy block obtained in step 3) was crushed and cut into crude particles with a particle size less than 1 mm. The crude particles were further grinded into irregular alloy particles with a particle size≤200 μm in an agate mortar under the protection of acetone. The resultant alloy particles were then screened through standard sieves with different mesh number so as to collect the particles with particle sizes within different ranges. To prevent oxidation, the screening process was conducted under the protection of acetone liquid. The detailed screening modes are shown as follows:

- Alloy particles with a particle size in the range of 90~120 μm were obtained by screening through 170-mesh and 120-mesh standard sieves;
- Alloy particles with a particle size in the range of 50~90 μm were obtained by screening through 270-mesh and 170-mesh standard sieves;
- Alloy particles with a particle size in the range of 15~50 μm were obtained by screening through 800-mesh and 270-mesh standard sieves;
- Alloy particles with a particle size less than 10 μm were obtained by screening through a 1600-mesh standard sieve.

Sample Test and Result Analysis

Figure 23:
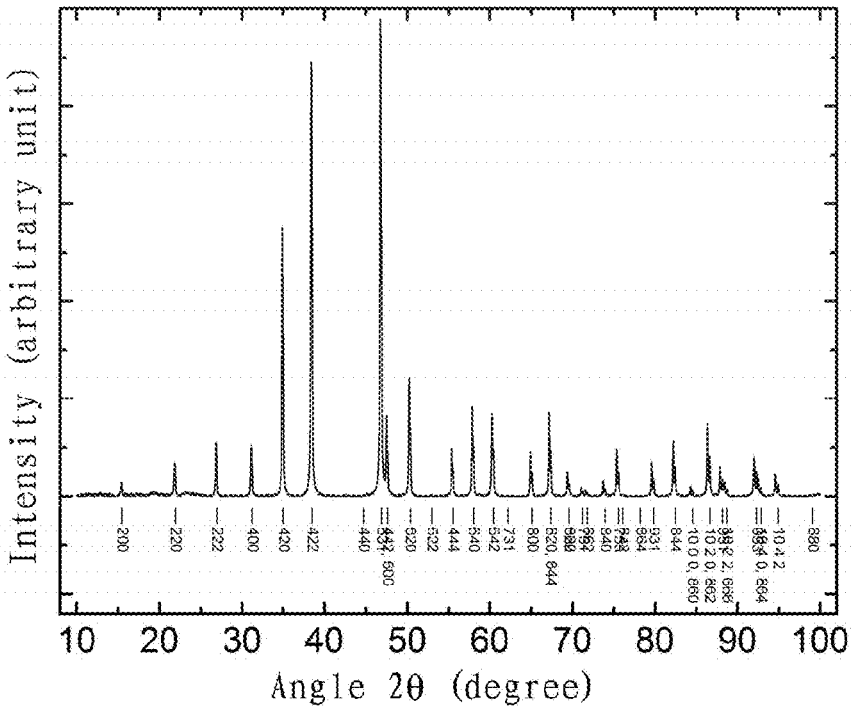
FIG. 23 shows the X-ray Diffraction (XRD) spectrum, at room temperature, of the $La_{0.7}Ce_{0.3}Fe_{11.6}Si_{1.4}C_{0.2}$ bulk prepared in Example 6.

I. The X-ray diffraction (XRD) spectrum, at room temperature was measured using the Cu-target X-ray diffractometer for the $La_{0.7}Ce_{0.3}Fe_{11.6}Si_{1.4}C_{0.2}$ alloy block. The XRD result, as shown in FIG. 23, indicated that the sample had a pure $NaZn_{13}$-type uniphase structure; and almost no impurity phase was present.

Figure 24:
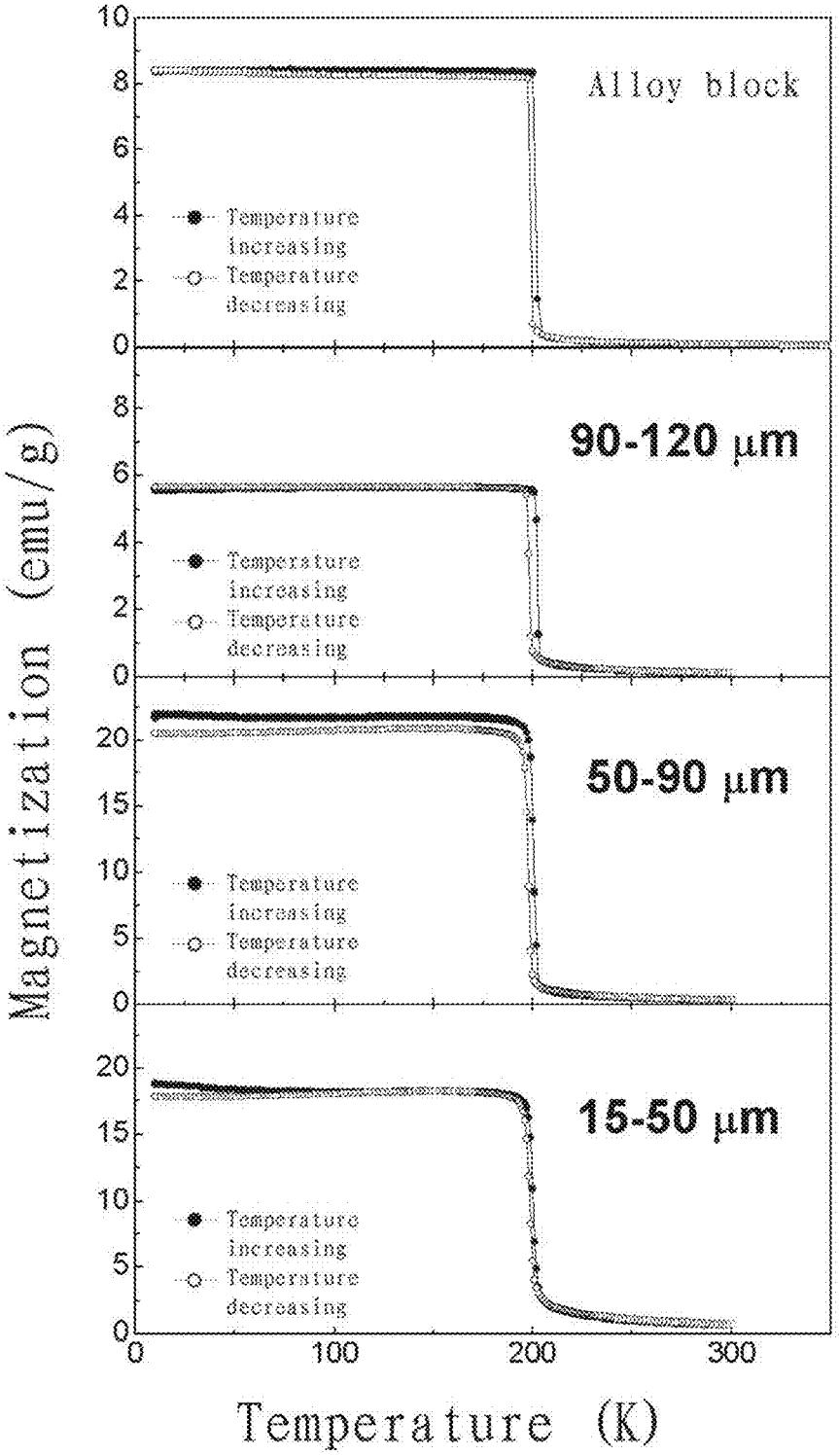
FIG. 24 shows the thermomagnetic (M-T) curves, in a magnetic field of 0.02 T, of the $La_{0.7}Ce_{0.3}Fe_{11.6}Si_{1.4}C_{0.2}$ bulk and samples with a particle size within 3 ranges prepared in Example 6.

II. The thermomagnetic curves (M-T), in a magnetic field of 0.02 T were measured for the $La_{0.7}Ce_{0.3}Fe_{11.6}Si_{1.4}C_{0.2}$ alloy block (single particle, weight: 2.7 mg) and the samples with particle sizes within various ranges (90~120 μm (weight: 2.31 mg), 50~90 μm (weight: 1.86 mg), 15~50 μm (weight: 1.28 mg), <10 μm (weight: 0.86 mg), using the Superconducting Quantum Interference Vibrating Sample Magnetometer [MPMS(SQUID)VSM], as shown in FIG. 24. The results showed that except for the alloy particles with a particle size<10 μm, of which the Curie temperature was raised to a temperature higher than 203K (because α-Fe might be separated out from the cumulative material introducing stress in the grinding process, relative Si content was increased), the alloy particles with particle sizes within three other ranges had Curie temperature of 200K, same as that of the alloy block.

Figure 25:
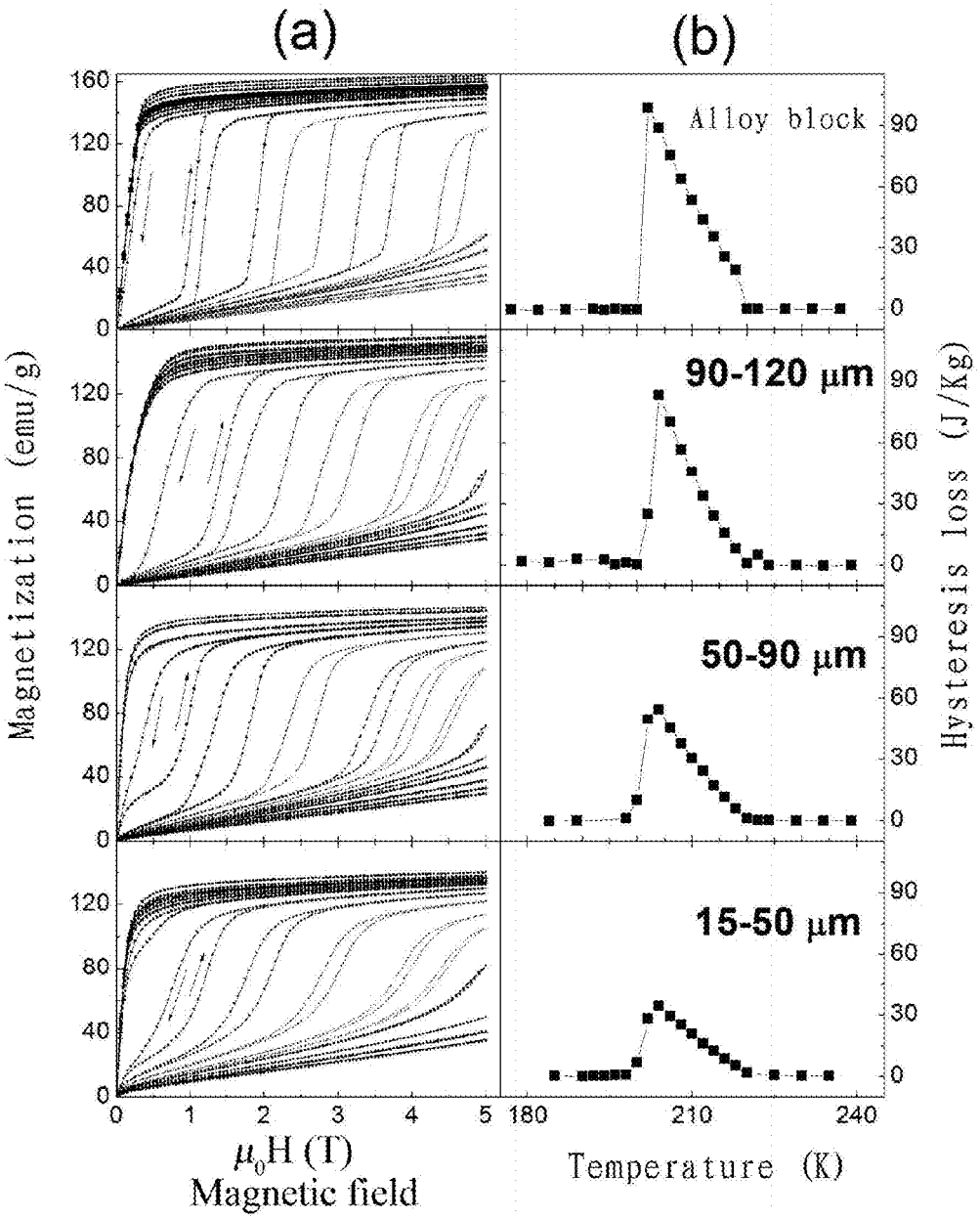
FIG. 25 shows a) the magnetization curves (M-H curve), at different temperatures, in the process of increasing and decreasing the field, of the $La_{0.7}Ce_{0.3}Fe_{11.6}Si_{1.4}C_{0.2}$ bulk and samples with a particle size within 3 ranges prepared in Example 6; b) the dependency of hysteresis loss on temperature.

III. The magnetization curves (M-H curves), at different temperatures in the process of increasing and decreasing field were measured for the $La_{0.7}Ce_{0.3}Fe_{11.6}Si_{1.4}C_{0.2}$ alloy block (single particle, weight: 2.7 mg) and the samples with particle sizes within various ranges (90~120 μm (weight: 2.31 mg), 50~90 μm (weight: 1.86 mg), 15~50 μm (weight: 1.28 mg), <10 μm (weight: 0.86 mg)), on the MPMS (SQUID) VSM. The rates of increasing and decreasing field were the same, both 500 oersteds/second. FIGS. 25 (*a*) and (*b*) showed M-H curves of the alloy block and the samples with particle sizes within the three ranges in the process of increasing and decreasing field and the dependency of hysteresis loss on temperature, respectively. The presence of a clear inflection point in the M-H curve indicated that metamagnetic transition from paramagnetic to ferromagnetic state was induced by the magnetic field. Through the comparison of all the curves, it can be observed that hysteresis loss was greatly reduced as the particle size was decreased; maximal magnetic hysteresis was reduced from 98.4 J/kg (for the alloy block) to 35.4 J/kg (for particle size in the range of 15~50 μm), and the reduction rate was up to 64%. The M-H curve is a straight line in the high temperature zone (the paramagnetic zone of 1:13-phase), which indirectly demonstrates that both the alloy block and the samples with particle sizes within the three ranges are pure 1:13-phase and almost no α-Fe-phase was present.

Figure 26:
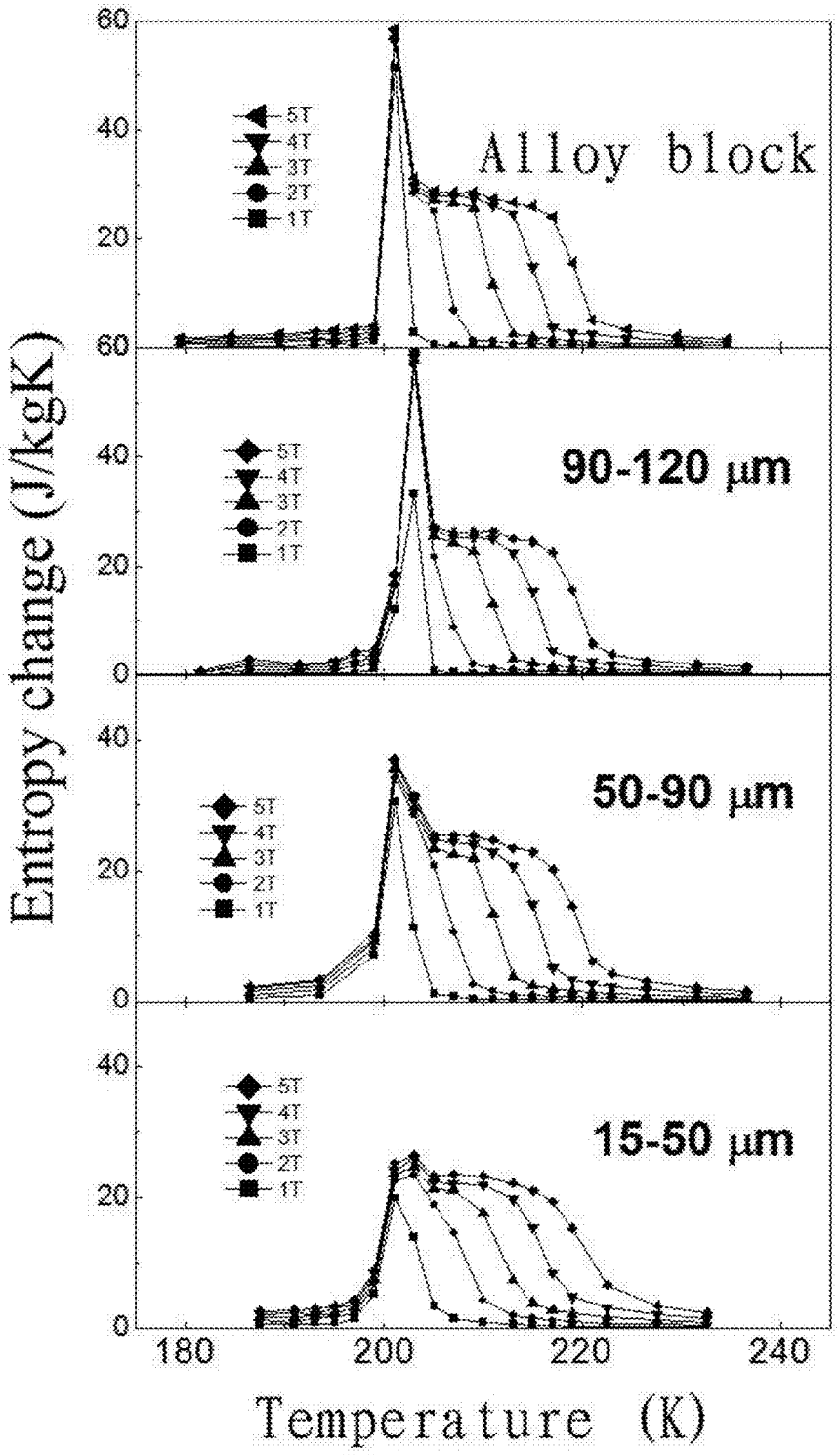
FIG. 26 indicates the dependency of ΔS of the $La_{0.7}Ce_{0.3}Fe_{11.6}Si_{1.4}C_{0.2}$ bulk and samples with a particle size within 3 ranges prepared in Example 6 on temperature in the process of increasing the field, in various magnetic fields.

IV. On the basis of the Maxwell's equation $$\Delta S(T, H) = S(T, H) - S(T, 0) = \int_0^H \left(\frac{\partial M}{\partial T}\right)_H dH,$$

the magnetic entropy change, ΔS, can be calculated according to the isothermal magnetization curve. FIG. 26 shows the dependency of ΔS on temperature for the alloy block and the $La_{0.7}Ce_{0.3}Fe_{11.6}Si_{1.4}C_{0.2}$ alloy particles with particle sizes within the three ranges in the process of increasing field in different magnetic fields. From FIG. 26, it was observed that the ΔS peak shape extended asymmetrically towards the high-temperature zone while the field was increased; the peak was followed by a plateau, which is a typical feature of a $La(Fe,Si)_{13}$-based first-order phase-transition system and caused by the metamagnetic transition behavior induced by the magnetic field at a temperature higher than Curie temperature. The ΔS peak shape further confirmed the first-order nature of the phase-transition and metamagnetic behavior of the material. According to previous studies, such an appearance of the ΔS peak is caused by the coexistence of two phases during the first-order phase transition, and the high ΔS spike is a false signal which does not involving thermal effect; but the ΔS plateau reflects the essential property of magnetocaloric effect. From above, it can be found that both the alloy block and the $La_{0.7}Ce_{0.3}Fe_{11.6}Si_{1.4}C_{0.2}$ samples with particle sizes within the three ranges remained great effective magnetic entropy change range, i.e. an average value of 26 J/kgK.

Figure 27:
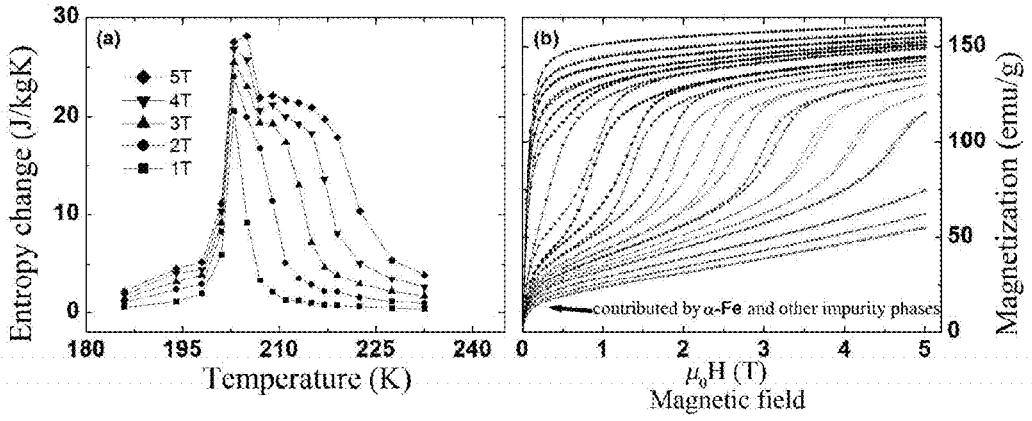
FIG. 27 shows a) the thermomagnetic (M-T) curves; b) the dependency of ΔS on temperature in the process of increasing the field, in various magnetic fields for the sample with a particle size in the range of <10 μm prepared in Example 6.

As compared with the above results, FIGS. 27 (*a*) and (*b*) show the M-H curves and magnetic entropy change-temperature curves for the particles with size range reduced to <10 μm, respectively. From FIG. 27, it can be observed that while the particle size was reduced to <10 μm, although maximal magnetic hysteresis was further reduced to 27 J/kg, separation of α-Fe phase allowed the magnitude of magnetocaloric effect to be decreased to 21 J/kgK. In FIG. 27(*a*), the M-H curve is still in a curl shape in the high temperature 1:13-phase paramagnetic zone, which is caused by cc-Fe impurity phase and indicates the separation of a-Fe phase.

Example 7: Preparation of Two High-Strength Magnetocaloric Materials $La_{0.7}(Ce,Pr,Nd)_{0.3}Fe_{11.6}Si_{1.4}C_{0.1}H_{2.9}$ and $La_{0.7}Pr_{0.3}Fe_{11.5}Si_{1.5}C_{0.2}B_{0.05}H_{0.55}$ 1) The materials were prepared in accordance with the chemical formula $La_{0.7}(Ce,Pr,Nd)_{0.3}Fe_{11.6}Si_{1.4}C_{0.1}$ and $La_{0.7}Pr_{0.3}Fe_{11.5}Si_{1.5}C_{0.2}B_{0.05}$. The raw materials included industrial-pure mischmetal La—Ce—Pr—Nd (with a purity of 98.2 wt %), La, Pr, FeC, FeB, Fe, Si, wherein elementary La could also be used to make up the La insufficience in the mischmetal.

2) The raw materials prepared in step 1), after mixed, was loaded into an arc furnace. The arc furnace was vacuumized to a pressure of $2\times10^{-3}$ Pa, purged with high-purity argon with a purity of 99.996 wt % twice, and then filled with high-purity argon with a purity of 99.996 wt % to a pressure of 1.4 atm. The arc was struck (the raw materials were smelted together to form alloy after striking) to generate alloy ingots. Each alloy ingot was smelted at a temperature of 2000° C. repeatedly for twice. After the smelting, the ingot alloys were obtained by cooling down in a copper crucible.

3) After wrapped separately with molybdenum foil and sealed in a vacuumized quartz tube ($1\times10^{-4}$ Pa), the ingot alloys obtained from step 2) were annealed at 1100° C. for 10 days followed by being quenched in liquid nitrogen by breaking the quartz tube. As a result, two alloy materials $La_{0.7}(Ce,Pr,Nd)_{0.3}Fe_{11.6}Si_{1.4}C_{0.1}$ and $La_{0.7}Pr_{0.3}Fe_{11.5}Si_{1.5}C_{0.2}B_{0.05}$ were obtained.

4) The two alloy materials $La_{0.7}(Ce,Pr,Nd)_{0.3}Fe_{11.6}Si_{1.4}C_{0.1}$ and $La_{0.7}Pr_{0.3}Fe_{11.5}Si_{1.5}C_{0.2}B_{0.05}$y obtained in step 3) were crushed into irregular particles with an average particle size in the range of 20~200 micron.

5) A glue solution was prepared proportionally with "superfine epoxy resin powder (abbreviated as resin)", "superfine latent Q curing agent (micronized dicyandiamide, abbreviated as curing agent)", "superfine latent SH-A100 accelerating agent (abbreviated as accelerating agent)", purchased from Xinxi Metallurgical Chemical Co., Ltd, Guangzhou City, China. The weight ratio of "resin:curing agent: accelerating agent was "100:12:5". Dissolving method: acetone and absolute ethanol (in a ratio of 1:1) was mixed and poured to epoxide-resin powder blended with the curing agent and accelerating agent (the solution of acetone and absolute ethanol was in an amount just allowing the complete dissolution of the solute); the mixture was agitated until the powder was dissolved completely in the solution, indicating the accomplishment of preparation of the glue solution. Then the resultant glue solution was poured to the two types of alloy particles $La_{0.7}(Ce,Pr,Nd)_{0.3}Fe_{11.6}Si_{1.4}C_{0.1}$ and $La_{0.7}Pr_{0.3}Fe_{11.5}Si_{1.5}C_{0.2}B_{0.05}$ obtained in step 4) according to a weight ratio of "alloy particles:(curing agent+accelerating agent+resin)="100:3.5", mixed evenly, and laid flat in an oven at 30° C. until died out. The drying period was 240 mins.

6) The two types of alloy particles $La_{0.7}(Ce,Pr,Nd)_{0.3}Fe_{11.6}Si_{1.4}C_{0.1}$ and $La_{0.7}Pr_{0.3}Fe_{11.5}Si_{1.5}C_{0.2}B_{0.05}$ (having been mixed with the adhesive agent) obtained in step 5) were press formed into a cylinder (diameter: 5 mm; height: 6 mm), separately. The procedure is shown as below: the alloy particles were, after mixed with the adhesive agent, loaded into a mould (in a shape of cylinder with a diameter of 5 mm) made of high chromium carbide alloy tool steel; and press formed in an oil hydraulic press at room temperature. During the forming process, a pressure of 1.0 GPa was born by the sample; and the forming period was 1 min. After press formed, the material was released from the mould.

7) The cylinders with two different compositions formed in step 6) were solidified in hydrogen atmosphere in different conditions, using a P-C-T tester. More specifically, (1) the $La_{0.7}(Ce,Pr,Nd)_{0.3}Fe_{11.6}Si_{1.4}C_{0.1}$ cylinder formed in step 6) was placed into the high-pressure sample chamber of the P-C-T tester; the sample chamber was vacuumized to a pressure of $1\times10^{-1}$ Pa, set up to a temperature of 120° C., then filled with high-purity $H_2$ (purity: 99.99%); the $H_2$ pressure was adjusted to $1\times10^{-5}$, $2\times10^{-3}$, 0.1054, 1.524, 2.046, 3.179, 4.252, 5.193, 6.131, 7.088, 8.028, 9.527 MPa, respectively, and under each pressure, hydrogen absorption was carried out for 25 mins; then the high-pressure sample chamber was placed in water at room temperature (20° C.), and immediately after this, hydrogen remained in the high-pressure sample chamber was extracted by a mechanical pump and the chamber was cooled down to room temperature; based on the P-C-T analysis and weighting calculation, it was determined that H content was about 2.9; (2) the $La_{0.7}Pr_{0.3}Fe_{11.5}Si_{1.5}C_{0.2}B_{0.05}$ cylinder formed in step 6) was placed into the high-pressure sample chamber of the P-C-T tester; the sample chamber was vacuumized to a pressure of $1\times10^{-1}$ Pa, set up to a temperature of 120° C., then filled with high-purity $H_2$ (purity: 99.99%); the $H_2$ pressure was adjusted to $2\times10^{-4}$, $1\times10^{-3}$, 0.0510, 0.2573, 1.028 MPa, respectively, and hydrogen absorption was carried out for 1 min under each of the first 4 pressures and 50 mins under the fifth pressure (1.028 MPa), so that H atoms were diffused evenly and the adhesive agent was solidified; then the high-pressure sample chamber was placed in water at room temperature (20° C.), and immediately after this, hydrogen remained in the high-pressure sample chamber was extracted by a mechanical pump and the chamber was cooled down to room temperature; based on the P-C-T analysis and weighting calculation, it was determined that H content was about 0.55; so that two hydride magnetic refrigeration materials, i.e. the high-strength, high-strength, bonded $La_{0.7}(Ce,Pr,Nd)_{0.3}Fe_{11.6}Si_{1.4}C_{0.1}H_{2.9}$ and $La_{0.7}Pr_{0.3}Fe_{11.5}Si_{1.5}C_{0.2}B_{0.05}H_{0.55}$ were obtained. It should be understood that the amount of hydrogen absorbed by the alloy depends on the temperature and pressure in the hydrogen absorption process, therefore the amount of the absorbed hydrogen can be adjusted by regulating the temperature and pressure in the hydrogen absorption process and different amount of hydrogen will be absorbed if the hydrogen absorption is terminated under different hydrogen absorption pressure.

Performance Test

Figure 28:
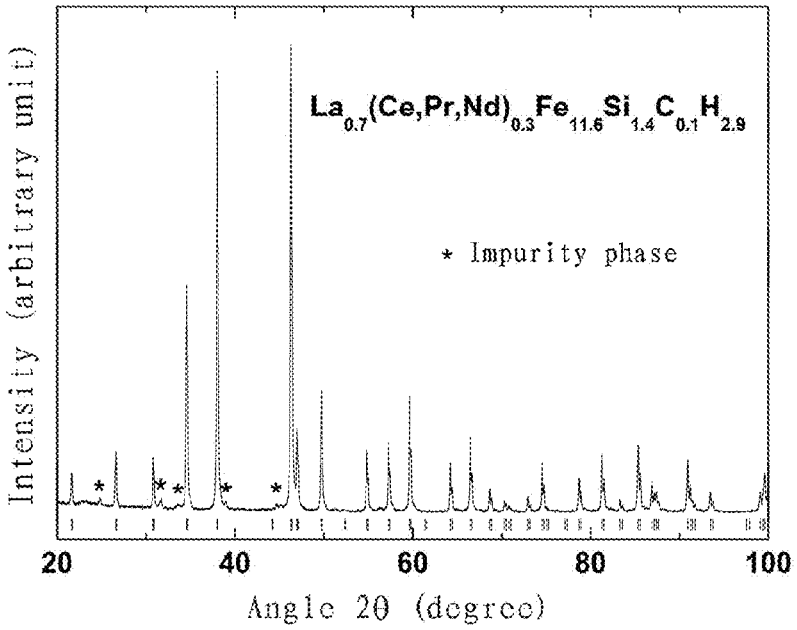
FIG. 28 shows the X-ray Diffraction (XRD) spectrum, at room temperature, of the $La_{0.7}(Ce,Pr,Nd)_{0.3}Fe_{11.6}Si_{1.4}C_{0.1}H_{2.9}$ bulk prepared in Example 7.

I. The X-ray diffraction (XRD) spectra, at room temperature were measured using the Cu-target X-ray diffractometer for the two massive bonded hydride materials $La_{0.7}(Ce,Pr,Nd)_{0.3}Fe_{11.6}Si_{1.4}C_{0.1}H_{2.9}$ and $La_{0.7}Pr_{0.3}Fe_{11.5}Si_{1.5}C_{0.2}B_{0.05}H_{0.55}$ obtained in step 7). The XRD results indicated that they had pure $NaZn_{13}$-type structures. The added epoxide-resin glue was organic, and its diffraction peak was not detected by the Cu-target X-ray diffraction technology. FIG. 28 shows the XRD spectra of the bonded $La_{0.7}(Ce,Pr,Nd)_{0.3}Fe_{11.6}Si_{1.4}C_{0.1}H_{2.9}$.

Figure 29:
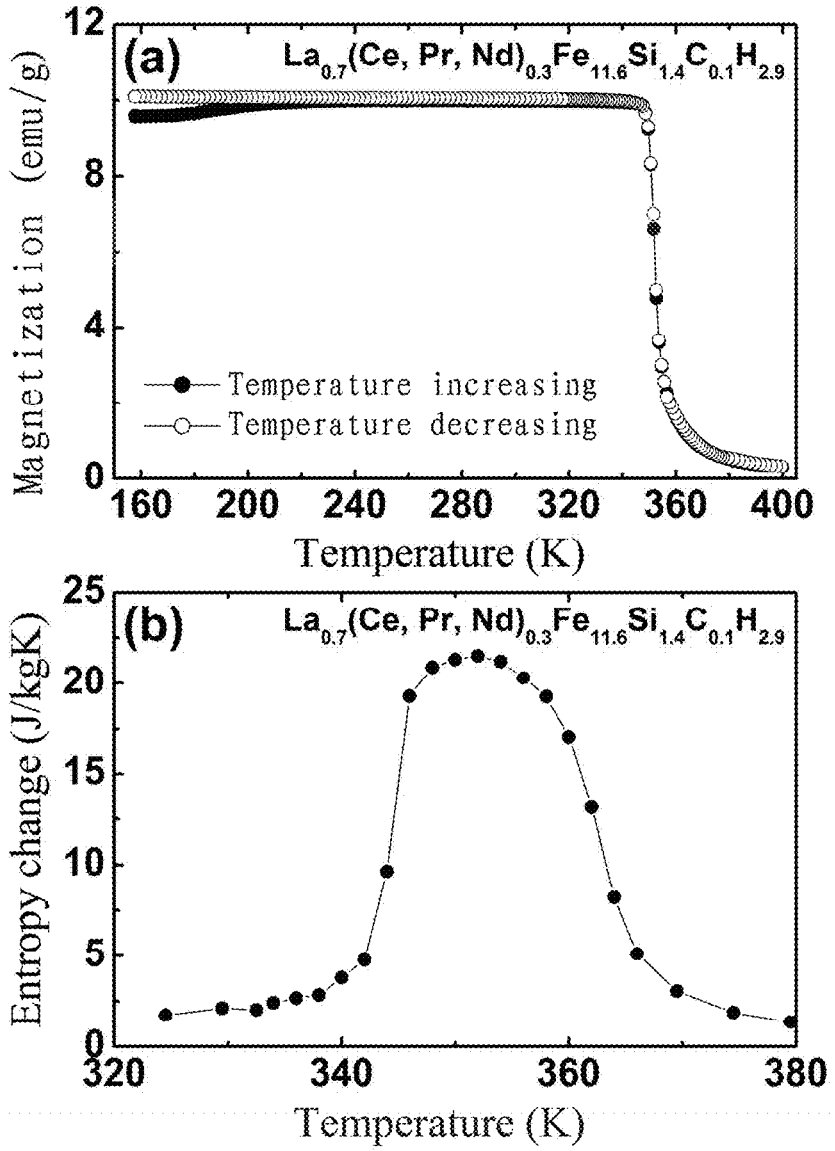
FIG. 29 shows a) the thermomagnetic (M-T) curves, in a magnetic field of 0.02 T; b) the dependency of magnetic entropy change (ΔS) on temperature while magnetic field changes from 0 T to 5 T (calculation of ΔS in the process of increasing the field) for the $La_{0.7}(Ce,Pr,Nd)_{0.3}Fe_{11.6}Si_{1.4}C_{0.1}H_{2.9}$ hydride prepared in Example 7, after being bonded and solidified.
Figure 30:
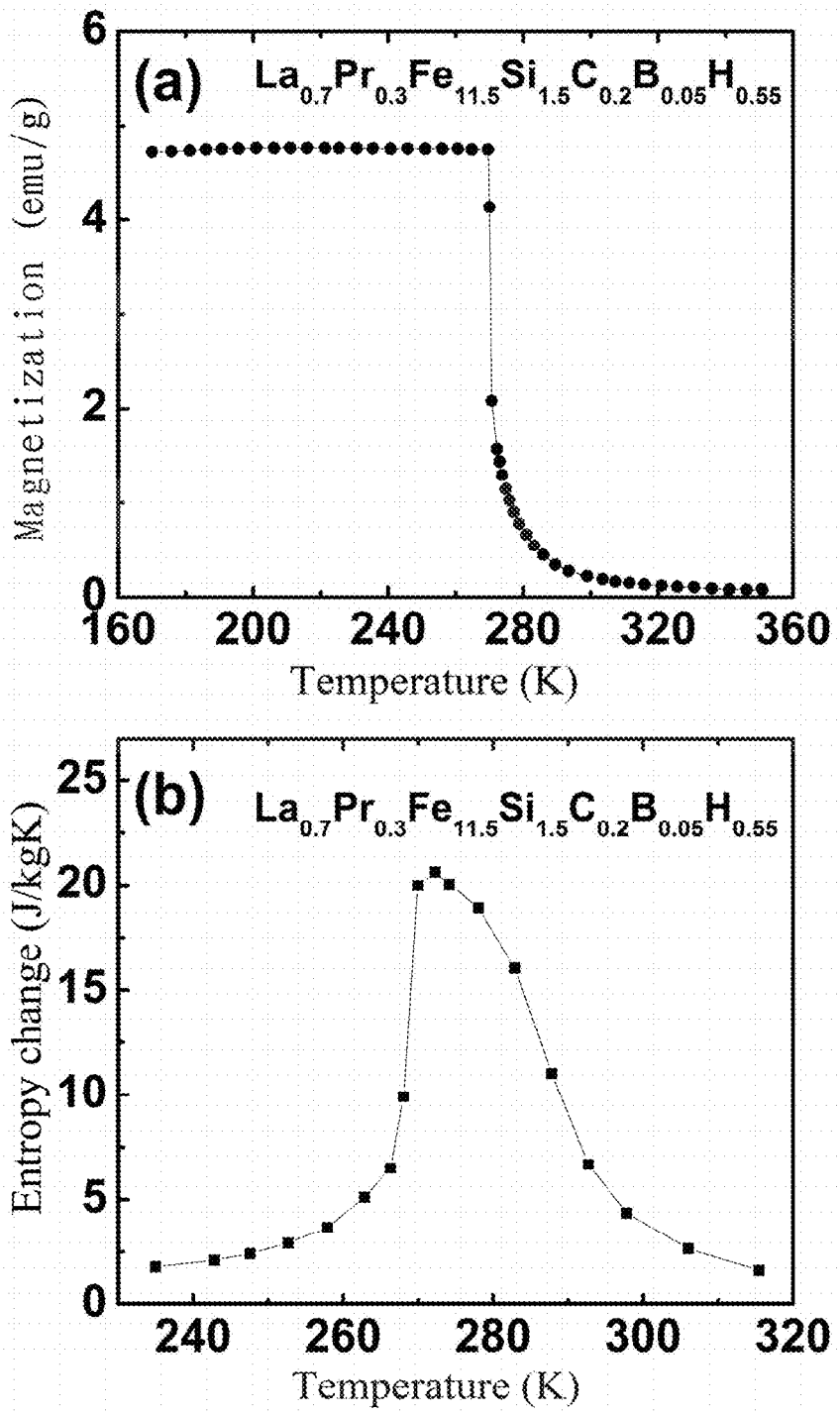
FIG. 30 shows a) the thermomagnetic (M-T) curves, in a magnetic field of 0.02 T; b) the dependency of magnetic entropy change (ΔS) on temperature while magnetic field changes from 0 T to 5 T (calculation of ΔS in the process of increasing the field) for the $La_{0.7}Pr_{0.3}Fe_{11.5}Si_{1.5}C_{0.2}B_{0.05}H_{0.55}$ hydride prepared in Example 7, after being bonded and solidified.

II. The magnetisition was measured for the two massive bonded hydride materials $La_{0.7}(Ce,Pr,Nd)_{0.3}Fe_{11.6}Si_{1.4}C_{0.1}H_{2.9}$ and $La_{0.7}Pr_{0.3}Fe_{11.5}Si_{1.5}C_{0.2}B_{0.05}H_{0.55}$ obtained in step 7), on MPMS (SQUID)VSM. FIGS. 29*a, b*/FIGS. 30*a, b* show thermomagnetic curves (M-T curves) in a magnetic field of 0.02 T, and the dependency of magnetic entropy change (ΔS, calculated on the basis of the Maxwell's equation) on temperature (calculation of ΔS in the process of increasing the field) of the former and latter materials, respectively. We found that the two massive bonded hydride materials $La_{0.7}(Ce,Pr,Nd)_{0.3}Fe_{11.6}Si_{1.4}C_{0.1}H_{2.9}$ and $La_{0.7}Pr_{0.3}Fe_{11.5}Si_{1.5}C_{0.2}B_{0.05}H_{0.55}$ had phase-transition temperatures of ~352K and ~270K, respectively; maximal magnetic entropy change value of 21.5 J/kgK and 20.5 J/kgK, respectively; and both showed considerable magnetocaloric effect.

III. The relation between the bearing pressure and strain was measured using an electronic universal testing machine (CMT4305) for the two massive bonded hydride materials $La_{0.7}(Ce,Pr,Nd)_{0.3}Fe_{11.6}Si_{1.4}C_{0.1}H_{2.9}$ and $La_{0.7}Pr_{0.3}Fe_{11.5}Si_{1.5}C_{0.2}B_{0.05}H_{0.55}$ obtained in step 7). It was found that the compressive strength was up to 47 MPa and 45 MPa, respectively.

Conclusion: La (Fe, Si)$_{13}$-based carbonboronhydrogen interstitial compounds with considerable compressive strength can be obtained by solidifying the bonded La(Fe, Si)$_{13}$-based carbonboron compounds in hydrogen atmosphere; the temperature at which the maximal magnetic entropy change occurs can be adjusted towards to high-temperature zone significantly through the hydrogen absorption process, which is very important to the magnetic refrigerating application in practice.

Example 8: Preparation of Three High-Strength Magnetocaloric Materials $La_{0.8}Ce_{0.2}Fe_{11.4}Si_{1.6}B_{\alpha}$ ($\alpha$=0, 0.2 and 0.4)

1) The materials were prepared in accordance with the chemical formula $La_{0.8}Ce_{0.2}Fe_{11.4}Si_{1.6}B_{\alpha}$ ($\alpha$=0, 0.2 and 0.4). The raw materials included La, industrial-pure LaCe alloy, Fe, Si and FeB, wherein elementary La could also be used to make up the La insufficience in the mischmetal, and FeB alloy was used to provide B. The amount of the elementary Fe added thereto was reduced properly since the FeB alloy also contains Fe element, so that the proportion of each element added still met the requirement for the atomic ratio in the chemical formula of the magnetic material.

2) The raw materials prepared in step 1), after mixed, was loaded into an arc furnace. The arc furnace was vacuumized to a pressure of $2\times10^{-3}$ Pa, purged with high-purity argon with a purity of 99.996 wt % twice, and then filled with high-purity argon with a purity of 99.996 wt % to a pressure of 1.4 atm. The arc was struck (the raw materials were smelted together to form alloy after striking) to generate alloy ingots. Each alloy ingot was smelted at a temperature of 1800° C. repeatedly for six times. After the smelting, the ingot alloys were obtained by cooling down in a copper crucible.

3) After wrapped separately with molybdenum foil and sealed in a vacuumized quartz tube ($1\times10^{-4}$ Pa), the ingot alloy obtained from step 2) was annealed at 1030° C. for 60 days followed by being quenched in liquid nitrogen by breaking the quartz tube. As a result, three alloys $La_{0.8}Ce_{0.2}Fe_{11.4}Si_{1.6}B_{\alpha}$ ($\alpha$=0, 0.2 and 0.4) were obtained.

4) The three alloys $La_{0.8}Ce_{0.2}Fe_{11.4}Si_{1.6}B_{\alpha}$ ($\alpha$=0, 0.2 and 0.4) obtained in step 3) were crushed into irregular particles with an average particle size in the range of 20200 micron.

5) A glue solution was prepared with the "epoxide-resin BT-801 powder (corresponding curing agent and accelerating agent have been mixed in this product)" purchased from BONT Surface Treatment Material Co., Ltd, Dongguan City, China. The weight ratio of "acetone:absolute ethanol:BT-801 epoxide-resin powder was "1:1:1". Dissolving method: a solution of acetone and absolute ethanol, after mixed, was poured to BT-801 epoxide-resin powder; the mixture was agitated until the powder was dissolved completely in the solution, indicating the accomplishment of preparation of the glue solution. Then the resultant glue solution was poured to the three types of particles $La_{0.8}Ce_{0.2}Fe_{11.4}Si_{1.6}B_{\alpha}$ ($\alpha$=0, 0.2 and 0.4) obtained in step 4) according to a weight ratio of "alloy particles:BT-801 epoxide-resin powder"="100:2.5", mixed evenly, and laid flat in an oven at 50° C. until dried out. The drying period was 180 mins.

6) $La_{0.8}Ce_{0.2}Fe_{11.4}Si_{1.6}B_{\alpha}$ ($\alpha$=0, 0.2 and 0.4) alloy particles (mixed with the adhesive agent) obtained in step 5) were press formed into cylinders (diameter: 5 mm; height: 7 mm) The procedure is shown as below: the alloy particles were, after mixed with the adhesive agent, loaded into a mould (in a shape of cylinder with a diameter of 5 mm) made of high chromium carbide alloy tool steel; and press formed in an oil hydraulic press at room temperature. The forming pressure was 1.0 GPa; and the forming period was 5 mins. After press formed, the material was released from the mould.

7) Each of the cylinders formed in step 6) was solidified in vacuum (vacuum degree: $1\times10^{-1}$ Pa). The solidification temperature was 170° C., and the solidification period was 30 mins. After solidification, high-strength first-order phase-transition $La_{0.8}Ce_{0.2}Fe_{11.4}Si_{1.6}B_{\alpha}$ ($\alpha$=0, 0.2 and 0.4) magnetocaloric materials were obtained.

Performance Test

Figure 31:
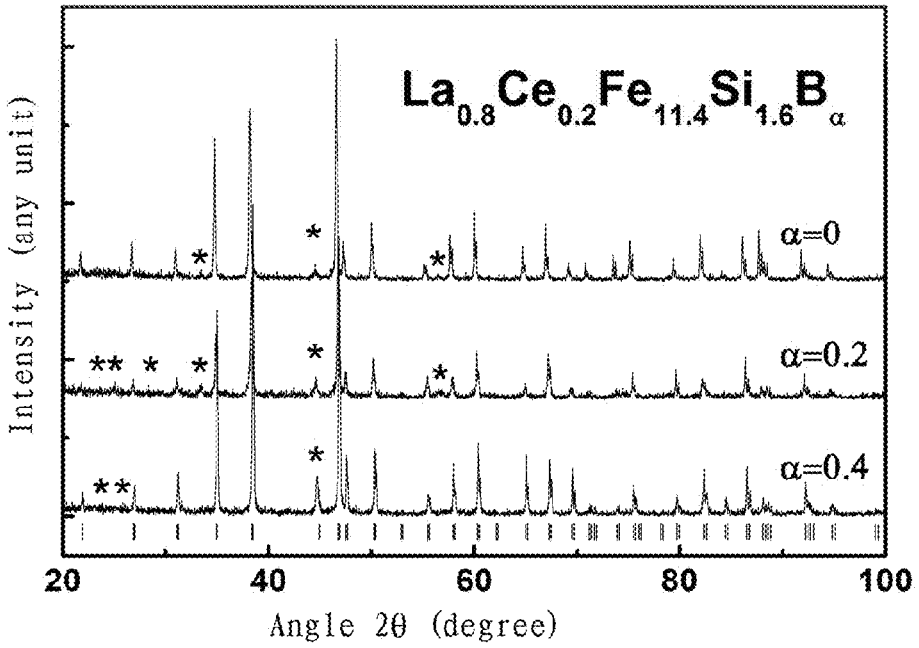
FIG. 31 shows the X-ray Diffraction (XRD) spectra, at room temperature, of the massive materials obtained by forming the three alloys $La_{0.8}Ce_{0.2}Fe_{11.4}Si_{1.6}B_{\alpha}$, (α=0, 0.2 and 0.4) prepared in Example 8 under 1.0 GPa and solidifying the formed materials in vacuum.

I. The X-ray diffraction (XRD) spectra, at room temperature were measured using the Cu-target X-ray diffractometer for the $La_{0.8}Ce_{0.2}Fe_{11.4}Si_{1.6}B_{\alpha}$ ($\alpha$=0, 0.2 and 0.4) alloy particles obtained in step 4) and the massive material formed under a pressure of 1.0 GPa and solidified in vacuum. The XRD results, as shown in FIG. 31, indicated that the alloy particles were crystallized into a $NaZn_{13}$-type structure, but a small amount of $\alpha$-Fe and other impurity phase was detected. After solidification, the samples still had a $NaZn_{13}$-type structure and the amount of the impurity phases were not changed much. The added epoxide-resin glue was organic, and its diffraction peak was not detected by the Cu-target X-ray diffraction technology.

Figure 32:
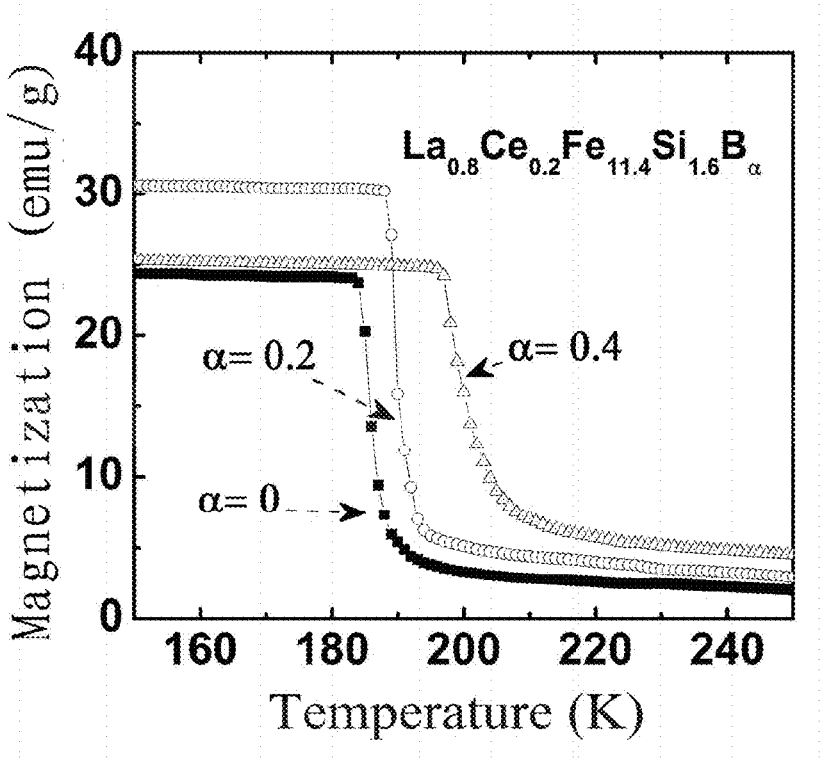
FIG. 32 shows the thermomagnetic (M-T) curves, in a magnetic field of 0.02 T, of the massive materials obtained by forming the three alloys $La_{0.8}Ce_{0.2}Fe_{11.4}Si_{1.6}B_{\alpha}$ (α=0, 0.2 and 0.4) prepared in Example 8 under 1.0 GPa and solidifying the formed materials in vacuum.
Figure 33:
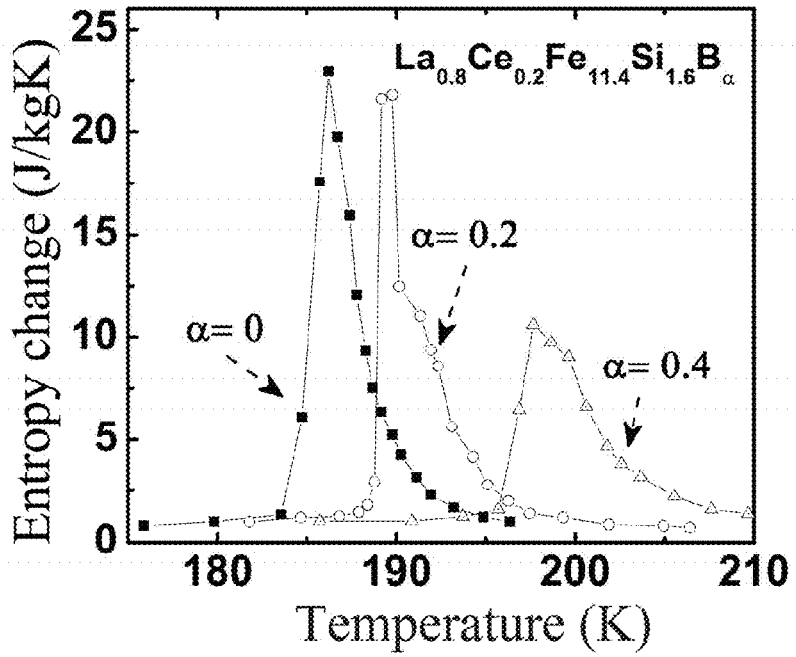
FIG. 33 indicates the dependency of magnetic entropy change (ΔS) on temperature while magnetic field changes from 0 T to 5 T for the massive materials obtained by forming the three alloys $La_{0.8}Ce_{0.2}Fe_{11.4}Si_{1.6}B_{\alpha}$ (α=0, 0.2 and 0.4) prepared in Example 8 under 1.0 GPa and solidifying the formed materials in vacuum (calculation of ΔS in the process of increasing the field)

II. The magnetisition was measured for the alloy particles obtained in step 4) and the massive materials obtained in step 7), on MPMS (SQUID) VSM. FIG. 32 shows thermomagnetic curves (M-T curves), in a magnetic field of 0.02 T, of the sample solidified in step 7). It was found that the phase-transition temperatures of $La_{0.8}Ce_{0.2}Fe_{11.4}Si_{1.6}B_{\alpha}$ were 186K ($\alpha$=0), 190K ($\alpha$=0.2) and 199K ($\alpha$=0.4), respectively. As calculated on the basis of the Maxwell's equation, the magnetic entropy change values of the samples solidified in step 7) were 23 J/kgK ($\alpha$=0), 21 J/kgK ($\alpha$=0.2) and 10 J/kgK ($\alpha$=0.4), respectively, while the magnetic field was changed from 0 T to 5 T.

III. The relation between the bearing pressure and strain was measured using an electronic universal testing machine (CMT4305) for the massive materials obtained in step 7). It was found that the compressive strength was 124 MPa, 119 MPa and 131 MPa for the three materials ($\alpha$=0, 0.2 and 0.4), respectively.

Example 9: Preparation of Four High-Strength Magnetocaloric Materials $La_{0.9}Ce_{0.1}(Fe_{0.6}Co_{0.2}Mn_{0.2})_{13-y}Si_y$ and $La_{0.9}Ce,Pr,Nd)_{0.1}(Fe_{0.6}Co_{0.2}Mn_{0.2})_{13-y}Si_y$ (y=0.9 and 1.8)

1) The materials were prepared in accordance with the chemical formula $La_{0.9}Ce_{0.1}(Fe_{0.6}Co_{0.2}Mn_{0.2})_{13-y}Si_y$ (y=0.9 and 1.8) and $La_{0.9}(Ce,Pr,Nd)_{0.1}(Fe_{0.6}Co_{0.2}Mn_{0.2})_{13-y}Si_y$ (y=0.9 and 1.8). The raw materials included industrial-pure LaCe alloy, mischmetal La—Ce—Pr—Nd (purity: 98.2 wt %), Fe, Si, Co, Mn and La, wherein elementary La could also be used to make up the La insufficience in the mischmetal.

2) The raw materials prepared in step 1), after mixed, was loaded into an arc furnace. The arc furnace was vacuumized to a pressure of $2\times10^{-3}$ Pa, purged with high-purity argon with a purity of 99.6% twice, and then filled with high-purity argon with a purity of 99.6% to a pressure of 0.6 atm. The arc was struck (the raw materials were smelted together to form alloy after striking) to generate alloy ingots. Each alloy ingot was smelted at a temperature of 2400° C. repeatedly for five times. After the smelting, the ingot alloys were obtained by cooling down in a copper crucible.

3) After wrapped separately with molybdenum foil, the ingot alloys obtained from step 2) was annealed in a vacuum furnace ($9\times10^{-4}$ Pa), at 1350° C. for 2 hours followed by furnace cooling to room temperature. As a result, four types of alloys $La_{0.9}Ce_{0.1}(Fe_{0.6}Co_{0.2}Mn_{0.2})_{13-y}Si_y$ and $La_{0.9}(Ce,Pr,Nd)_{0.1}(Fe_{0.6}Co_{0.2}Mn_{0.2})_{13-y}Si_y$ (y=0.9 and 1.8) were obtained.

4) The alloys $La_{0.9}Ce_{0.1}(Fe_{0.6}Co_{0.2}Mn_{0.2})_{13-y}Si_y$ and $La_{0.9}(Ce,Pr,Nd)_{0.1}(Fe_{0.6}Co_{0.2}Mn_{0.2})_{13-y}Si_y$ (y=0.9 and 1.8) were crushed into irregular particles with an average particle size in the range of 20~200 micron.

5) A glue solution was prepared with the "epoxide-resin BT-801 powder (corresponding curing agent and accelerating agent have been mixed in this product)" purchased from BONT Surface Treatment Material Co., Ltd, Dongguan City, China. The weight ratio of "acetone:absolute ethanol:BT-801 epoxide-resin powder" was "1:1:1". Dissolving method: a solution of acetone and absolute ethanol, after mixed, was poured to BT-801 epoxide-resin powder; the mixture was agitated until the powder was dissolved completely in the solution, indicating the accomplishment of preparation of the glue solution. Then the resultant glue solution was poured to the four types of particles $La_{0.9}Ce_{0.1}(Fe_{0.6}Co_{0.2}Mn_{0.2})_{13-y}Si_y$ and $La_{0.9}(Ce,Pr,Nd)_{0.1}(Fe_{0.6}Co_{0.2}Mn_{0.2})_{13-y}Si_y$ (y=0.9 and 1.8) obtained in step 4) according to a weight ratio of "alloy particles:BT-801 epoxide-resin powder"="100:4.5", mixed evenly, and laid flat in an oven at 50° C. until dried out. The drying period was 180 mins.

6) $La_{0.9}Ce_{0.1}(Fe_{0.6}Co_{0.2}Mn_{0.2})_{13-y}Si_y$ and $La_{0.9}(Ce,Pr,Nd)_{0.1}(Fe_{0.6}Co_{0.2}Mn_{0.2})_{13-y}Si_y$ (y=0.9 and 1.8) alloy particles (mixed with the adhesive agent) obtained in step 5) were press formed into cylinders (diameter: 5 mm; height: 7 mm) The procedure is shown as below: the alloy particles were, after mixed with the adhesive agent, loaded into a mould (in a shape of cylinder with a diameter of 5 mm) made of high chromium carbide alloy tool steel; and press formed in an oil hydraulic press at room temperature. In the parallel experiments, the forming pressure was 0.75 GPa; and the forming period was 10 mins. After press formed, the material was released from the mould.

7) Each of the cylinders formed in step 6) was solidified in vacuum (vacuum degree: 9.5 MPa). The solidification temperature was 160° C., and the solidification period was 10 mins. After solidification, four types of high-strength, first-order phase-transition $La_{0.9}Ce_{0.1}(Fe_{0.6}Co_{0.2}Mn_{0.2})_{13-y}Si_y$ and $La_{0.9}(Ce,Pr,Nd)_{0.1}(Fe_{0.6}Co_{0.2}Mn_{0.2})_{13-y}Si_y$ (y=0.9 and 1.8) magnetocaloric materials were obtained.

Performance Test

Figure 34:
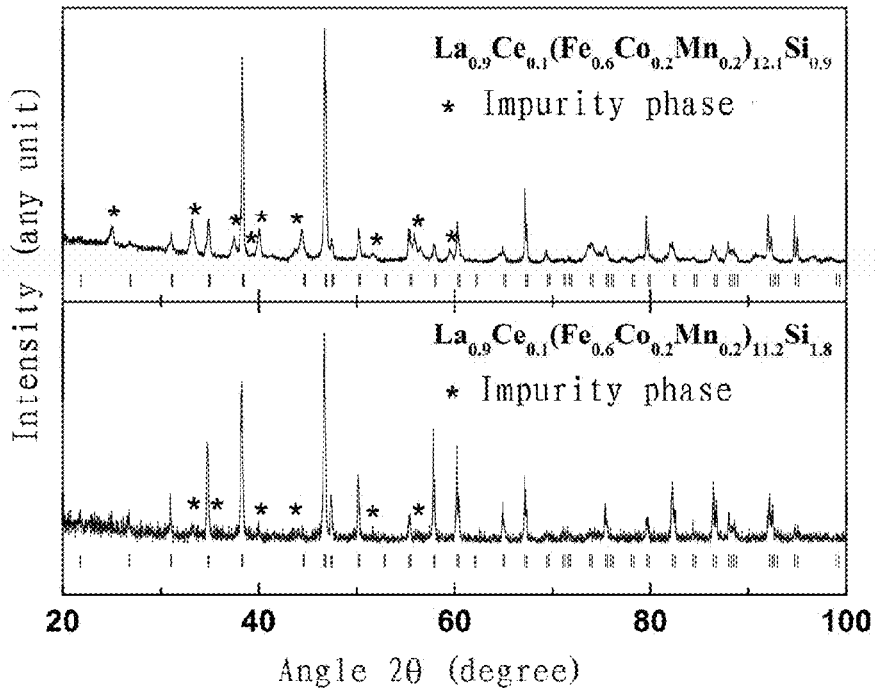
FIG. 34 shows the X-ray Diffraction (XRD) spectra, at room temperature, of the two alloy blocks $La_{0.9}Ce_{0.1}(Fe_{0.6}Co_{0.2}Mn_{0.2})_{13-y}Si_y$ (y=0.9 and 1.8) prepared in Example 9.

I. The X-ray diffraction (XRD) spectra, at room temperature, were measured using the Cu-target X-ray diffractometer for the $La_{0.9}Ce_{0.1}(Fe_{0.6}Co_{0.2}Mn_{0.2})_{13-y}Si_y$ (y=0.9 and 1.8) and $La_{0.9}(Ce,Pr,Nd)_{0.1}(Fe_{0.6}Co_{0.2}Mn_{0.2})_{13-y}Si_y$ (y=0.9 and 1.8) alloy particles obtained in step 4). The XRD results indicated that their main phases had $NaZn_{13}$-type structures, and α-Fe and other unknown impurity phases were also detected. FIG. 34 shows the XRD spectra measured at room temperature for $La_{0.9}Ce_{0.1}(Fe_{0.6}Co_{0.2}Mn_{0.2})_{13-y}Si_y$ (y=0.9 and 1.8) and $La_{0.9}(Ce,Pr,Nd)_{0.1}(Fe_{0.6}Co_{0.2}Mn_{0.2})_{13-y}Si_y$ (y=0.9 and 1.8) alloy particles, wherein the impurity phases were labeled as "*". After mixed with the adhesive agent, formed under a forming pressure of 0.75 GPa and solidified in vacuum, the samples still contained impurity phases in a similar amount. The added 4.5% epoxide-resin glue was organic, and its diffraction peak was not detected by the Cu-target X-ray diffraction technology.

Figure 35:
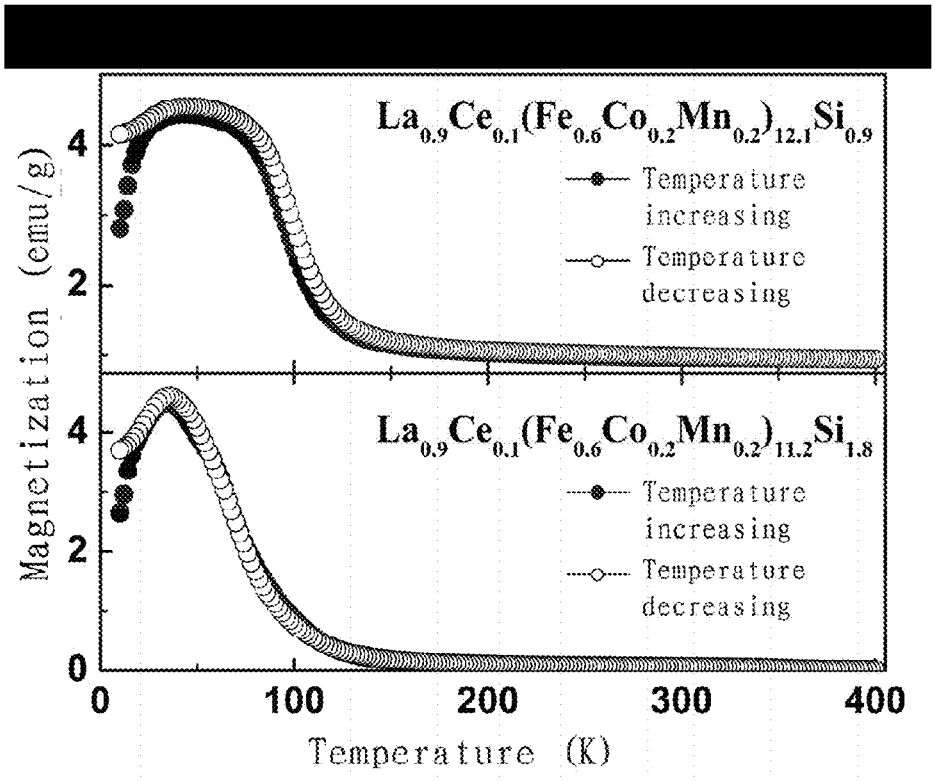
FIG. 35 shows the thermomagnetic (M-T) curves, in a magnetic field of 0.02 T, of the two alloy blocks $La_{0.9}Ce_{0.1}(Fe_{0.6}Co_{0.2}Mn_{0.2})_{13-y}Si_y$ (y=0.9 and 1.8) prepared in Example 9.
Figure 36:
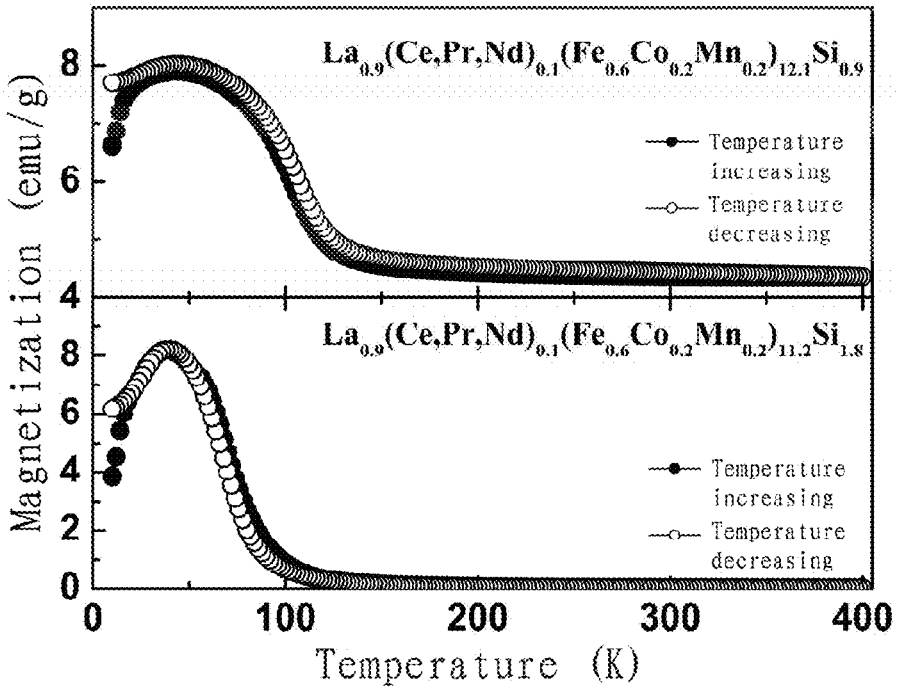
FIG. 36 shows the thermomagnetic (M-T) curves, in a magnetic field of 0.02 T, of the two alloy blocks $La_{0.9}(Ce,Pr,Nd)_{0.1}(Fe_{0.6}Co_{0.2}Mn_{0.2})_{13-y}Si_y$ (y=0.9 and 1.8) prepared in Example 9.

II. The magnetisition was measured for the $La_{0.9}Ce_{0.1}(Fe_{0.6}Co_{0.2}Mn_{0.2})_{13-y}Si_y$ and $La_{0.9}(Ce,Pr,Nd)_{0.1}(Fe_{0.6}Co_{0.2}Mn_{0.2})_{13-y}Si_y$ (y=0.9 and 1.8) alloy particles obtained in step 4) and the massive materials formed and solidified, on MPMS (SQUID)VSM. FIGS. 35 and 36 shows thermomagnetic curves (M-T curves), in a magnetic field of 0.02 T, of $La_{0.9}Ce_{0.1}(Fe_{0.6}Co_{0.2}Mn_{0.2})_{13-y}Si_y$ and $La_{0.9}(Ce,Pr,Nd)_{0.1}(Fe_{0.6}Co_{0.2}Mn_{0.2})_{13-y}Si_y$ (y=0.9 and 1.8) alloy particles, respectively. It was found that $La_{0.9}Ce_{0.1}(Fe_{0.6}Co_{0.2}Mn_{0.2})_{13-y}Si$ (y=0.9 and 1.8) had phase-transition temperatures of 97K and 70K and magnetic entropy change values (as calculated on the basis of the Maxwell's equation while the magnetic field was changed from 0 T to 5 T) of 1.1 J/kgK and 2.0 J/kgK, respectively; and $La_{0.9}(Ce,Pr,Nd)_{0.1}(Fe_{0.6}Co_{0.2}Mn_{0.2})_{13-y}Si_y$ (y=0.9 and 1.8) had phase-transition temperatures of 100K and 70K and magnetic entropy change values (as calculated on the basis of the Maxwell's equation while the magnetic field was changed from 0 T to 5 T) of 1.5 J/kgK and 2.4 J/kgK, respectively. After solidification, neither the phase-transition temperature nor the entropy change was changed significantly.

III. The relation between the bearing pressure and strain was measured using an electronic universal testing machine (CMT4305) for the samples formed under different forming pressure followed by solidification. It was found that after formed under 0.75 GPa and solidified in vacuum, $La_{0.9}Ce_{0.1}(Fe_{0.6}Co_{0.2}Mn_{0.2})_{13-y}Si$ (y=0.9 and 1.8) materials showed compressive strength of 92.1 MPa and 95.2 MPa, respectively; and $La_{0.9}(Ce,Pr,Nd)_{0.1}(Fe_{0.6}Co_{0.2}Mn_{0.2})_{13-y}Si_y$ (y=0.9 and 1.8) materials showed compressive strength of 85.1 MPa and 93.2 MPa, respectively.

Conclusion: Considering this Example in combination with Example 3, it can be confirmed that a La(Fe, SOD-based magnetocaloric material having a main phase in a $NaZn_{13}$-type structure and a larger component range (Co content: $0 \le p \le 0.2$, Mn content: $0 \le q \le 0.2$, Si content: $0.8 \le y \le 2$) can be prepared from industrial-pure LaCe alloy and industrial-pure La—Ce—Pr—Nd as raw materials, using said preparation method. A bonded $La(Fe,Si)_{13}$-based magnetocaloric material with high compressive strength can be obtained by the said bonding process.

The invention has been described in detail by referring to the specific embodiments above. A person skilled in the field shall understand that the above specific embodiments should not be interpreted to restrict the scope of the invention. Therefore, without deviating from the spirit and extent of the invention, the embodiments of the invention can be altered and modified.

The invention claimed is:

1. A high-strength, bonded $La(Fe, Si)_{13}$-based magnetocaloric material, comprising:

magnetocaloric alloy particles represented by the chemical formula $La_{1-x}(Fe_{1-p-q}Co_pMn_q)_{13-y}Si_yA_\alpha$, having a $NaZn_{13}$ structure, wherein all of the particles having the chemical formula $La_{1-x}R_x(Fe_{1-p-q}Co_pMn_q)_{13-y}Si_yA_\alpha$ have a particle size in the range of 15-200 μm: and an adhesive agent, wherein, the magnetocaloric alloy particles are bonded into a bulk material by the adhesive agent;

wherein, in the chemical formula $La_{1-x}R_x(Fe_{1-p-q}Co_pMn_q)_{13-y}Si_yA_\alpha$, R is one or more selected from elements Ce, Pr and Nd, A is one or more selected from elements C, H and B, x is in the range of $0 \le x \le 0.5$, y is in the range of $0.8 \le y \le 2$, p is in the range of $0 \le p \le 0.2$, q is in the range of $0 \le q \le 0.2$, α is in the range of $0 \le \alpha \le 3.0$, wherein the adhesive agent is a thermosetting adhesive agent that is selected from one or more of epoxide-resin glue, polyimide adhesive, urea resin, phenol-formaldehyde resin and diallyl phthalate, wherein the high-strength, bonded La (Fe, $Si)_{13}$-based magnetocaloric material has a compressive strength of at least 47.6 MPa, wherein, relative to 100 parts by weight of the magnetocaloric alloy particles, the adhesive agent is contained in an amount of 1-10 parts by weight, wherein an effective refrigerating capacity of the high-strength, bonded $La(Fe, Si)_{13}$-based magnetocaloric material is greater than an effective refrigerating capacity of the magnetocaloric alloy particles prior to forming the high-strength, bonded $La(Fe, Si)_{13}$-based magnetocaloric material.

2. The high-strength, bonded $La(Fe, Si)_{13}$-based magnetocaloric material according to claim 1, wherein, relative to 100 parts by weight of the magnetocaloric alloy particles, the adhesive agent is contained in an amount of 2~5 parts by weight.

3. The high-strength, bonded $La(Fe, Si)_{13}$-based magnetocaloric material according to claim 2, wherein, relative to 100 parts by weight of the magnetocaloric alloy particles, the adhesive agent is contained in an amount of 2.5 to 4.5 parts by weight.

4. The high-strength, bonded $La(Fe, Si)_{13}$-based magnetocaloric material according to claim 1, wherein, the magnetocaloric alloy particles is represented by a chemical formula:

$La_{1-x}R_x(Fe_{1-p}Co_p)_{13-y}Si_yA_\alpha$, wherein,

R is selected from one or more of elements Ce, Pr and Nd,

A is selected from one, two or three of elements H, C and B, x is in the range of $0 \le x \le 0.5$, y is in the range of $1 \le y \le 2$, p is in the range of $0 \le p \le 0.1$, α is in the range of $0 \le \alpha \le 2.6$.

5. A magnetic refrigerator, comprising the high-strength, bonded La $(Fe,Si)_{13}$-based magnetocaloric material according to claim 1.

6. A method for preparing the high-strength, bonded $La(Fe, Si)_{13}$-based magnetocaloric material according to claim 1, comprising the steps of:

1) formulating raw materials according to the chemical formula, or formulating raw materials other than hydrogen according to the chemical formula where A includes hydrogen element;

2) placing the raw materials formulated in step 1) in an arc furnace, vacuuming and purging the furnace with an inert gas, and smelting the materials under the protection of an inert gas so as to obtain alloy ingots;

3) vacuum annealing the alloy ingots obtained in step 2) and then quenching the alloy ingots in liquid nitrogen or water, or furnace cooling the alloy ingots to room temperature, so as to obtain the magnetocaloric alloys $La_{1-x}R_x(Fe_{1-p-q}Co_pMn_q)_{13-y}Si_yA_\alpha$ having a $NaZn_{13}$ structure;

4) crushing the magnetocaloric alloys obtained in step 3) so as to obtain magnetocaloric alloy particles with a particle size of 15 to 200 μm;

5) mixing an adhesive agent with the magnetocaloric alloy particles obtained in step 4) evenly, press forming and solidifying the mixture into a massive material;

wherein, when A in the chemical formula includes hydrogen element, the solidification in step 5) is performed in hydrogen gas.

7. The high-strength, bonded $La(Fe, Si)_{13}$-based magnetocaloric material according to claim 1, wherein a magnetic entropy change of the magnetocaloric material is greater than a magnetic entropy change of the magnetocaloric alloy particles prior to forming the magnetocaloric material, wherein the magnetic entropy change is determined using a magnetic field change from 0 Tesla to 5 Tesla.

8. A magnetic refrigerator, comprising the high-strength, bonded $La (Fe,Si)_{13}$-based magnetocaloric material prepared by the method according to claim 6.

9. The method according to claim 8, wherein, in step 5), the adhesive agent is mixed with the magnetocaloric alloy particles by a dry or wet mixing method; wherein the dry mixing method includes the step of mixing the pulverous adhesive agent as well as its curing agent and accelerating agent with the magnetocaloric alloy particles evenly; and the wet mixing method includes the steps of dissolving the adhesive agent as well as its curing agent and accelerating agent in an organic solvent to obtain a glue solution, adding the magnetocaloric alloy particles to the glue solution, mixing evenly and drying the mixture.

10. The method according to claim 8, wherein, in step 5), the press forming is carried out under a compressing pressure of 100 MPa~20 GPa for a compressing period of 1~120 mins.

11. The method according to claim 10, wherein, in step 5), the press forming is carried out under a compressing pressure of 0.1~2.5 GPa for a compressing period of 1~120 mins.

12. The method according to claim 11, wherein, in step 5), the press forming is carried out under a compressing pressure of 100 MPa~20 GPa for a compressing period of 1~10 mins.

13. The method according to claim 8, wherein, in step 5), the solidification is performed in an inert gas and the solidification condition includes a solidification temperature of 70~250° C., a solidification period of 1~300 min, and an inert gas pressure of $10^{-2}$ Pa~10 MPa; or wherein, in step 5), the solidification is performed in a vacuum, and the solidification condition includes a solidification temperature of 70~250° C., a solidification period of 1~300 mins, and a vacuum of <1 Pa; or wherein A in the chemical formula includes hydrogen, the solidification in step 5) is performed in hydrogen gas, and the solidification condition includes a solidification temperature of 70~250° C., a solidification period of 1~300 mins, and a hydrogen gas pressure of $10^{-2}$ Pa~10 MPa.

14. The method according to claim 13, wherein, in step 5), the solidification is performed in an inert gas and the solidification condition includes a solidification temperature of 100-200° C., a solidification period of 10-60 min, and an inert gas pressure of $10^{-2}$ Pa-10 MPa; or wherein, in step 5), the solidification is performed in a vacuum, and the solidification condition includes a solidification temperature of 100~200° C., a solidification period of 10-60 mins, and a vacuum of <1 Pa; or wherein A in the chemical formula includes hydrogen, the solidification in step 5) is performed in hydrogen gas, and the solidification condition includes a solidification temperature of 100~200° C., a solidification period of 10-60 mins, and a hydrogen gas pressure of $10^{-2}$ Pa-10 MPa.

15. The method according to claim 8, wherein, the raw materials La, R are commercially available elementary rare earth elements and/or industrial-pure LaCe alloy and/or industrial-pure LaCePrNd mischmetal; optionally wherein A includes carbon and/or boron element(s), the carbon and/or boron are provided by FeC and/or FeB alloy(s), respectively.

16. The method according to claim 8, wherein, the step 2) comprises the steps of placing the raw material formulated in step 1) into an arc furnace; vacuuming the arc furnace to reach a vacuum degree less than $1\times10^{-2}$ Pa; purging the furnace chamber with an argon gas having a purity higher than 99 wt. %; then filling the furnace chamber with the argon gas to reach 0.5-1.5 atm; and arcing; so as to obtain the alloy ingots; wherein each alloy ingot is smelted at 1500-2500° C. for 1-6 times repeatedly;

the step 3) comprises the steps of annealing the alloy ingots obtained in step 2) at 1000-1400° C., with a vacuum degree less than $1\times10^{-3}$ Pa, for 1 hour—60 days; then quenching the alloy ingots in liquid nitrogen or water, or furnace cooling the alloy ingots to room temperature.

* * * * *